US007614271B2

(12) United States Patent
Ueno et al.

(10) Patent No.: US 7,614,271 B2
(45) Date of Patent: Nov. 10, 2009

(54) PREFORM, HYDROFORMING METHOD, AND HYDROFORMED PRODUCT

(75) Inventors: Kazuto Ueno, Tokyo (JP); Kazuhiro Mitamura, Chigasaki (JP); Satoru Majima, Hiratsuka (JP); Takashi Haraoka, Machida (JP); Masaaki Yoshitome, Sagamihara (JP); Hideto Kanafusa, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 12/146,900

(22) Filed: Jun. 26, 2008

(65) Prior Publication Data

US 2008/0268276 A1 Oct. 30, 2008

Related U.S. Application Data

(62) Division of application No. 11/236,876, filed on Sep. 28, 2005, now Pat. No. 7,406,849.

(30) Foreign Application Priority Data

Sep. 29, 2004 (JP) ..... 2004-285233
Sep. 29, 2004 (JP) ..... 2004-285240

(51) Int. Cl.
*B23K 20/12* (2006.01)
*B23K 20/02* (2006.01)

(52) U.S. Cl. ..... 72/61; 228/112.1; 228/114; 228/157; 228/181; 228/190; 29/421.1; 29/897.2

(58) Field of Classification Search ..... 72/60, 72/61; 228/112.1, 114, 157, 181, 184, 190; 29/421.1, 897.2
See application file for complete search history.

(56) References Cited

U.S. PATENT DOCUMENTS

| | | | | |
|---|---|---|---|---|
| 4,292,375 | A | 9/1981 | Ko | |
| 4,331,284 | A | 5/1982 | Schulz et al. | |
| 4,420,958 | A | 12/1983 | Schulz et al. | |
| 5,323,953 | A | 6/1994 | Adderley et al. | |
| 5,723,225 | A | 3/1998 | Yasui et al. | |
| 5,881,459 | A | 3/1999 | Yasui | |
| 6,568,582 | B2 | 5/2003 | Colligan | |
| 7,406,849 | B2 * | 8/2008 | Ueno et al. | 72/61 |
| 2003/0094026 | A1 | 5/2003 | Hama et al. | |

FOREIGN PATENT DOCUMENTS

| | | | |
|---|---|---|---|
| JP | 2003-320960 | A | 11/2003 |
| JP | 2004-082142 | A | 3/2004 |
| JP | 2004-160485 | A | 6/2004 |

* cited by examiner

*Primary Examiner*—David B Jones
(74) *Attorney, Agent, or Firm*—Foley & Lardner LLP

(57) ABSTRACT

A preform with edges overlapped and jointed each other and first and second outer members for forming outer surfaces of a hydroformed product, and reinforcement members that are jointed to the first and second outer members to form reinforcement ribs that divide a hollow cross section of the outer surfaces, the reinforcement members having dimensions capable of suppressing elongation in a tensile direction due to a tensile force that develops during hydroforming.

4 Claims, 49 Drawing Sheets

50

50

1065

1150 FIG.68
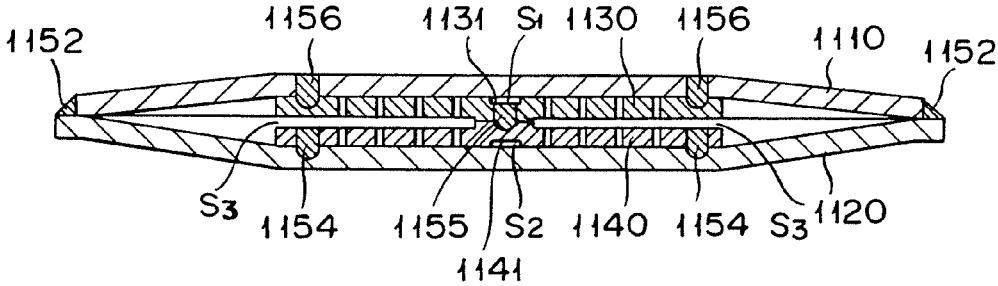
FIG.69
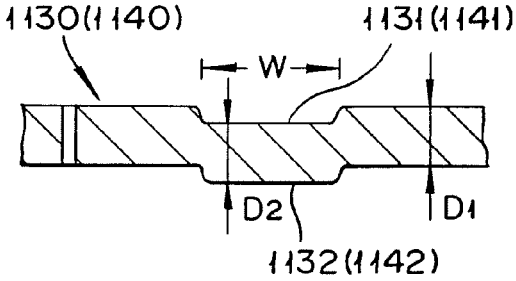
FIG.70
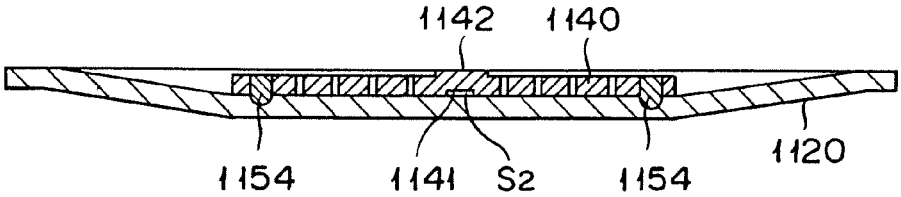
FIG.71
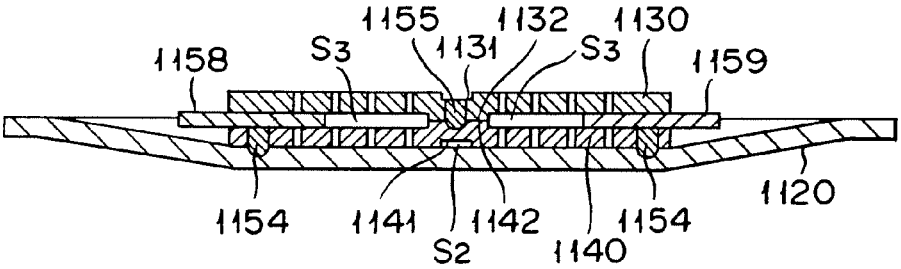

PREFORM, HYDROFORMING METHOD, AND HYDROFORMED PRODUCT

CROSS-REFERENCE TO RELATED APPLICATIONS

The present application is a Divisional of U.S. application Ser. No. 11/236,876, filed Sep. 28, 2005, which is based upon and claims the benefit of priority from prior Japanese Patent Application No. 2004-285233, filed Sep. 29, 2004 and Japanese Patent Application No. 2004-285240, filed Sep. 29, 2004, the entire contents of which are incorporated herein by reference.

BACKGROUND OF THE INVENTION

1. Field of the Invention

The present invention relates to a preform, hydroforming method, and a hydroformed product.

2. Description of the Related Art

A typical automobile body structural member such as a side member has a hollow structure for improving absorption capacity of crash impact, and provided with internal reinforcement members in order to reinforce the strength thereof, and a typical hydroformed product to be used as a body structural member is made by feeding hydraulic pressure to the inside of a preform having two outer members and reinforcement members to cause an inflating deformation (see, e.g., Publication Nos. of Unexamined Japanese Patent Application, 2003-320960 and 2004-82142).

SUMMARY OF THE INVENTION

However, reinforcement ribs are formed as a result of linear expansions of reinforcement members without any material inflow, different from the case of outer members, so that there is a relatively higher chance of fractures of reinforcement members. Consequently, said manufacturing method has a problem that it is rather difficult to form reinforcement ribs securely and maintain stable and excellent strength quality of hydroformed products at the same time.

It is therefore a general object of the invention to provide a preform that can restrain fractures of reinforcement members, a hydroforming method for obtaining a hydroformed product with stable and excellent strength quality, and a hydroformed product with stable and excellent strength quality.

More specifically, it is an object of the invention to provide a preform with edges overlapped and jointed each other and first and second outer members for forming outer surfaces of a hydroformed product, and reinforcement members that are jointed to the first and second outer members to form reinforcement ribs that divide a hollow cross section of the outer surfaces. The reinforcement members have dimensions capable of suppressing elongation in a tensile direction due to a tensile force that develops during hydroforming.

Another object of the invention is to provide a hydroforming method which includes disposing a preform inside forming dies having cavity surfaces that correspond to an outer shape of a hydroformed product, the preform having edges overlapped and jointed each other and including first and second outer members for forming outer surfaces of the hydroformed product, and reinforcement members that are jointed to the first and second outer members to form reinforcement ribs that divide a hollow cross section of the outer surfaces, and the reinforcement members having dimensions capable of suppressing elongation in a tensile direction due to a tensile force that develops during hydroforming, and applying a hydraulic pressure in an inside of the preform while suppressing elongations of the reinforcement members in a tensile direction due to a tensile force developed during inflating deformation of the preform to form the reinforcement ribs that divide the hollow cross section of the hydroformed product.

A further object of the invention is to provide a hydroformed product formed by disposing a preform inside forming dies having cavity surfaces that correspond to an outer shape of a hydroformed product, the preform having edges overlapped and jointed each other and including first and second outer members for forming outer surfaces of the hydroformed product, and reinforcement members that are jointed to the first and second outer members to form reinforcement ribs that divide a hollow cross section of the outer surfaces, and the reinforcement members having dimensions capable of suppressing elongation in a tensile direction due to a tensile force that develops during hydroforming, and applying a hydraulic pressure in an inside of the preform while suppressing elongations of the reinforcement members in a tensile direction due to a tensile force developed during inflating deformation of the preform to form the reinforcement ribs that divide the hollow cross section of the hydroformed product, wherein the reinforcement ribs that divide the hollow cross section of the outer surfaces are formed by means of suppressing elongations of the reinforcement members due to a tensile force developed during hydroforming.

The objects, features, and characteristics of this invention other than those set forth above will become apparent from the description given herein below with reference to preferred embodiments illustrated in the accompanying drawings.

BRIEF DESCRIPTION OF THE DRAWINGS

FIG. 68 is a cross-sectional view of assistance in explaining a preform according to an embodiment B2.

FIG. 69 is a cross-sectional view of assistance in explaining shapes of a lower insertion plate and an upper insertion plate that constitute reinforcement members of the preform shown in FIG. 68.

FIG. 70 is a cross-sectional view of assistance in explaining an example method of jointing reinforcement members in the preform showing the jointing process of the lower insertion plate to a bottom plate.

FIG. 71 is across-sectional view of assistance in explaining jointing process of the upper insertion plate to the lower insertion plate following FIG. 70.

DETAILED DESCRIPTION OF THE PREFERRED EMBODIMENT

The embodiments of this invention will be described below with reference to the accompanying drawings.

Figure 1:
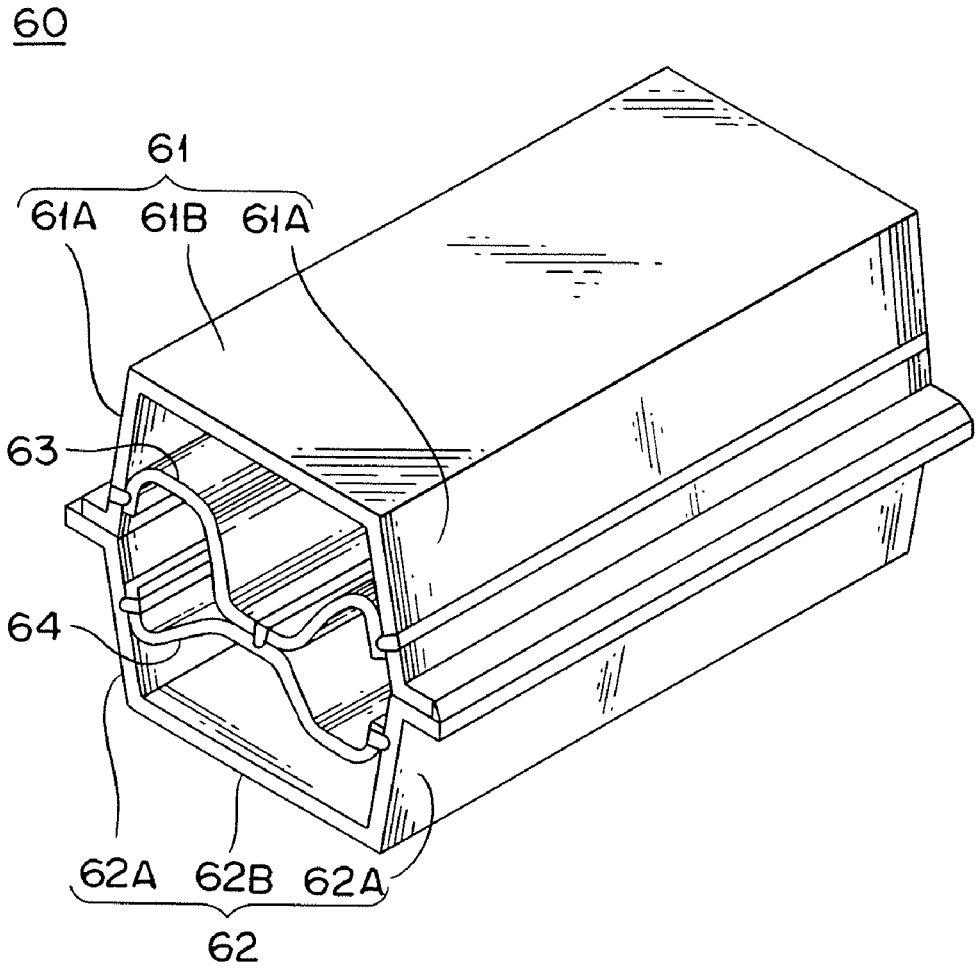
FIG. 1 is a perspective view of assistance in explaining a hydroformed product according to an embodiment A1.
Figure 2:
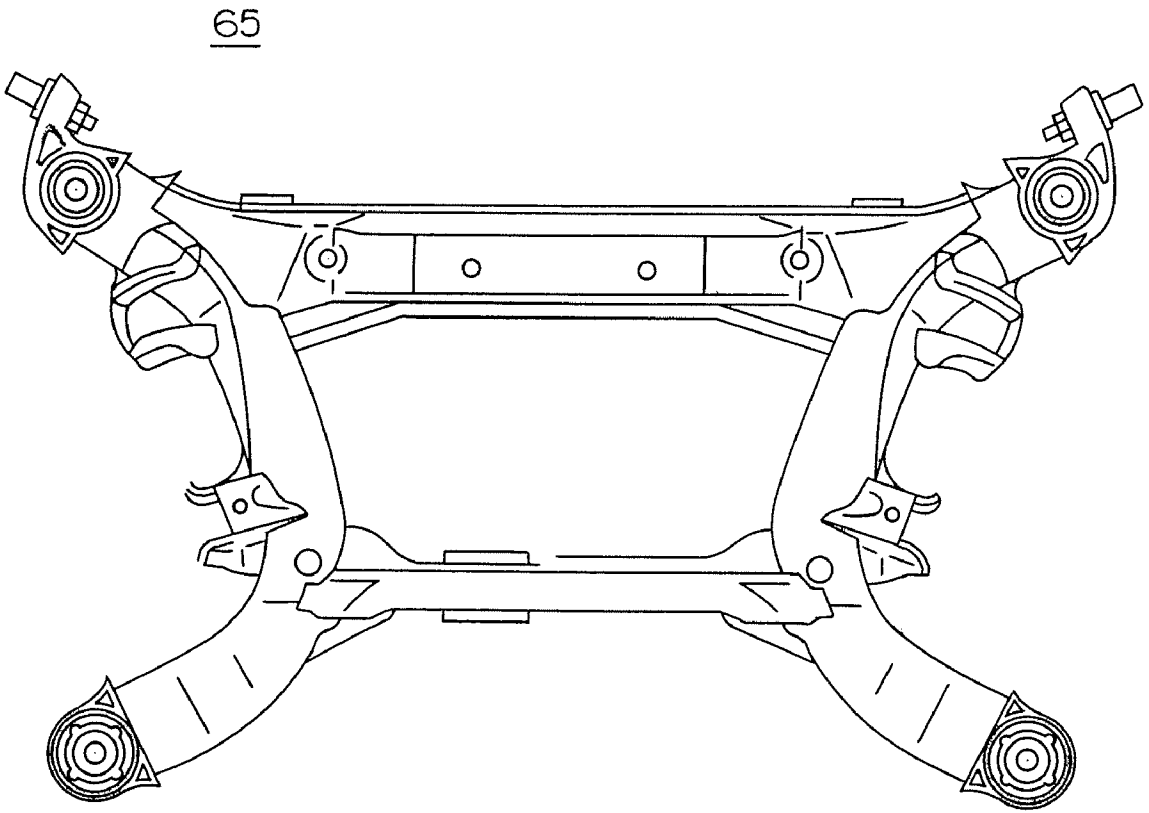
FIG. 2 is a plan view of assistance in explaining an automobile part to which the hydroformed product shown in FIG. 1 is applied.

FIG. 1 is a perspective view of assistance in explaining a hydroformed product according to an embodiment A1 and FIG. 2 is a plan view of assistance in explaining an automobile part to which the hydroformed product shown in FIG. 1 is applied.

A hydroformed product 60 has outer surfaces 61, 62 forming a hollow structure and reinforcement ribs 63, 64 and is applied to automobile parts that require lighter weight and high rigidity, such as a side member or a cross member of a suspension part 65. The hydroformed product 60 can also be applied to pillar parts, axle parts, or body side parts.

Outer surfaces 61, 62 have sidewalls 61A, 62A that are inclined relative to an overlapping surface OS and summit parts 61B, 62B that are surrounded by the sidewalls 61A, 62A. The reinforcement ribs 63, 64 are dividing hollow cross section of outer surfaces 61, 62 and supporting sidewalls 61A, 62A in order to improve the rigidity relative to the horizontal direction or lateral direction relative to the overlapping surface OS. The reinforcement ribs 63, 64 are formed into bending shapes resulting from minimizing elongations in the tensile directions by controlling the tensile forces that occur during hydroforming.

Figure 3:
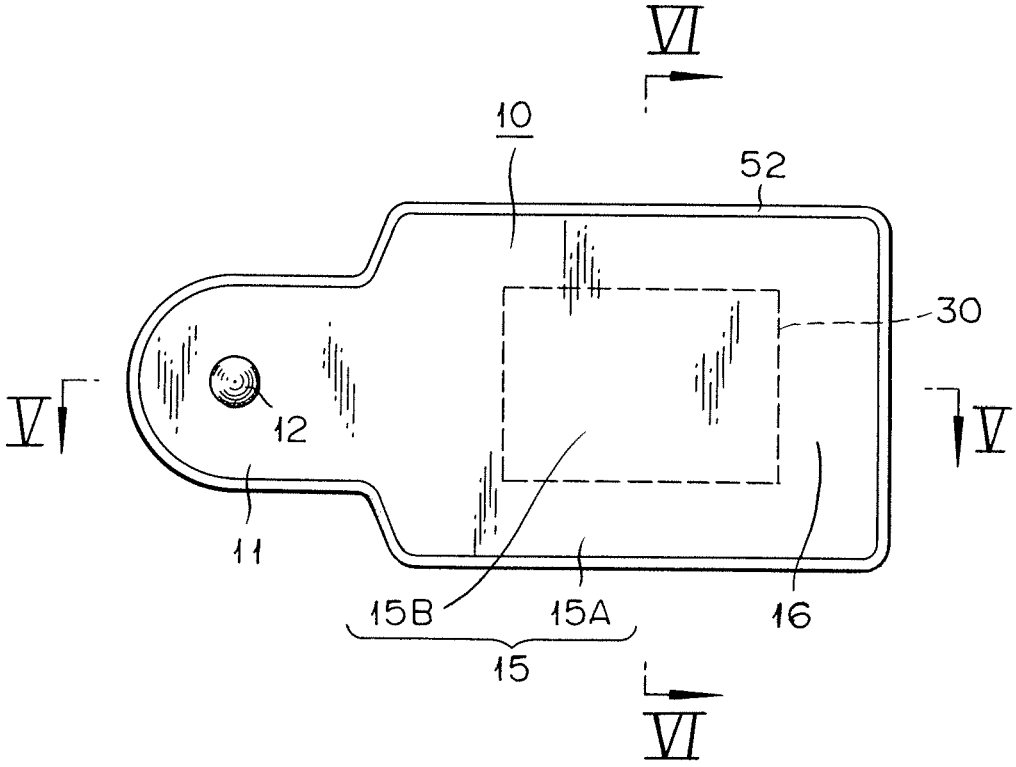
FIG. 3 is a plan view of assistance in explaining a preform according to the embodiment A1.
Figure 4:
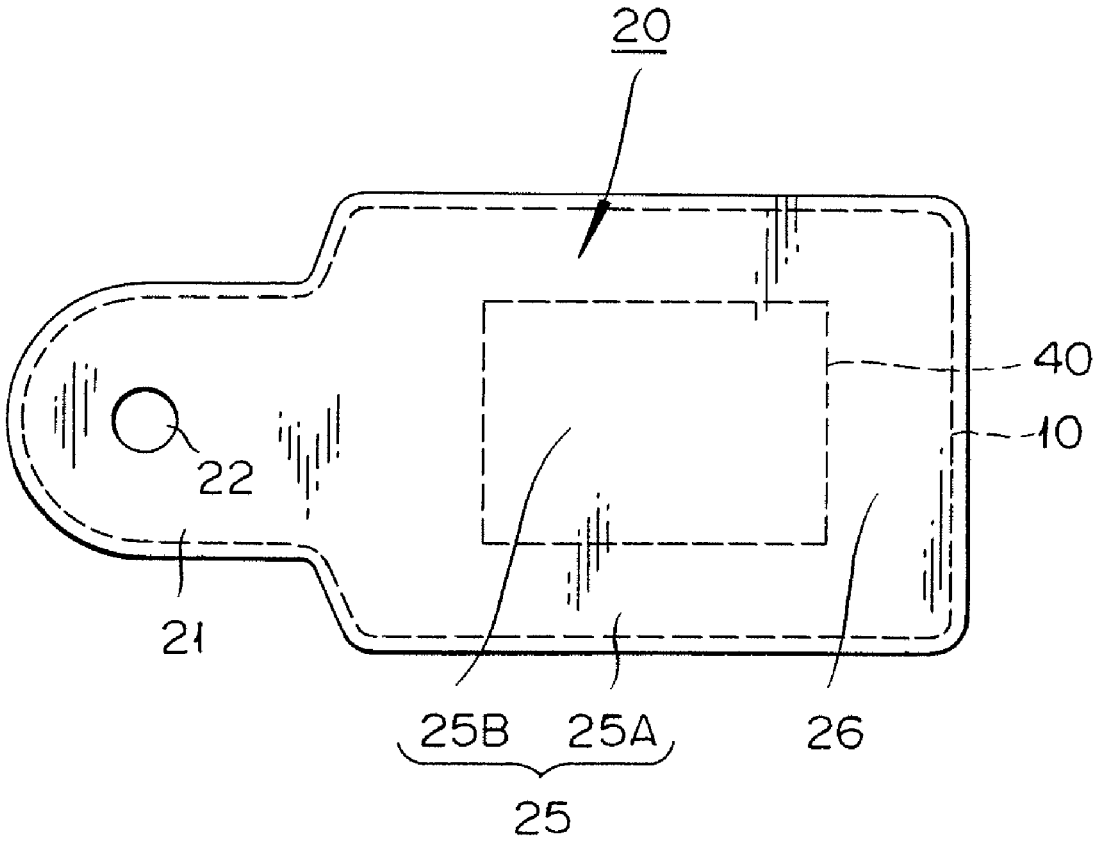
FIG. 4 is a rear elevation of the preform shown in FIG. 3.
Figure 5:
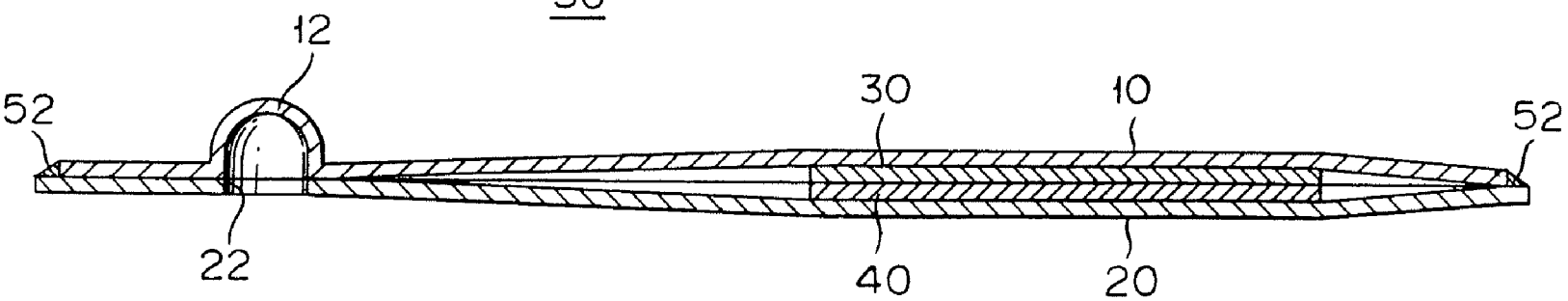
FIG. 5 is a cross-sectional view taken on line V-V of FIG. 3.
Figure 6:
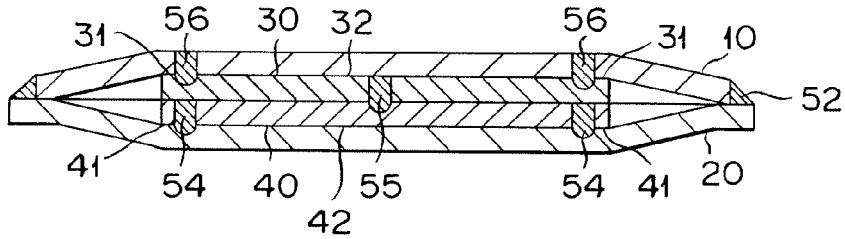
FIG. 6 is a cross-sectional view taken on line VI-VI of FIG. 3.

FIG. 3 is a plan view of assistance in explaining a preform according to the embodiment A1, FIG. 4 is a rear elevation of the preform shown in FIG. 3, FIG. 5 is a cross-sectional view taken on line V-V of FIG. 3, and FIG. 6 is a cross-sectional view taken on line VI-VI of FIG. 3.

The preform 50 has outer members and reinforcement members. The outer members are to form the outer surfaces 61, 62 of the hydroforming product 60. The reinforcement members are to form the reinforcement ribs 63, 64 of the hydroforming product 60.

The sheet materials that constitute the outer members include a top plate (first outer member) 10 and a bottom plate (second outer member) 20 and their overlapping edge has a joint 52 formed by fillet welding. The method of forming the joint 52 can be anything that securely provides good sealing and does not affect hydraulic forming capability, for example, laser welding, arc welding, or gluing.

The sheet materials that constitute the reinforcement members include an upper insertion plate (first reinforcement member) 30 and a lower insertion plate (second reinforcement member) 40 having substantially same shapes and are overlapped and disposed in the inside of the top plate 10 and the bottom plate 20. The material of the sheets that constitute the outer members 10, 20 and the reinforcement members 30, 40 are not specified but can be cold rolled steel sheet or hot rolled mild steel sheet.

The top plate 10 that forms the outer surface 61 of the hydroformed product 60 have a middle section 15 and end sections 11, 16 located on both sides of the middle section 15. A peripheral area 15A and a central area 15B of the middle section 15 form the sidewall 61A and the summit part 61B of the outer surface 61. A dome-shaped part 12 is formed on the end section 11.

The bottom plate 20 that is to form the outer surface 62 of the hydroformed product 60 is slightly larger than the top plate 10 in size and is similar to the top plate 10 in shape, and has a middle section 25 that faces the middle section 15 of the top plate 10 and end sections 21, 26 that face the end sections 11, 16 of the top plate 10. A peripheral area 25A and a central area 25B of the middle section 25 form the sidewall 62A and the summit part 62B of the outer surface 62. The end section 21 has an opening 22 that coincides with the position of the dome-shaped part 12.

The upper insertion plate 30 and the lower insertion plate 40 have substantially same shapes. Both end sections 41 of the lower insertion plate 40 are jointed to the bottom plate 20 via joints 54. Both end sections 31 of the upper insertion plate 30 are jointed to the top plate 10 via joints 56. A central area 42 of the lower insertion plate 40 is jointed to a central area 32 of the upper insertion plate 30 via a joint 55.

Both end sections 31, 41 of the upper insertion plate 30 and the lower insertion plate 40 are jointed to peripheral areas 15A, 25A of the middle sections 15, 25 of the top plate 10 and the bottom plate 20 that form the sidewalls 61A, 62A on the outer surfaces 61, 62 of the hydroformed product 60. As a result, the hydroformed product obtained from the preform 50 will have the reinforcement ribs 63, 64 that support the sidewalls 61A, 62A, thus improving the rigidity in the direction parallel or horizontal to the overlapping surface OS.

The spans between the joints 55 at the central areas 32, 42 and the joints 54, 56 at both end sections 31, 41 are selected to be larger than the linear distances between the corresponding joints of the hydroformed product 60 respectively, so that they provide slackness that enables the reinforcement ribs 63, 64 to bend. Therefore, no tensile force is applied to the upper insertion plate 30 and the lower insertion plate 40 during hydroforming. In other words, the upper insertion plate 30 and the lower insertion plate 40 have dimensions sufficient to restrain the elongations that occur during hydroforming due to the tensile forces, so that the chance of fracturing the upper insertion plate 30 and the lower insertion plate 40 can be minimized.

The joints 54, 55 and 56 are formed by pierce welding. The pierce welding preferably welds together the first sheet material located on the surface and the second sheet material located below the first sheet material to provide a good joint strength. Laser welding or electronic beam welding can be applied as the pierce welding. Also, the method of forming the joints 54, 55 and 56 can be anything that securely provides good jointing strength and does not affect hydroforming capability, for example, gluing.

Figure 7:
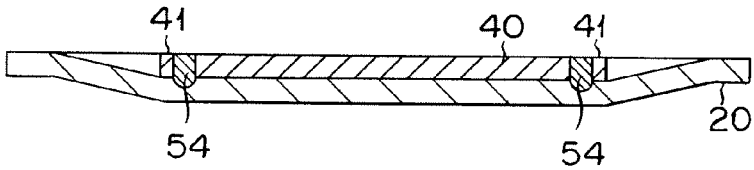
FIG. 7 is across-sectional view of assistance in explaining an example method of jointing a lower insertion plate and an upper insertion plate showing jointing process of the lower insertion plate to a bottom plate.

Next, an example of the method for jointing the reinforcement members, or the lower insertion plate and the upper insertion plate of the preform will be described. FIG. 7 is a cross-sectional view of assistance in explaining the jointing process of the lower insertion plate to the bottom plate, FIG. 8 is a cross-sectional view of assistance in explaining the jointing process of the upper insertion plate to the lower insertion plate following FIG. 7, and FIG. 9 is a cross-sectional view of assistance in explaining the jointing process of the top plate to the upper insertion plate following FIG. 8.

First, the lower insertion plate 40 is disposed on the bottom plate 20 disposed in a specified location. Next, joint the end sections 41 of the lower insertion plate 40 to the peripheral areas 25A of the middle section 25 of the bottom plate 20 by pierce welding to form the joint 54 (see FIG. 7).

Figure 8:
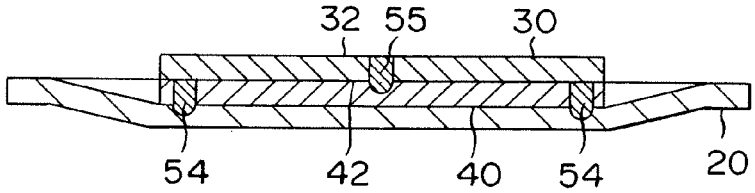
FIG. 8 is a cross-sectional view of assistance in explaining jointing process of the upper insertion plate to the lower insertion plate following FIG. 7.
Figure 9:
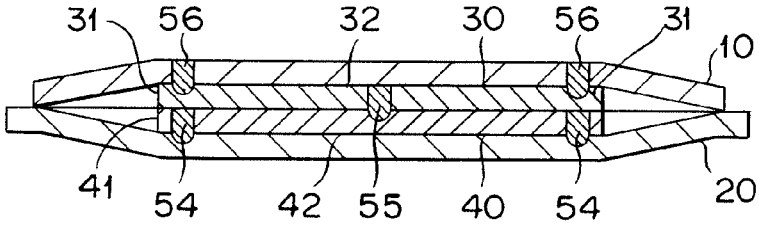
FIG. 9 is across-sectional view of assistance in explaining jointing process of a top plate to the upper insertion plate following FIG. 8.

After that, the upper insertion plate 30 is laid on the lower insertion plate 40, and the central area 32 of the upper insertion plate 30 is jointed to the central area 42 of the lower insertion plate 40 by pierce welding to form the joint 55 (see FIG. 8).

The top plate 10 is then laid on top of them to match the edges of the top plate 10 with the edges of the bottom plate 20. Next, joint the peripheral areas 15A of the middle section 15 of the top plate 10 to both ends 31 of the upper insertion plate 30 by pierce welding to form the joint 56 (see FIG. 9)

Finally, the overlapped edges of the top plate 10 and the bottom plate 20 are jointed to complete the preform 50 (FIG. 6).

Figure 10:
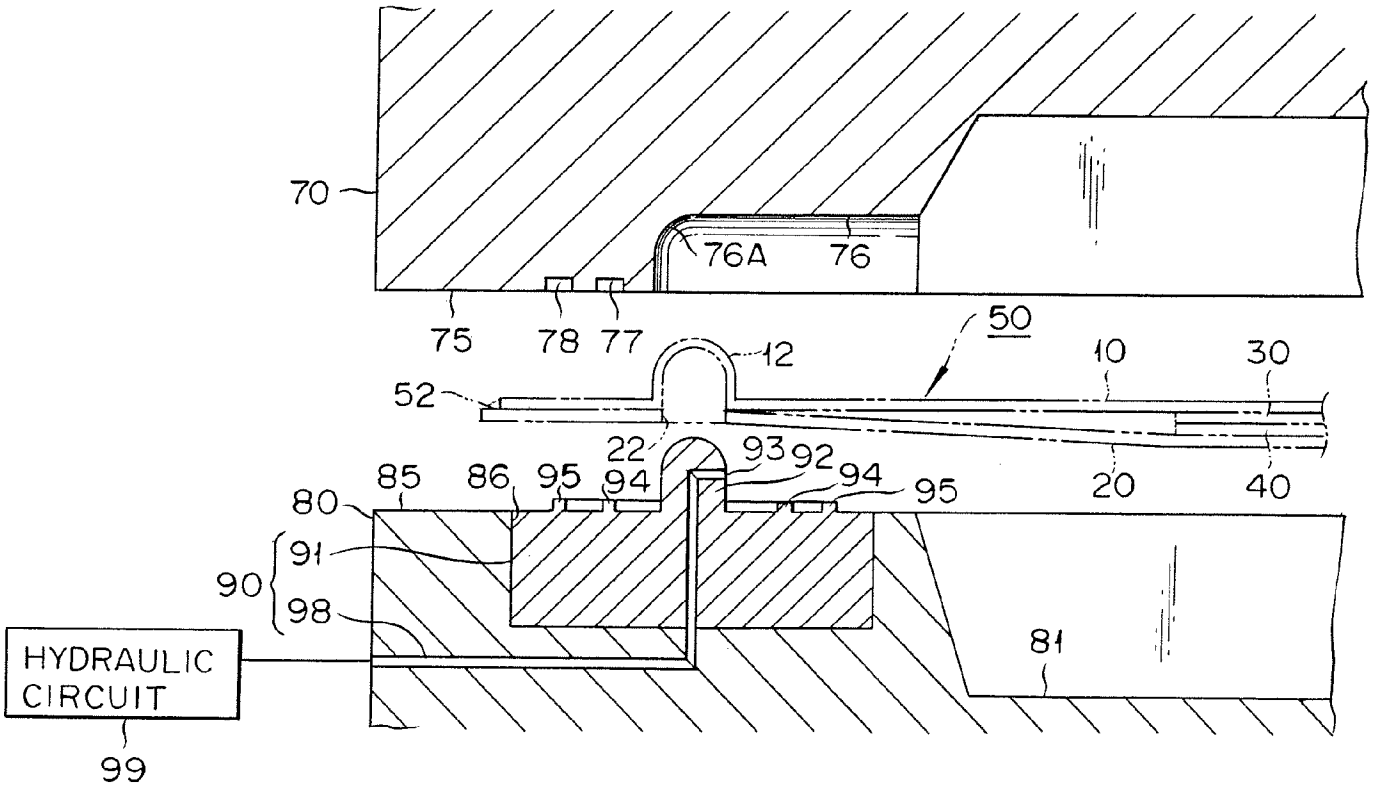
FIG. 10 is a cross-sectional view of assistance in explaining a hydroforming apparatus according to the embodiment A1.
Figure 11:
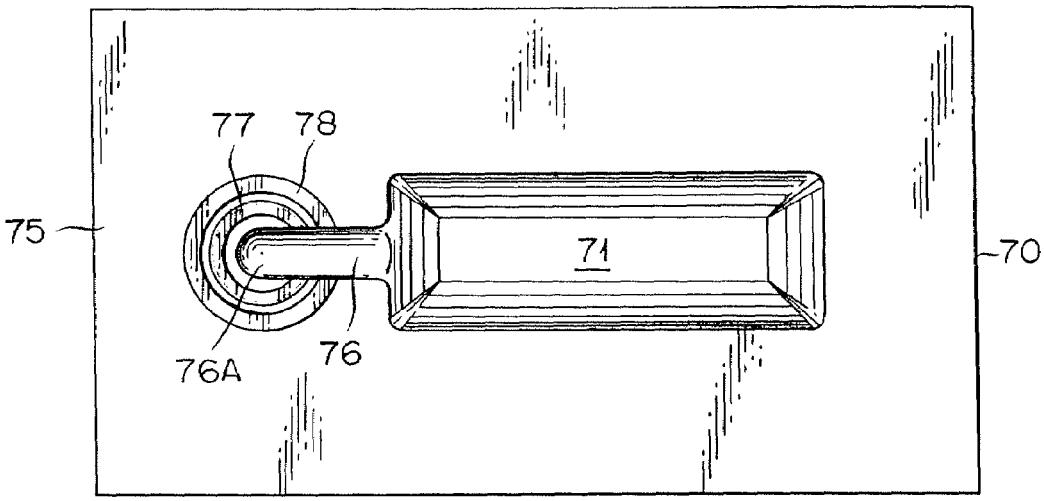
FIG. 11 is a plan view of assistance in explaining a top die for the hydroforming apparatus shown in FIG. 10.
Figure 12:
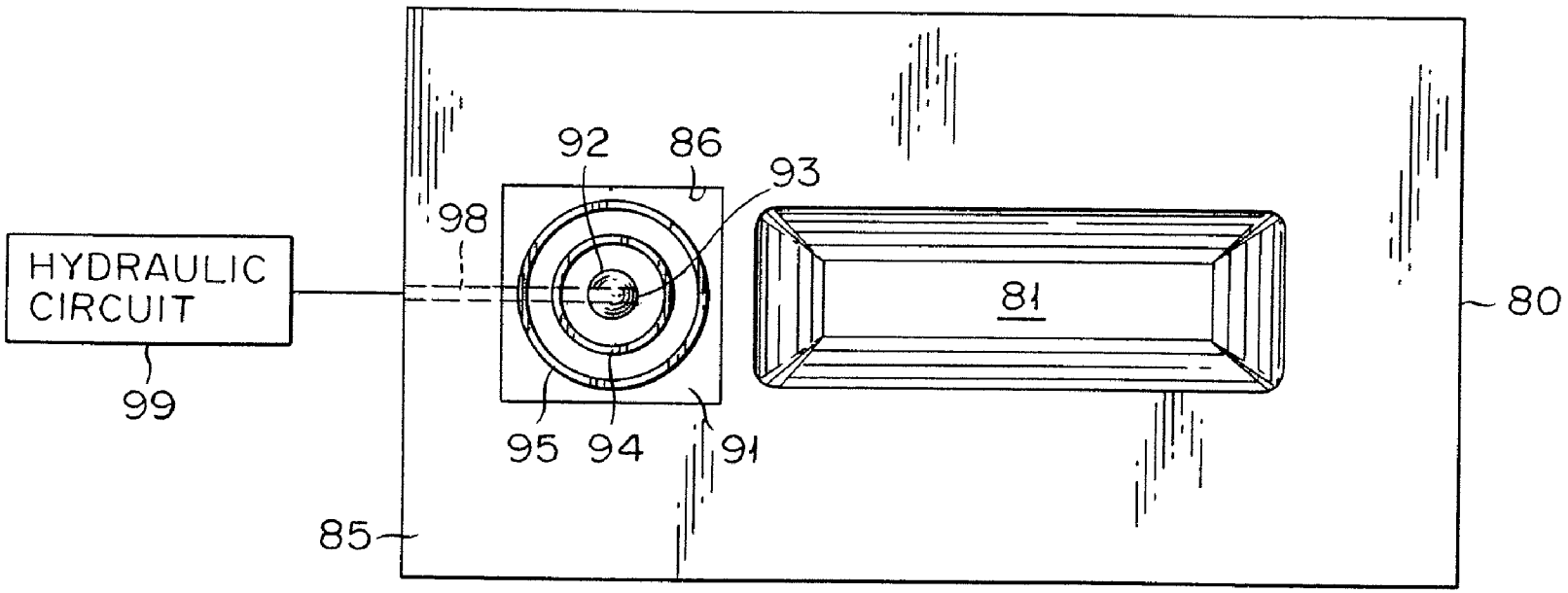
FIG. 12 is a plan view of assistance in explaining a bottom die for the hydroforming apparatus shown in FIG. 10.

FIG. 10 is a cross-sectional view of assistance in explaining a hydroforming apparatus according to the embodiment A1, FIG. 11 is a plan view of assistance in explaining a top die for the hydroforming apparatus shown in FIG. 10, and FIG. 12 is a plan view of assistance in explaining a bottom die for the hydroforming apparatus shown in FIG. 10.

The hydroforming apparatus has a top die 70 and a bottom die 80 as forming dies, and a hydraulic pressure supply mechanism 90. The top die 70 and the bottom die 80 can be moved proximate to or apart from each other, and clamped with the preform 50 being placed inside thereof.

The top die 70 and the bottom die 80 have cavity surfaces 71, 81 and pressing sections 75, 85. The cavity surfaces 71, 81 correspond to the outer surface shapes of the hydroformed product 60, having sidewalls and summit parts, or top or bottom surfaces corresponding to the sidewalls 61A, 62A and summit parts 61B, 62B on the outer surfaces 61, 62 of the hydroformed product 60. The pressing sections 75, 85 are parts to grip the outer periphery of the preform 50 during the die clamping.

The pressing section 75 of the top die 70 includes a recess 76 that extends from the cavity surface 71, having arc-shaped grooves 77, 78 placed to surround an end section 76A of the recess 76. The end section 76A has a cross-sectional shape that corresponds to the outer shape of the section obtained by vertically separating the dome-shaped part 12 of the preform 50 in two parts. The common center of the arc-shaped grooves 77, 78 coincides with the center of the end section 76A. The pressing section 85 of the bottom die 80 has a substantially rectangular recess 86 where a nozzle unit 91 is to be placed.

The hydroforming apparatus further has a large spacer and a small spacer (not shown) placed between the pressing section 75 of the top die 70 and the pressing section 85 of the bottom die 80, so that the die clamping of the top die 70 and the bottom die 80 can be implemented in two stages.

The thickness of the large spacer is designed to correspond with the thickness of a part of the preform 50 where the joints 54, 55 and 56 are located, or the total thickness of the top plate 10 and the bottom plate 20 as well as the upper insertion plate 30 and the lower insertion plate 40. The thickness of the smaller spacer is designed to correspond with the thickness of an edge of the preform 50 where the joint 52 is located, or the total thickness of the top plate 10 and the bottom plate 20.

The hydraulic pressure supply mechanism 90 is, for example, connected to a pressure generating device having a booster cylinder and a forming medium source, and has a flow path 98 and a nozzle unit 91 that are connected to a hydraulic circuit 99. The flow path 98 extends through the inside of the bottom die 80 and reaches the nozzle unit 91. The forming medium is typically water.

The nozzle unit 91 has a dome-shaped section 92 that corresponds to the inside of the dome-shaped section 12 of the preform 50, and annular protrusions 94, 95 disposed to surround the dome-shaped section 92. The annular protrusions 94, 95 are matched in positions with the arc-shaped grooves 77, 78 of the pressing section 75 of the top die 70. The annular protrusions 94, 95 are smaller than the arc-shaped grooves 77, 78 in size and are selected in consideration of the thickness of the top plates 10 and the bottom plate 20. The arc-shaped grooves 77, 78 as well as annular protrusions 94, 95 can be omitted if necessary.

The dome-shaped part 92 can pass freely through the opening 22 of the bottom plate 20 and has an injection port 93 that communicates with the flow path 98. When the nozzle unit 91 is inserted into the opening 22 and placed inside the dome-shaped part 12 of the preform 50, the forming medium supplied from the hydraulic circuit 99 is introduced inside the preform 50 via the nozzle part 91 and the opening 22. As a result, the forming medium applies a hydraulic pressure to the inside of the preform 50 and causes an inflating deformation of the preform 50.

Figure 13:
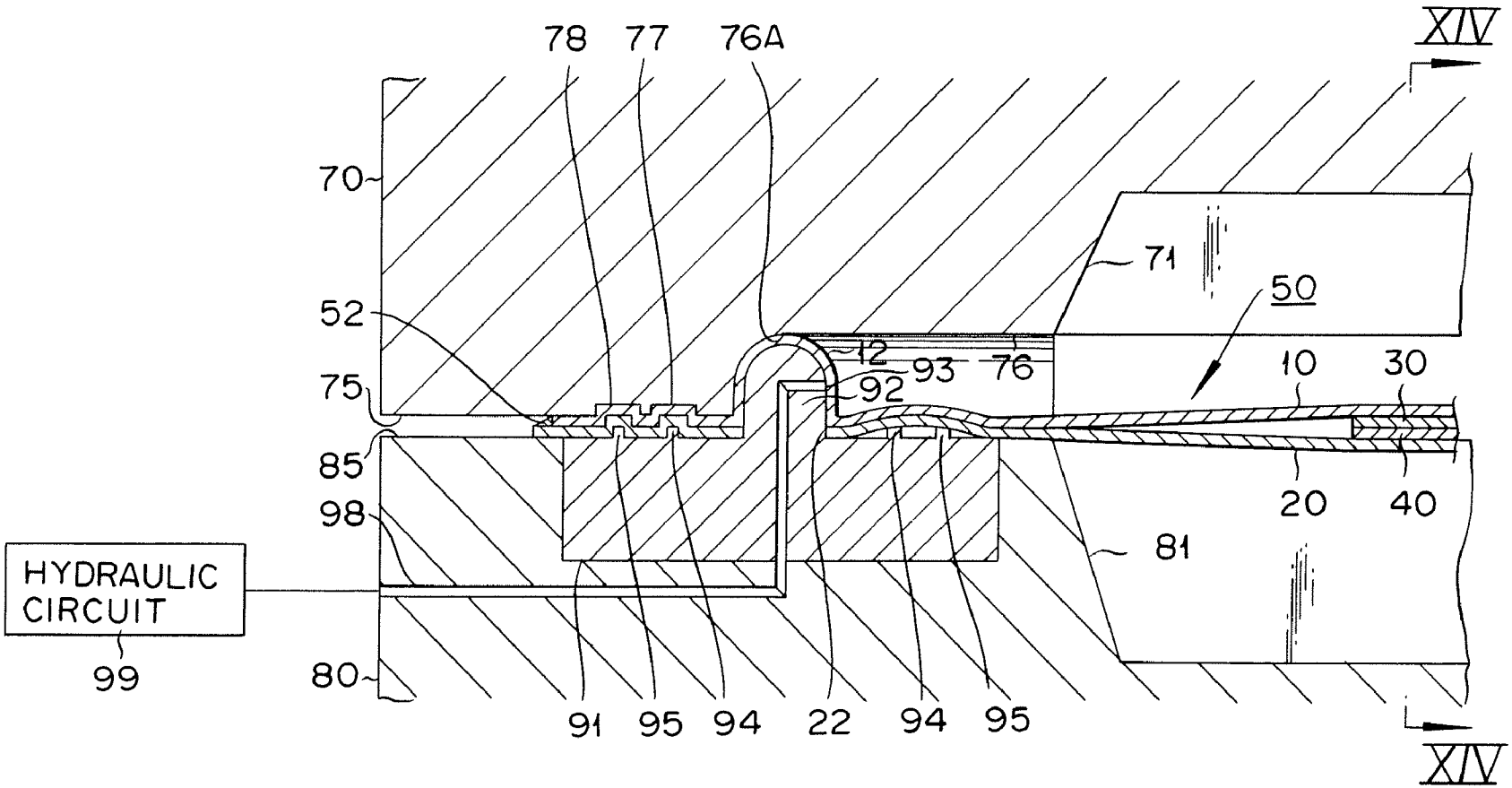
FIG. 13 is across-sectional view of assistance in explaining a hydroforming method according to the embodiment A1 showing a die clamping stage.
Figure 15:
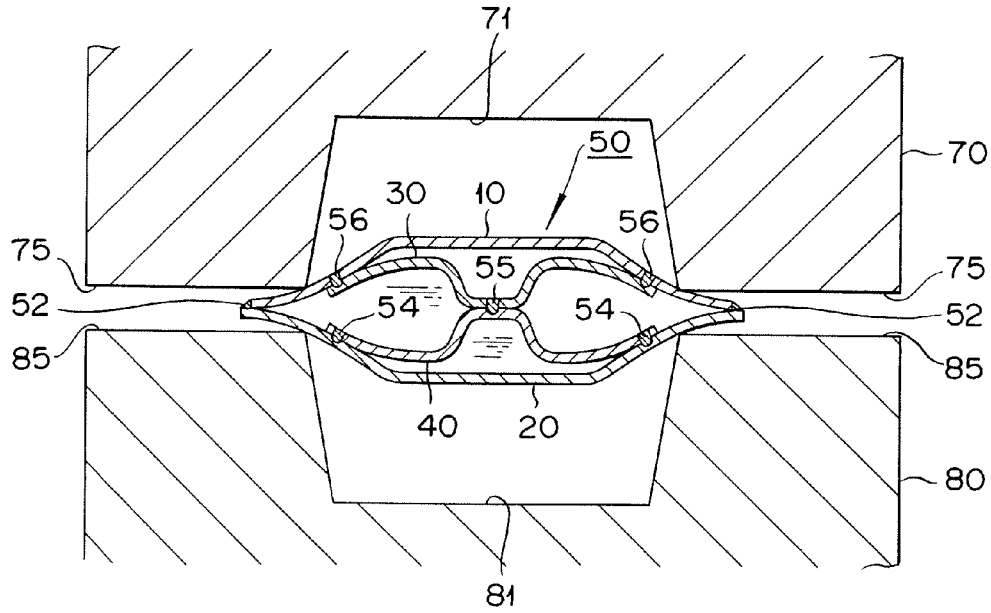
FIG. 15 is across-sectional view of assistance in explaining an initial stage of forming continued from FIG. 14.
Figure 16:
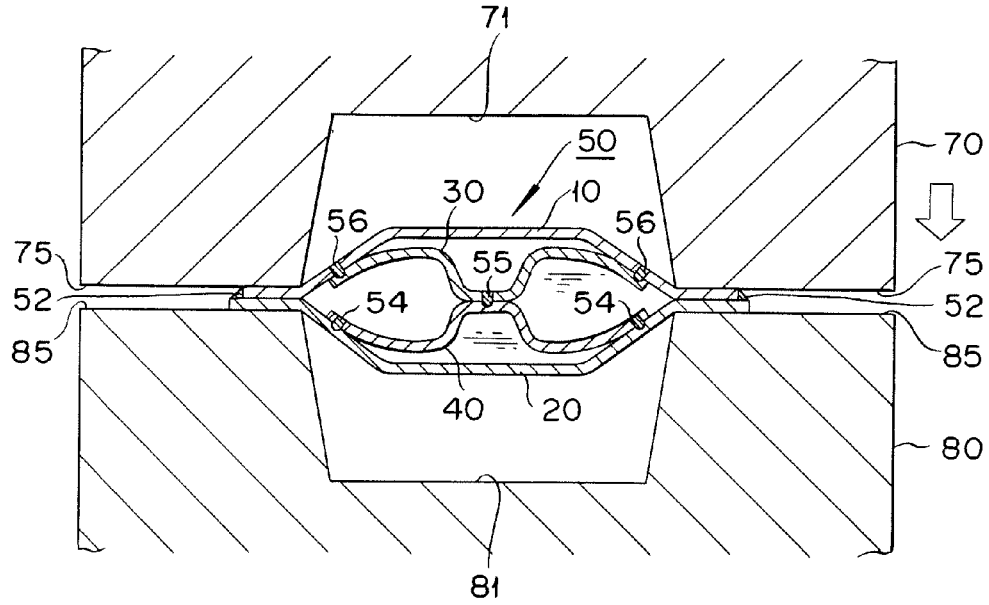
FIG. 16 is across-sectional view of assistance in explaining a die clamping stage continued from FIG. 15.
Figure 17:
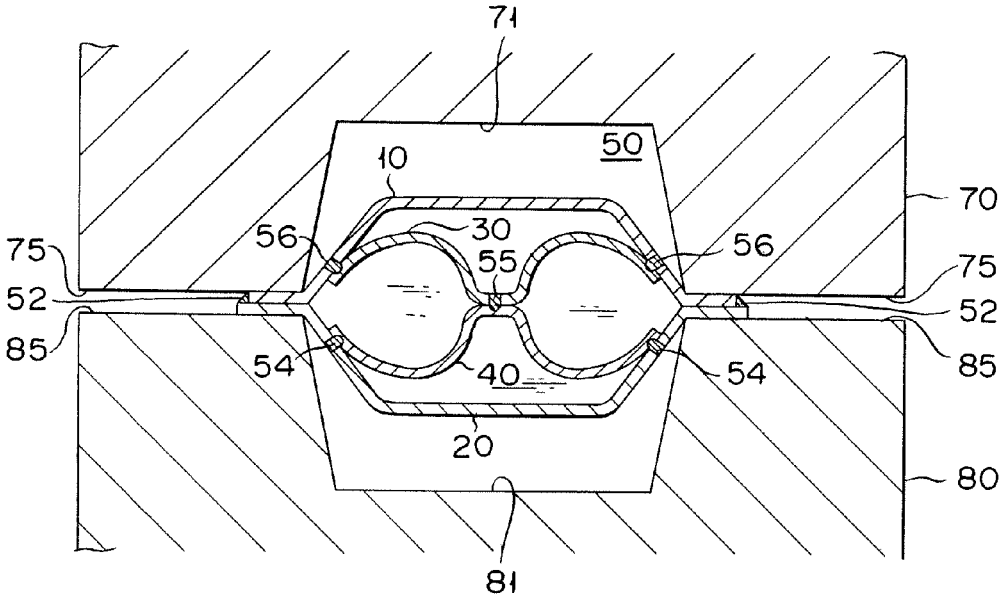
FIG. 17 is across-sectional view of assistance in explaining an intermediate stage of forming continued from FIG. 16.
Figure 18:
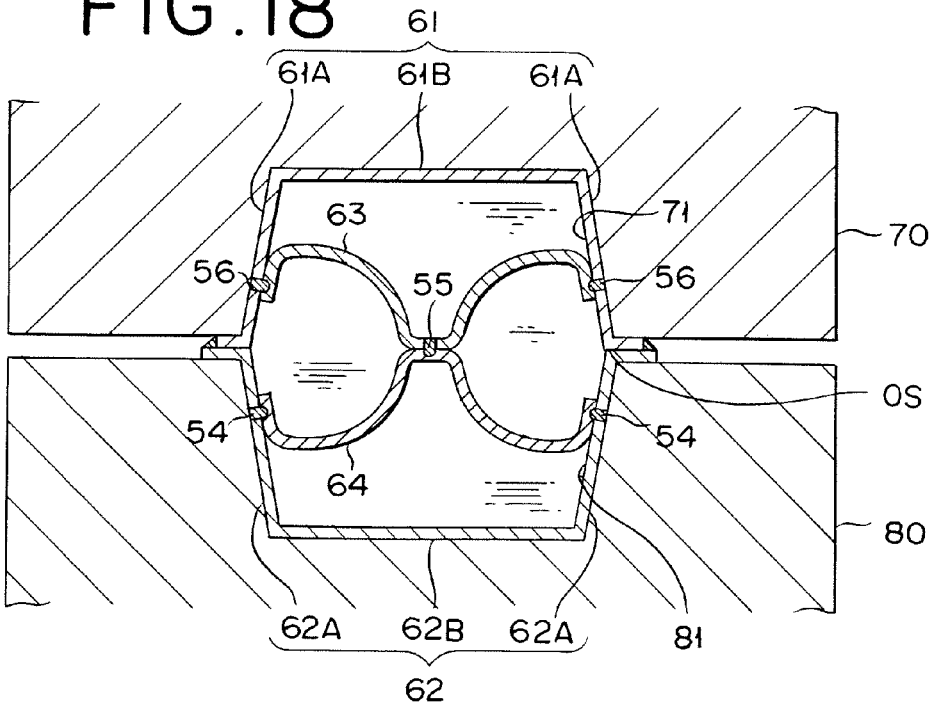
FIG. 18 is across-sectional view of assistance in explaining a latter stage of forming continued from FIG. 17.
Figure 19:
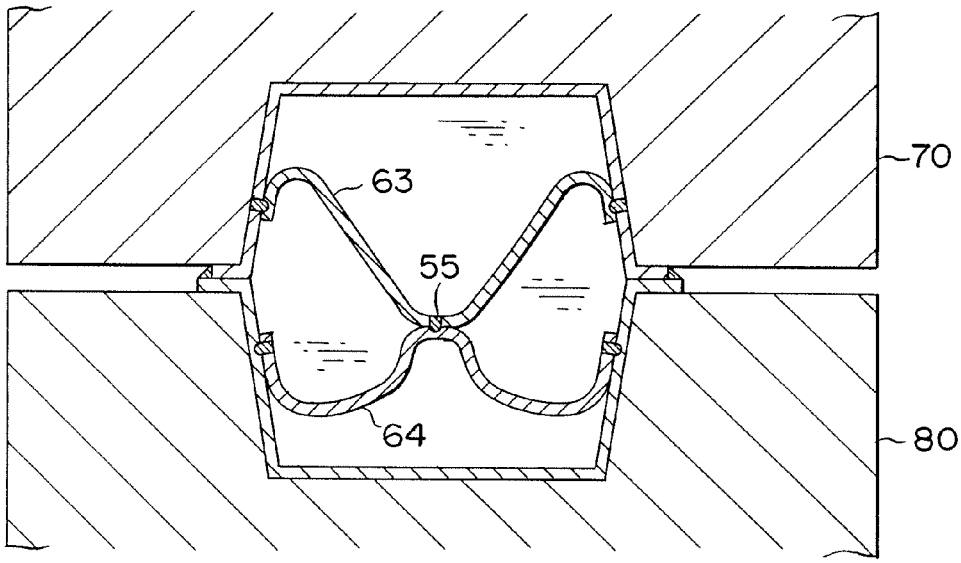
FIG. 19 is across-sectional view of assistance in explaining deformation of reinforcement ribs due to fluctuation in the operating condition.

Next, the hydroforming method according to the embodiment A1 will be described. FIG. 13 is a cross-sectional view of assistance in explaining a die clamping stage, FIG. 14 is a cross-sectional view taken on line XIV-XIV of FIG. 13, FIG. 15 is a cross-sectional view of assistance in explaining an initial stage of forming continued from FIG. 14, FIG. 16 is a cross-sectional view of assistance in explaining a die clamping stage continued from FIG. 15, FIG. 17 is a cross-sectional view of assistance in explaining an intermediate stage of forming stage continued from FIG. 16, FIG. 18 is a cross-sectional view of assistance in explaining a latter stage of forming continued from FIG. 17, and FIG. 19 is a cross-sectional view of assistance in explaining deformation of a reinforcement rib due to fluctuations of the operating condition.

First, the preform 50 is placed on the bottom die 80. At this time, the bottom plate 20 that is to constitute the outer surface 62 of the hydroformed product 60 is disposed in such a way as to face the cavity surface 81, and align the opening 22 of the bottom plate 20 with the dome-shaped part 92 of the nozzle unit 91 of the hydraulic pressure supply mechanism 90.

Figure 14:
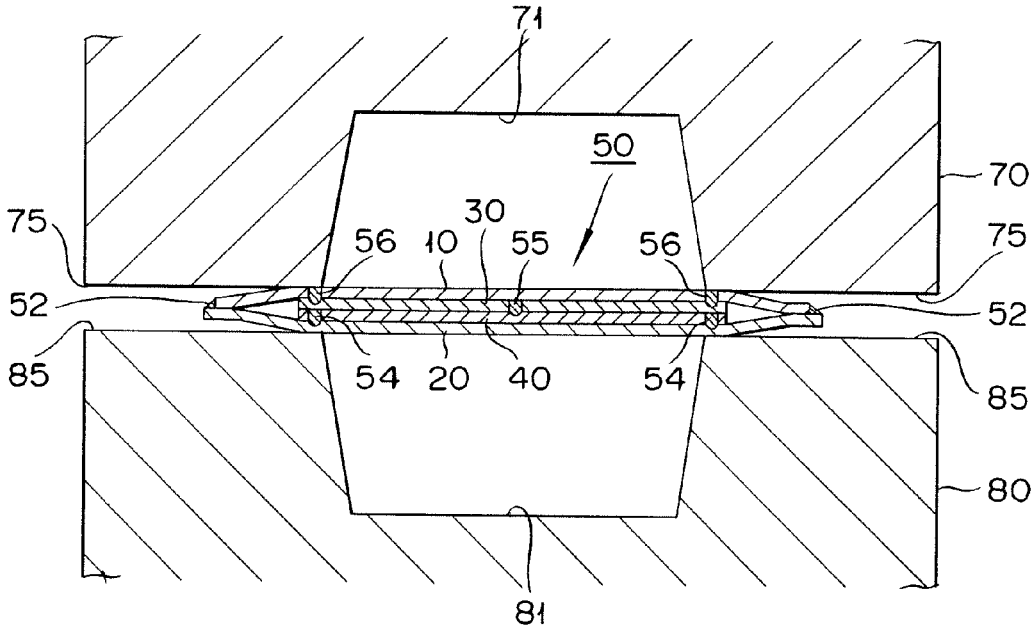
FIG. 14 is a cross-sectional view taken on line XIV-XIV of FIG. 13.

After that, the top die 70, which has been in a standby position, comes down to approach the bottom die 80 to complete the clamping of the top die 70 and the bottom die 80 (see FIG. 13 and FIG. 14). At this time, the top plate 10, which is to constitute the outer surface 61 of the hydroformed product 60, is disposed in such a way as to face the cavity surface 71, and the dome-shaped part 12 of the top plate 10 is fitted to the end section 76A of the recess 76 located in the pressing section 75 of the top die 70.

The vicinity of the dome-shaped part 12 is gripped by the arc-shaped grooves 77, 78 in the pressing section 75 of the top die 70 and the annular protrusions 94, 95 in the nozzle unit 91 placed in the recess 86 of the bottom die 80. This generates an annularly deformed area in the vicinity of the dome-shaped part 12, which provides an improved sealability against the forming medium being introduced.

The joints 52, 54 and 56 of the preform 50 are disposed to the pressing sections 75, 85, which are positioned a prescribed clearance apart from each other by large spacer (not shown).

The hydraulic pressure supply mechanism 90 introduces a forming medium supplied from the hydraulic circuit 99 into the inside of the preform 50 via the nozzle unit 91 and the opening 22 to apply a hydraulic pressure. As a result, the preform 50 causes its inflating deformation, bringing the edges of the preform 50 closer toward the cavity surfaces 71, 81 and causing material flows.

As the joints 54, 56 of the preform 50 move into the internal forming space surrounded by the cavity surfaces 71, 81 (see FIG. 15), the large spacer (not shown) placed between the pressing sections 75, 85 of the top die 70 and the bottom die 80 is replaced with smaller spacer. The top die 70 comes down further in correspondence with the thickness of the smaller spacer to clamp the dies, securing a specified clearance corresponding to the thickness of the edges of the preform 50 (see FIG. 16).

As the supply of the forming medium continues, the upper insertion plate 30 and the lower insertion plate 40 that are jointed to the top plate 10 and the bottom plate 20 further deform (FIG. 17). At this time, since the spans between the joint 55 at the central areas 32, 42 and the joints 54, 56 at both end sections 31, 41 are large enough to cause some slackness, no tensile force is applied thereto, so that they generate bending shapes.

Specifically, the reinforcement ribs that divide the hollow cross section of the hydroformed product are formed while minimizing the elongations of the upper insertion plate 30 and the lower insertion plate 40 due to tensile forces that act on them. Therefore, it is possible to prevent the upper insertion plate 30 and the lower insertion plate 40 from fracture, form the reinforcement ribs securely, and maintain stable and excellent strength quality of the hydroformed product.

Moreover, the root sections of the upper insertion plate 30 and the lower insertion plate 40 bend in an L-shape because of the existence of the joints of 54, 56 limiting the radii of curvatures in the bends small.

When the inner pressure of the preform 50 reaches its final pressure, the supply of the forming medium is stopped and held for a prescribed time to complete the inflation process of the preform 50 (see FIG. 18). Consequently, the top plate 10 and the bottom plate 20 form the outer surfaces 61, 62 of the hydroformed product 60, wherein the peripheral areas 15A, 25A and the central areas 15B, 25B of the middle sections 15, 25 of the top plate 10 and the bottom plate 20 form the sidewalls 61A, 62A that are inclined relative to the overlapping surface OS of the outer surface 61, 62 as well as the summit parts 61B, 62B surrounded by the sidewalls 61A, 62A.

On the other hand, since both end sections 31, 41 of the upper insertion plate 30 and the lower insertion plate 40 are jointed to the sidewalls 61A, 62A and the central areas 32, 42 are jointed together, the upper insertion plate 30 and the lower insertion plate 40 form the reinforcement ribs 63, 64 that divide the hollow cross sections of the outer surfaces 61, 62 of the hydroformed product 60 and that bend and support the sidewalls 61A, 62A of the outer surfaces 61, 62.

There is a possibility that the joint 55 that connects the central areas 32, 42 of the upper insertion plate 30 and the lower insertion plate 40 may offset from the center or initial position due to fluctuations of the processing condition (see FIG. 19). However, the spans between the joints of the upper insertion plate 30 and the lower insertion plate 40 are selected to be long enough to maintain sufficient slackness, so that the chance of exerting an excessive tensile force to the upper insertion plate 63 as one of the reinforcement members is minimized.

Next, the top die 70 is raised after removing the hydraulic pressure, the hydroformed product is taken out, and trimming including cutting is performed.

The reinforcement ribs 63, 64 of the hydroformed product 60 are formed while controlling the elongation in the tensile directions due to tensile forces that occur during hydroforming, and minimizing the chance of fracture of the upper insertion plate 30 and the lower insertion plate 40. Therefore, the reinforcement ribs 63, 64 are formed securely, and maintain stable and excellent strength quality of the hydroformed product.

As can be seen from the above, the embodiment A1 is capable of providing a preform that can restrain fractures of reinforcement members, a hydroforming method for obtaining a hydroformed product with stable and excellent strength quality, and a hydroformed product with stable and excellent strength quality.

Moreover, although it was shown to provide the hydraulic pressure by injecting the forming medium through the opening formed in one of the outer members, the embodiment A1 is capable of applying various other types of preforms and hydroforming apparatuses without being limited to the aforementioned particular style.

For example, the opening 22 of the bottom plate 20 and the nozzle unit 91 of the hydraulic pressure supply mechanism 90 can both be provided more than one. It is also possible to perform the die clamping only once by disposing the joints 54, 56 of the preform 50 in the internal forming space surrounded by the cavity surfaces 71, 81 from the start and eliminating the spacer replacement process.

Figure 20:
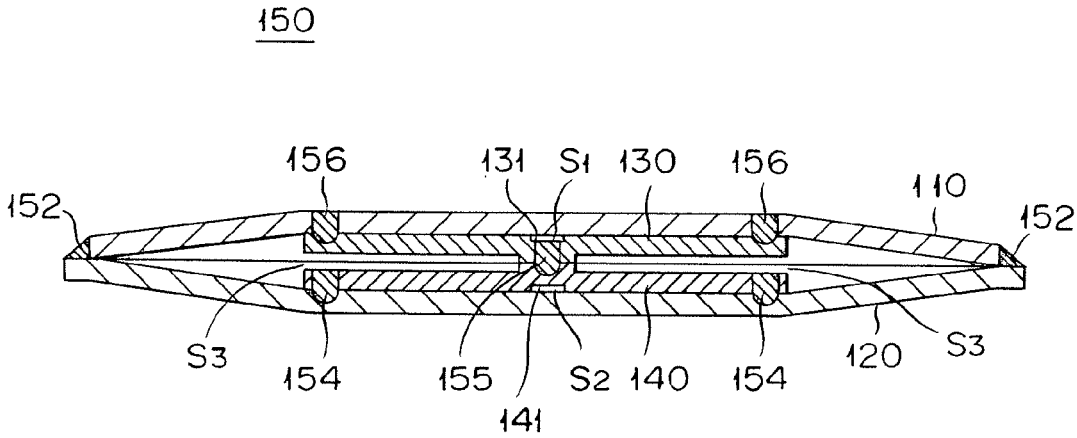
FIG. 20 is a cross-sectional view of a preform according to an embodiment A2.
Figure 21:
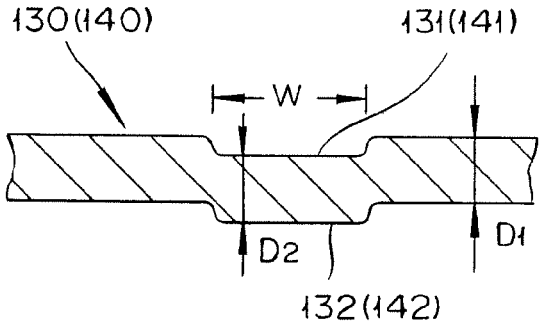
FIG. 21 is across-sectional view of assistance in explaining shapes of a lower insertion plate and an upper insertion plate that constitute reinforcement members of the preform shown in FIG. 20.

FIG. 20 is across-sectional view of assistance in explaining a preform according to the embodiment A2 and FIG. 21 is a cross-sectional view of assistance in explaining shapes of a lower insertion plate and an upper insertion plate that constitute reinforcement members of the preform shown in FIG. 20. Those members that have the similar functions as those in the embodiment A1 will be denoted with the similar reference signs hereinafter in order to avoid duplicating their descriptions.

The embodiment A2 is generally different from the embodiment A1 in that the chance of welding failure is minimized by modifying the shapes of the upper insertion plate and the lower insertion plate.

The upper insertion plate 130 and the lower insertion plate 140 in accordance with the embodiment A2 have recesses 131, 141 located substantially in the middle between the edges. The recesses 131, 141 have, for example, bending shapes which can be formed by presses.

The recesses 131, 141 are aligned with joint 155 to be pierce welded. The welding heat generated by pierce welding moves primarily through an area with reduced thickness and the welding preferably requires a penetration of about two to three times of the material thickness. Therefore, it is so designed that the sheet thickness $D_2$ of the bottoms of the recesses 131, 141 is smaller than the sheet thickness $D_1$ of the vicinities of the recesses 131, 141 as areas where the recesses 131, 141 are not formed, and the width W of the recesses 131, 141 is two to three times of the sheet thickness $D_1$.

The lower insertion plate 140 is disposed in such a way that the recess 141 faces the bottom plate 120, and its both ends are connected to the middle area of the bottom plate 120 via the joint 154. The recess 141 forms a space $S_2$ between the lower insertion plate 140 and the bottom plate 120.

The upper insertion plate 130 is disposed in such a way that a back area 132 of the recess 131 faces a back area 142 of the recess 141 of the lower insertion plate 140, and the back areas 132, 142 are connected via the joint 155. Since the back areas 132, 142 constitute protrusions or are protrusively shaped, it forms a thin flat space $S_3$ between the upper insertion plate 130 and the lower insertion plate 140.

The top plate 110 is disposed to face the recess 131 of the upper insertion plate 130, and the middle area of the top plate 110 is connected to both ends of the upper insertion plate 130 via the joint 156. The recess 131 of the upper insertion plate 130 forms a space $S_1$ between the upper insertion plate 130 and the topplate 110. The edges of the topplate 110 are connected to the edges of the bottom plate 120 via joints 152.

Figure 22:
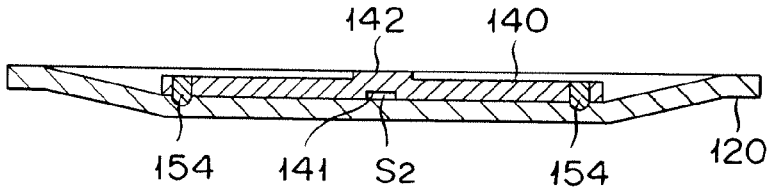
FIG. 22 is across-sectional view of assistance in explaining an example method of jointing reinforcement members in the preform showing jointing process of the lower insertion plate to a bottom plate.
Figure 23:
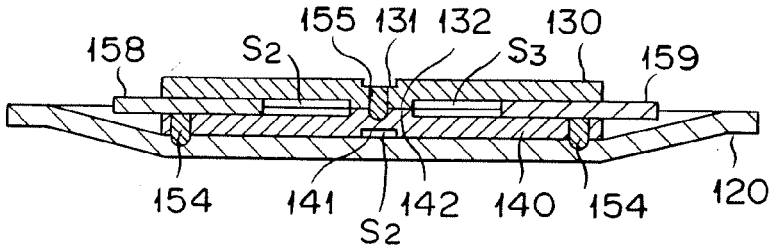
FIG. 23 is across-sectional view of assistance in explaining jointing process of the upper insertion plate to the lower insertion plate following FIG. 22.
Figure 24:
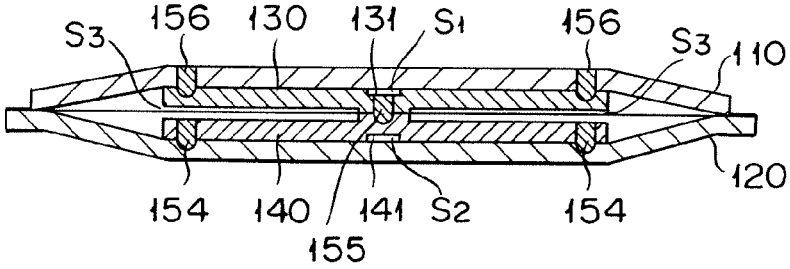
FIG. 24 is across-sectional view of assistance in explaining jointing process of a top plate to the upper insertion plate following FIG. 23.

Next, an example of the method for jointing the reinforcement members 130, 140 of the preform 150 will be described. FIG. 22 is a cross-sectional view of assistance in explaining the jointing process of the lower insertion plate to the bottom plate, FIG. 23 is a cross-sectional view of assistance in explaining the jointing process of the upper insertion plate to the lower insertion plate following FIG. 22, and FIG. 24 is a cross-sectional view of assistance in explaining the jointing process of the top plate to the upper insertion plate following FIG. 23.

First, place the bottom plate 120 at a specified position, and then place the lower insertion plate 140 so as to cause the recess 141 to face the bottom plate 120. Next, join the end sections of the lower insertion plate 140 to the bottom plate 120 by pierce welding to form the joint 154 (see FIG. 22).

Place the upper insertion plate 130 on the lower insertion plate 140 in such a way that the back area 132 of the recess 131 of the upper insertion plate 130 abuts against the back area 142 of the recess 141 of the lower insertion plate 140. Then joint the recess 131 of the upper insertion plate 130 to the back area 142 of the recess 141 of the lower insertion plate 140 by pierce welding to form the joint 155 (see FIG. 23).

In fact, the joint 155 is formed by welding the upper insertion plate 130 or the first sheet material located on the surface to the lower insertion plate 140 or the second sheet material located below the first sheet material while stacking more than three pieces of sheet materials that constitute the outer member and the reinforcement members, i.e., the bottom plate 120, and the upper insertion plate 130 and the lower insertion plate 140.

The recess 141 of the lower insertion plate 140 forms the space $S_2$. The space $S_2$, which is aligned with the joint area, is located between the second sheet material or the lower insertion plate 140 and the third sheet material or the bottom plate 120 located below the second sheet material. The space $S_2$ therefore prevents the transmission of welding heat and inadvertent welding failure of the second sheet material or the lower insertion plate 140 to the third sheet material or the bottom plate 120 and minimizes the possibility of fracture of the joint due to welding failures and improving the welding yield.

The upper insertion plate 130 is relatively unstable as it is supported only by the back area 142 of the recess 141 of the lower insertion plate 140 via the back area 132 of the recess 131. Such an unstable condition can be averted by placing wedging plates 158, 159 in the space $S_3$ formed between the upper insertion plate 130 and the lower insertion plate 140. The space $S_3$ has a function of absorbing any warping that may have developed due to jointing of the lower insertion plate 140 and the bottom plate 120, and thus minimizes the possibility of fracture of the joints due to welding failure to improve the welding yield.

The wedging plates 158, 159 are removed when the forming of the joint 155 is completed, and the top plate 110 is placed allowing the edges of the top plate 110 to meet with the edges of the bottom plate 120. Next, joint the top plate 110 to both ends of the upper insertion plate 130 by pierce welding to form the joint 156 (see FIG. 24).

At this time, the space $S_3$ remains between the upper insertion plate 130 and the lower insertion plate 140. Namely, the joint 156 is formed by welding the first sheet material or the top plate 110 located on the surface to the second sheet material or the upper insertion plate 130 located below the first sheet material while stacking more than three pieces of sheet materials that constitute the outer members and the reinforcement members, i.e., the top plate 110, the bottom plate 120, the upper insertion plate 130 and lower insertion plate 140. In addition, the space $S_3$, which is aligned with the joint area, is located between the second sheet material or the upper insertion plate 130 and the third sheet material or the lower insertion plate 140 located below the second sheet material.

The space $S_3$ therefore prevents the transmission of welding heat and inadvertent welding failure of the second sheet material or the upper insertion plate 130 to the third sheet material or the lower insertion plate 140, and thus minimizes the possibility of fracture of the joint due to welding failures to improve the welding yield.

When the joint 156 is completed, the overlapping edges of the top plate 110 and the bottom plate 120 are jointed to complete the preform 150 (see FIG. 20).

As stated above, the possibility of welding failure of the preform 150 according to the embodiment A2 is prevented. This improves the quality of welding joints and minimizes the possibility of fractures of the welding joints. Also, it reduces the manufacturing cost of the preform due to the improvement of the welding yield. The use of the wedging plates 158, 159 placed in the space $S_3$ can be omitted depending on the situation.

Figure 25:
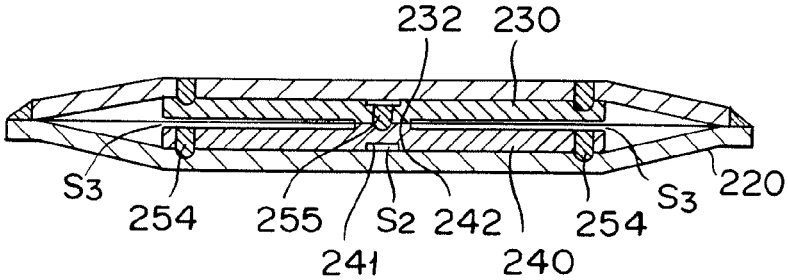
FIG. 25 is a cross-sectional view of assistance in explaining a preform according to an embodiment A3.

FIG. 25 is a cross-sectional view of a preform according to the embodiment A3.

A preform 250 according to the embodiment A3 is substantially different from the preform 150 according to the embodiment A2 in that the upper insertion plate and the lower insertion plate are different in shape wherein an upper insertion plate 230 is substantially flat, and a lower insertion plate 240 has a recess 241 located substantially in the middle of both ends.

The lower insertion plate 240 is so disposed as to make the recess 241 to face against the bottom plate 220, both ends of the lower insertion plate 240 are connected to the bottom plate 220 via a joint 254, and the recess 241 forms a space $S_2$ between it and the bottom plate 220.

A back area 242 of the recess 241 of the lower insertion plate 240 is connected to the upper insertion plate 230 via a joint 255. The reference numeral 232 denotes the back area of the upper insertion plate 230 that abuts against the back area 242 of the recess 241 of the lower insertion plate 240, and the abutment face of the back areas 232, 242 define the joint area.

The back area 242 has a protruded shape so that a space $S_3$ is formed between the upper insertion plate 230 and the lower insertion plate 240.

As described above, the recess 241 is formed only on the lower insertion plate 240, so that the shape of the vicinity of the joint 255 is not vertically symmetric. On the other hand, the upper insertion plate 230 and the lower insertion plate 240 create a bending condition due to a compression load in the initial stage of hydraulic forming (see FIG. 15).

At this time, the side of the joint 255 where the recess 241 is located is more easily bent, so that it is possible to maintain the direction of the initial bending always the same and the location of the joint 255 always substantially in the middle securely, different from the case of the preform 250 according to the embodiment A2. In fact, it is possible to avoid the reinforcement rib from resulting in a distorted shape in the hydroforming due to the difference in the inflation amount.

As can be seen from the above, it is possible to improve the shape quality or accuracy of the reinforcement ribs that divide the hollow cross section of the hydroformed product in the embodiment A3 further than in the embodiment A2.

Figure 26:
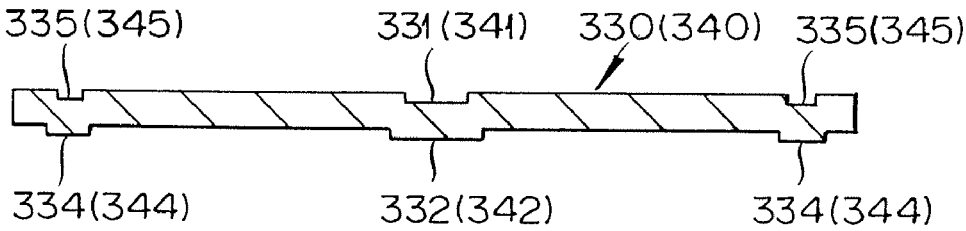
FIG. 26 is across-sectional view of assistance in explaining a lower insertion plate and an upper insertion plate that constitute reinforcement members according to an embodiment A4.

FIG. 26 is across-sectional view of assistance in explaining a lower insertion plate and an upper insertion plate that constitute reinforcement members according to the embodiment A4. The preform according to the embodiment A4 is generally different from the preform 150 according to the embodiment A2 in that protrusions are formed on both the upper insertion plate and the lower insertion plate.

Protrusions 334, 344 in the embodiment A4 are disposed across back areas 332, 342 of recesses 331, 341 respectively in the vicinities of the end sections. Each of the protrusions 334, 344 is formed in a bent shape having a substantially flat summit part and can be formed by a press forming process. Reference numerals 335, 345 denote the back areas of the protrusions 334, 344 in the shape of a recess.

The protrusions 334, 344 are located to abut against each other and the height of the protrusions 334, 344 is chosen to match the height of the back areas 332, 342 of the recess 331, 341.

As a result, when the upper insertion plate 330 is laid on the lower insertion plate 340 aligning the back area 332 of the upper insertion plate 330 with the back area 342 of the lower insertion plate 340, the protrusion 334 and the back area 332 of the recess 331 of the upper insertion plate 330 abut against the protrusion 344 and the back area 342 of the recess 341 of the lower insertion plate 340, respectively. The space $S_3$ formed between the upper insertion plate 330 and the lower insertion plate 340 matches the total height of the back areas 332, 342.

Figure 27:
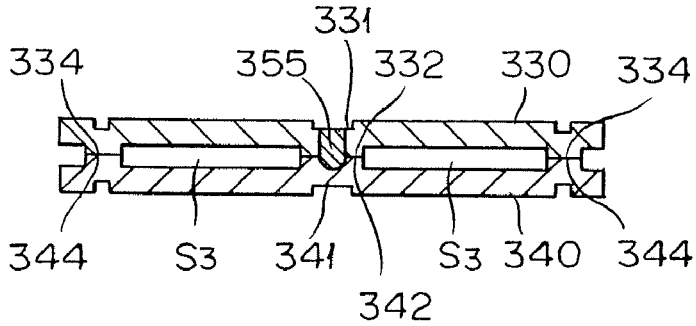
FIG. 27 is across-sectional view of assistance in explaining an example method of jointing reinforcement members shown in FIG. 26 showing jointing process of the upper insertion plate to the lower insertion plate.
Figure 28:
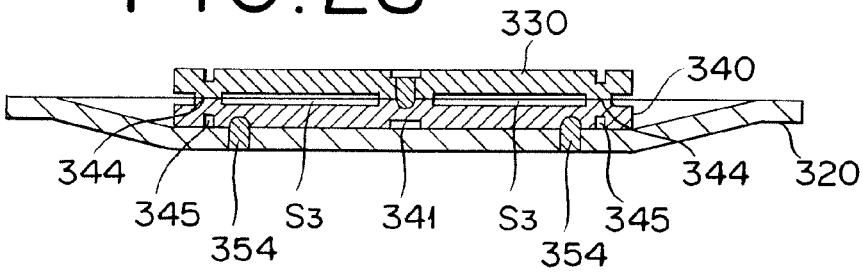
FIG. 28 is a cross-sectional view of assistance in explaining jointing process of the lower insertion plate to a bottom plate following FIG. 27.
Figure 29:
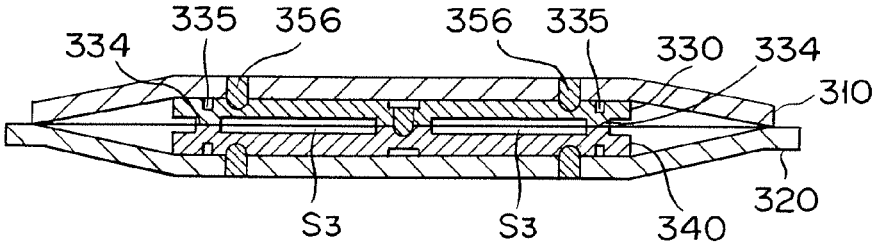
FIG. 29 is a cross-sectional view of assistance in explaining jointing process of a top plate to the upper insertion plate following FIG. 28.
Figure 30:
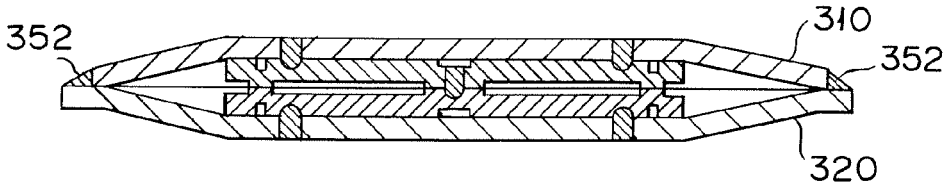
FIG. 30 is a cross-sectional view of assistance in explaining jointing process of the top plate to the bottom plate following FIG. 29.

Next, an example of the method for jointing the reinforcement members shown in FIG. 26 will be described. FIG. 27 is a cross-sectional view of assistance in explaining the jointing process of the lower insertion plate to the upper insertion plate, FIG. 28 is a cross-sectional view of assistance in explaining the jointing process of the lower insertion plate to a bottom plate following FIG. 27, FIG. 29 is a cross-sectional view of assistance in explaining the jointing process of a top plate to the upper insertion plate following FIG. 28, and FIG. 30 is a cross-sectional view of assistance in explaining the jointing process of the top plate to the bottom plate following FIG. 29.

First, overlap the upper insertion plate 330 on the lower insertion plate 340 disposed at a specified position in such a way as to cause the protrusion 334 and the back area 332 of the recess 331 of the upper insertion plate 330 to abut against the protrusion 344 and the back area 342 of the recess 341 of the lower insertion plate 340. Then joint the recess 331 of the upper insertion plate 330 to the back area 342 of the recess 341 of the lower insertion plate 340 by pierce welding to form the joint 355 (see FIG. 27).

Different from the case of the embodiment A2 wherein it is supported in one place, the upper insertion plate 330 is stable as it is supported by three locations in total, i.e., the protrusions 344 and the back area 342 of the recess 341 of the lower insertion plate 340 via the protrusions 334 and the back area 332 of the recess 331. Therefore, it is unnecessary to use the wedging plates 158, 159 which are otherwise required to cancel the instability, so that it can reduce the production man-hour related to the wedging plates 158, 159 and provide a better productivity.

After that, the jointed member consisting of the upper insertion plate 330 and the lower insertion plate 340 is disposed in such a way that the recess 341 of the lower insertion plate 340 faces the bottom plate 320. Next, joint the bottom plate 320 to both ends of the lower insertion plate 340 by pierce welding to form the joint 354 (see FIG. 28). The welding locations are in the vicinities of the protrusions 344 and the back areas 345.

The joint 354 is formed by welding the first sheet material or the bottom plate 320 located on the surface to the second sheet material or the lower insertion plate 340 located below the first sheet material while stacking more than three pieces of sheet materials that constitute the outer member and the reinforcement members, i.e., the bottom plate 320, the upper insertion plate 330 and lower insertion plate 340.

On the other hand, the space $S_3$ is formed between the upper insertion plate 330 and the lower insertion plate 340 by applying the protrusions 334, 344 to the back areas 332, 342 of the recesses 331, 341. Therefore, the space $S_3$ prevents the transmission of welding heat and inadvertent welding of the second sheet material or the lower insertion plate 340 to the third sheet material or the upper insertion plate 330.

When the formation of the joint 354 is completed, the top plate 310 is laid matching the edges of the top plate 310 with the edges of the bottom plate 320. Next, joint the top plate 310 to both ends of the upper insertion plate 330 by pierce welding to form the joint 356 (see FIG. 29). The welding locations are in the vicinities of the protrusions 334 and back areas 335, and the space $S_3$ exists between the upper insertion plate 330 and the lower insertion plate 340.

In fact, the joint 356 is formed by welding the first sheet material or the top plate 310 located on the surface to the second sheet material or the upper insertion plate 330 located below the first sheet material while stacking more than three pieces of sheet materials that constitute the outer members and the reinforcement members, i.e., the top plate 310, the bottom plate 320, the upper insertion plate 330 and lower insertion plate 340. In addition, the space $S_3$, which is aligned with the joint area, is located between the upper insertion plate 330 as the second sheet material and the lower insertion plate 340 as the third sheet material located below the second sheet material.

Therefore, the space $S_3$ prevents the transmission of welding heat and inadvertent welding of the second sheet material or the upper insertion plate 330 to the third sheet material or the lower insertion plate 340.

When the joint 356 is completed, the overlapping edges of the top plate 310 and the bottom plate 320 are jointed to complete the preform 350 (see FIG. 30). The reference numeral 352 denotes the joint formed on the edges.

As can be seen from the above, the embodiment A4 makes it possible to improve the productivity in comparison with the embodiment A2 and the embodiment A3.

The heights of the protrusions 334, 344 do not have to be identical. For example, the heights of the protrusions 334, 344 can be arbitrarily chosen so long as the total height of the protrusions 334, 344 matches with the total height of the back areas 332, 342 of the recesses 331, 341. It is also possible to form protrusions on one of the upper insertion plate 330 and the lower insertion plate 340. In this case, the height of the protrusion should coincide with the total height of the back areas 332, 342 of the recesses 331, 341.

Figure 31:
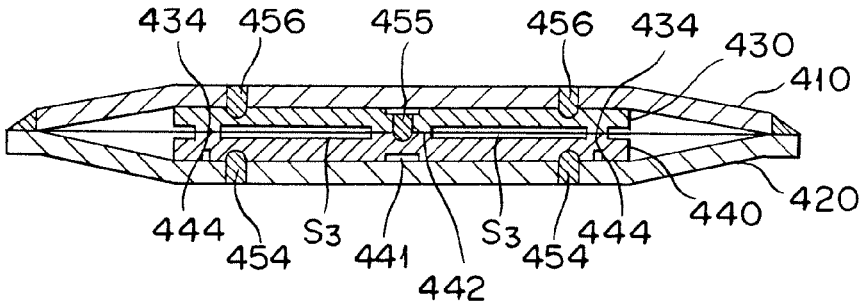
FIG. 31 is a cross-sectional view of assistance in explaining reinforcement members according to an embodiment A5.

FIG. 31 is across-sectional view of assistance in explaining reinforcement members according to the embodiment A5.

A preform 450 concerning the embodiment A5 is substantially different from the preform 350 concerning the embodiment A4 in regard to the shape of the upper insertion plate in that an upper insertion plate 430 of the embodiment A5 is substantially flat having neither a recess nor a protrusion and a lower insertion plate 440 has a recess 441 and protrusions 444.

The upper insertion plate 430 is stable as it is supported by the back area 442 of the recess 441 and the protrusions 444 of the lower insertion plate 440, i.e., total of three locations. As a consequence, this embodiment is capable of reducing the production man-hour and providing a better productivity as in the embodiment A4.

Moreover, the space $S_3$ is formed between the upper insertion plate 430 and the lower insertion plate 440 by abutting of the upper insertion plate 430 against the back areas 442 of the recesses 441 and the protrusions 444. Therefore, if the jointed assembly of the upper insertion plate 430 and the lower insertion plate 440 with the joint 455 is disposed on the bottom plate 420 for forming the joints 454 in the vicinities of the protrusions 444 and the back areas of the protrusions 444, the space $S_3$ prevents the transmission of welding heat as in the case of the embodiment A4, and thus prevents inadvertent welding failure between the lower insertion plate 440 and the upper insertion plate 430.

Furthermore, if the top plate 410 is disposed on the upper insertion plate 430 for forming the joints 456 in the vicinities of the parts 434 that abut against the protrusions 444 after the joint 454 is formed, the space $S_3$ prevents the transmission of welding heat as in the case of the embodiment A4, and thus prevents inadvertent welding failure between the upper insertion plate 430 and the lower insertion plate 440.

On the other hand, the recess 441 is formed only on the lower insertion plate 440 in the preform 450, so that the shape of the vicinities of the joint 455 is not vertically symmetric as in the case of the embodiment A3. Therefore, the side of the joint 455 on which the recess 441 is located is more likely to bend when hydroforming is applied, so that the initial bending direction becomes always the same and so it becomes possible to keep the location of the joint 455 substantially in the middle more securely. In fact, it is possible to avoid the reinforcement rib from resulting in a distorted shape in the hydroforming due to the difference in the inflation amount.

As can be seen from the above, it is possible to improve the shape quality or accuracy of the reinforcement ribs that divide the hollow cross section of the hydroformed product in the embodiment A5 further than in the embodiment A4.

The protrusions do not have to be formed on the lower insertion plate 440, but also can be provided on the upper insertion plate 430. It is also possible to form protrusions on both the upper insertion plate 430 and the lower insertion plate 440. In this case, it is necessary to make the total height of the protrusion substantially equal to the height of the back area 442 of the recess 441 of the lower insertion plate 440.

Figure 32:
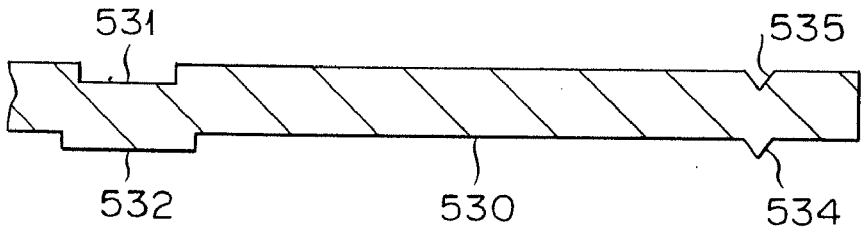
FIG. 32 is a cross-sectional view of assistance in explaining an upper insertion plate that constitutes one of reinforcement members according to an embodiment A6.
Figure 33:
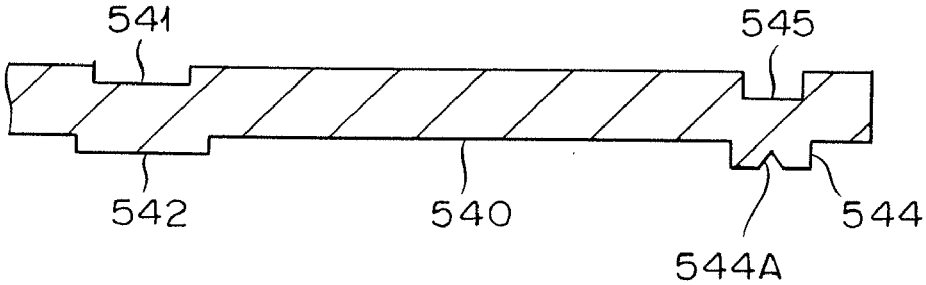
FIG. 33 is a cross-sectional view of assistance in explaining a lower insertion plate that constitutes the other of the reinforcement members according to the embodiment A6.
Figure 34:
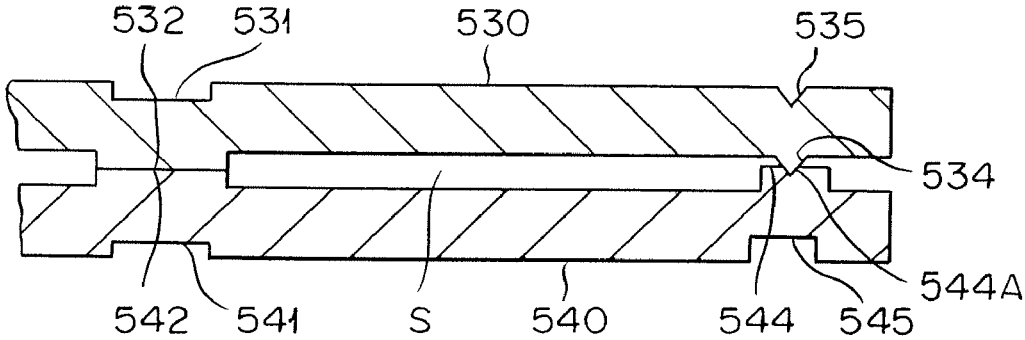
FIG. 34 is a cross-sectional view of assistance in explaining a fitting structure between the upper insertion plate of FIG. 32 and the lower insertion plate of FIG. 33.

FIG. 32 is a cross-sectional view of assistance in explaining an upper insertion plate that constitutes one of reinforcement members according to the embodiment A6, FIG. 33 is a cross-sectional view of assistance in explaining a lower insertion plate that constitutes the other of the reinforcement members according to the embodiment A6, and FIG. 34 is a cross-sectional view of assistance in explaining a fitting structure between the upper insertion plate of FIG. 32 and the lower insertion plate of FIG. 33.

A preform concerning the embodiment A6 is substantially different from the preform 350 (see FIG. 20) concerning the embodiment A4 in regard to the shape of the upper insertion plate and the lower insertion plate in that an upper insertion plate 530 concerning the embodiment A6 has protrusions 534 disposed across a back area 532 of a recess 531. The protrusions 534 are formed substantially in a V-shape and located in the vicinity of each end of the upper insertion plate 530.

On the other hand, a lower insertion plate 540 has receiving parts 544 disposed across a back area 542 of a recess 541. The receiving parts 544 are protrusions formed by a press forming process, and are disposed to fit properly with the protrusions 534 of the upper insertion plate 530. Each receiving part 544 has a summit part on which a concave 544A is provided to fit properly with the protrusion 534 of the upper insertion plate 530. A reference numeral 545 denotes the depressed back area of the receiving parts 544.

A space $S_3$ formed between the lower insertion plate 540 and the upper insertion plate 530 when the receiving parts 544 of the lower insertion plate 540 fits with the protrusions 534 of the upper insertion plate 530 matches with the sum of the height of the back area 532 of the recess 531 of the upper insertion plate 530 and the height of the back area 542 of the recess 541 of the lower insertion plate 540.

When the upper insertion plate 530 is laid over the lower insertion plate 540, the protrusions 534 of the upper insertion plate 530 fits with the receiving parts 544 of the lower insertion plate 540 in a specified position. Namely, the protrusions 534 and the receiving parts 544 can function as the positioning mechanism of the upper insertion plate 530 for the lower insertion plate 540.

Therefore, when jointing the recess 531 of the upper insertion plate 530 to the back area 542 of the recess 541 of the lower insertion plate 540 by pierce welding to form joints (FIG. 27), the overlapping of the upper insertion plate 530 to the lower insertion plate 540 can be easily and quickly done.

As can be seen from the above, the embodiment A6 makes it possible to improve the productivity in comparison with the embodiment A4.

It is also possible to dispose the receiving parts 544 on the upper insertion plate 530 and dispose the protrusions 534 to the lower insertion plate 540.

The positioning mechanism by means of the protrusions 534 and the receiving parts 544 can be applied to the embodiment A3 as well. For example, the overlapping of the upper insertion plate 230 on the lower insertion plate 240 can be easily and speedily done by disposing the protrusions 534 on the upper insertion plate 230 and disposing the receiving parts 544 on the lower insertion plate 240.

The space $S_3$ formed between the lower insertion plate 240 and the upper insertion plate 230 by fitting the receiving parts 544 of the lower insertion plate 240 to the protrusions 534 of the upper insertion plate 230 should match with the height of the back area 242 of the recess 241 of the lower insertion plate 240 in this case. It is also possible to dispose the receiving parts 544 on the upper insertion plate 230 and dispose the protrusions 534 to the lower insertion plate 240.

Figure 35:
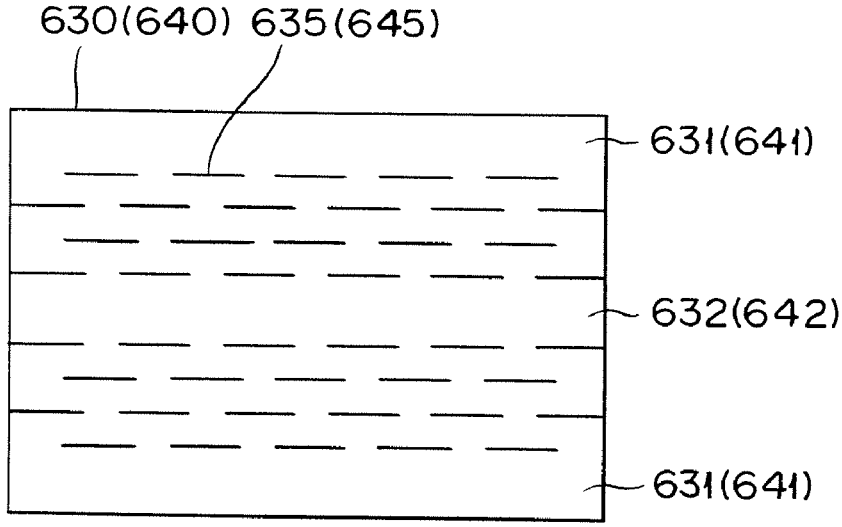
FIG. 35 is a plan view of assistance in explaining a lower insertion plate and an upper insertion plate that constitute reinforcement members for a preform according to an embodiment A7.
Figure 36:
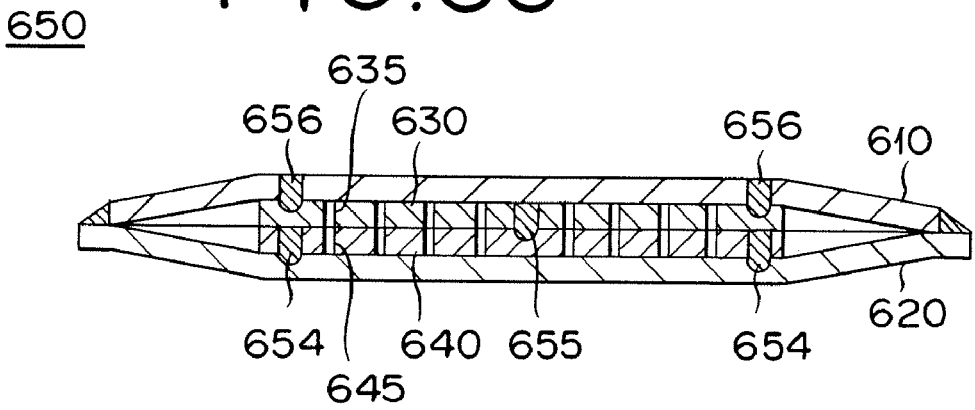
FIG. 36 is a cross-sectional view of assistance in explaining the preform according to the embodiment A7.
Figure 37:
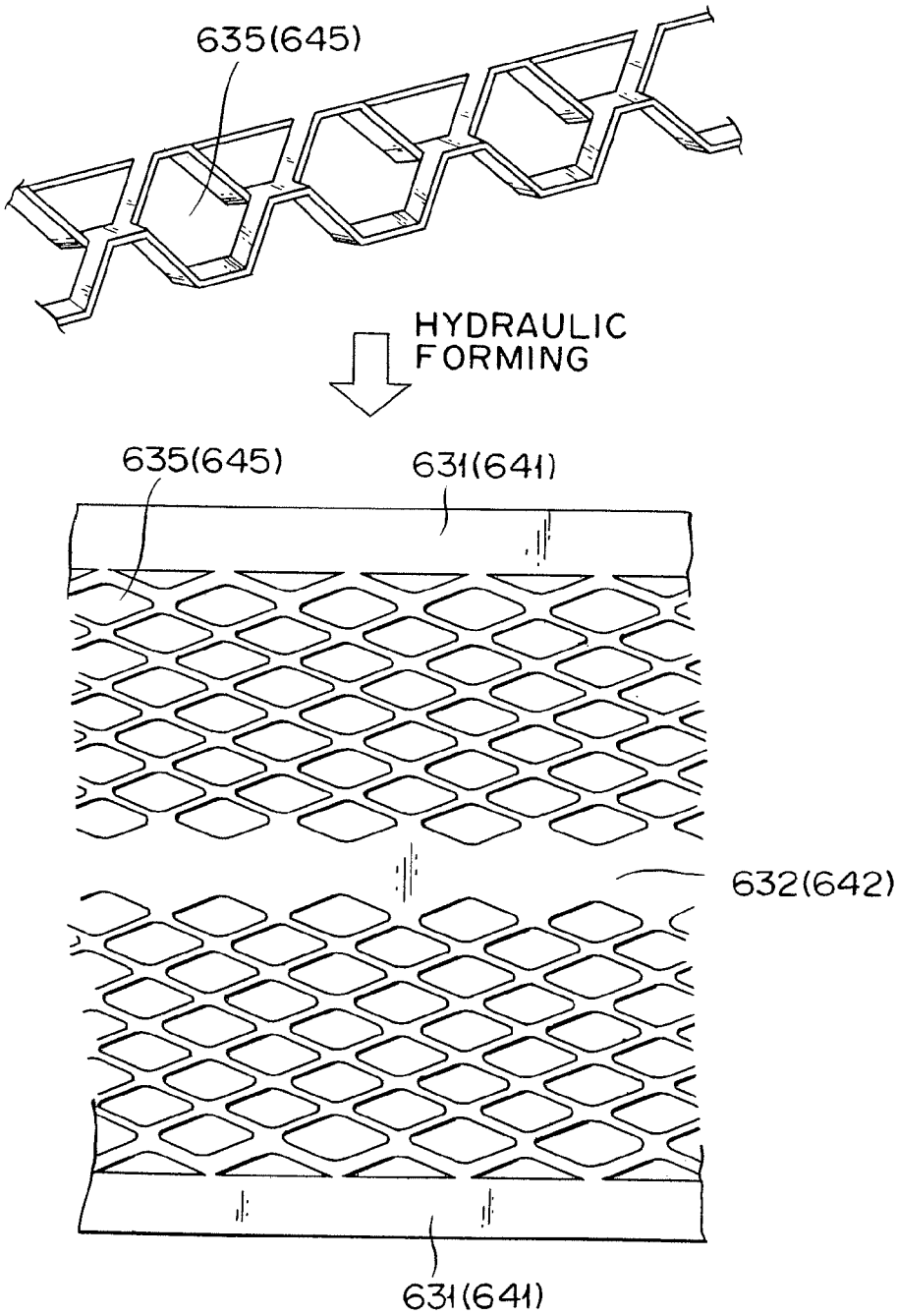
FIG. 37 is a schematic illustration of assistance in explaining shape changes of openings shown in FIG. 35.

FIG. 35 is a plan view of assistance in explaining a lower insertion plate and an upper insertion plate that constitute reinforcement members for a preform according to the embodiment A7, FIG. 36 is a cross-sectional view of assistance in explaining the preform according to the embodiment A7, and FIG. 37 is a schematic illustration of assistance in explaining shape changes of openings shown in FIG. 35.

The preform concerning the embodiment A7 is substantially different from the preform 50 concerning the embodiment A1 in regard to the shape of the upper insertion plate and the lower insertion plate in that an upper insertion plate 630 and a lower insertion plate 640 concerning the embodiment A7 use expanded metal as defined by JIS G 3351 and have openings 635, 645. The openings 635, 645 are formed by generating slits in a staggered pattern by machining and then expanded by inflating deformation during hydroforming for minimizing the possibility of fractures of the upper insertion plate 630 and the lower insertion plate 640.

The openings 635, 645 are disposed in the non-jointing parts which are areas excluding both ends 631, 641 and a central areas 632, 642 of the upper insertion plate 630 and the lower insertion plate 640 where joints 654, 655 and 656 are disposed in order to minimize the effects on the joints. However, the openings 635, 645 can be formed over the entire surface if needed.

As can be seen from the above, the preform 650 allows the openings 635, 645 of the reinforcement members 630, 640 to expand by inflating deformation during hydroforming, the expansion of the openings 635, 645 minimizing the possibilities of the expansions of the reinforcement members 630, 640 that can result in fractures of the reinforcement members 630, 640.

Therefore, it can effectively prevent fractures of the reinforcement members 630, 640 even when the joint 655 connecting the central areas 632, 642 of the reinforcement members 630, 640 is excessively offset due to the fluctuation of the operating condition. The shapes of the openings 635, 645 are not particularly specified and can be anything such as diamond shapes or hexagonal shapes so long as they can be expanded by inflating deformation during hydroforming.

Figure 38:
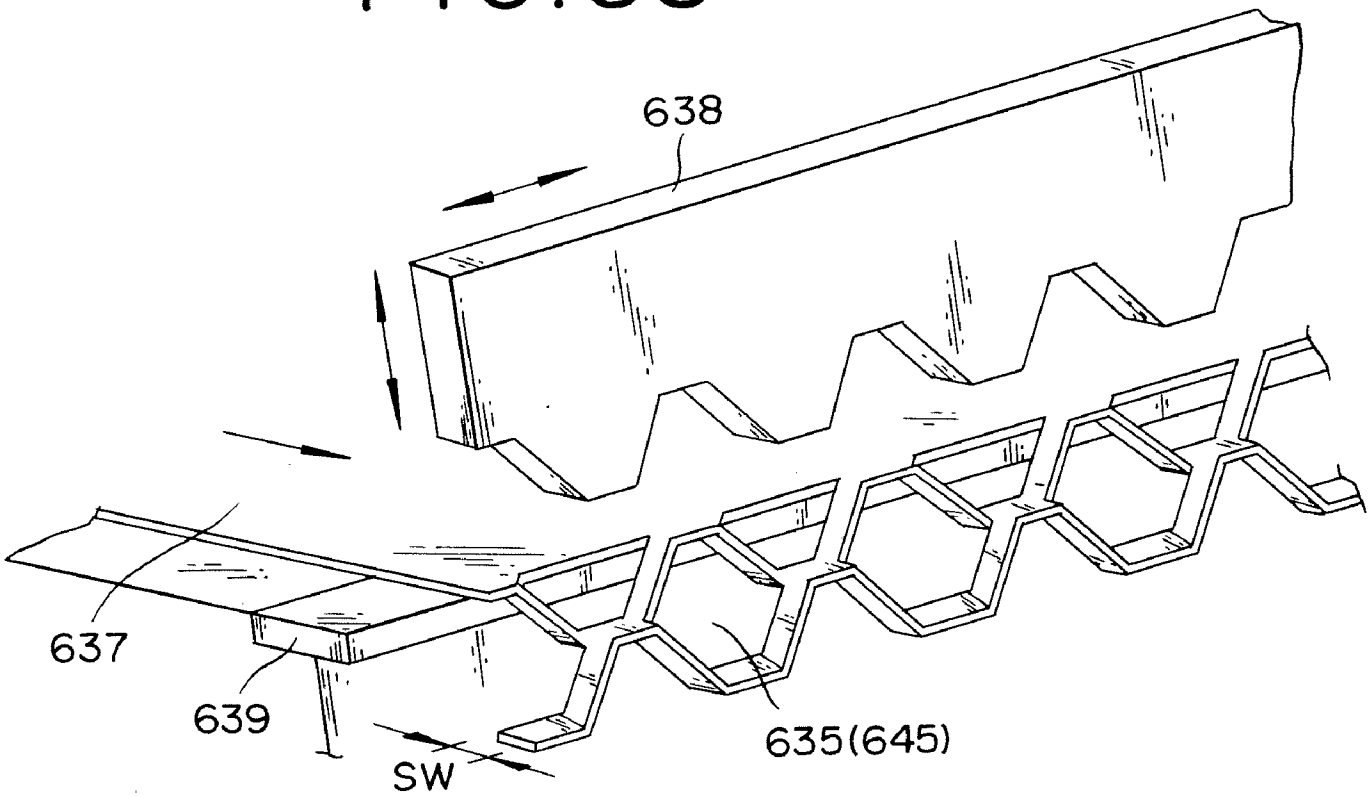
FIG. 38 is a perspective view of assistance in explaining an example of a forming apparatus for forming the openings shown in FIG. 35.

FIG. 38 is a perspective view of assistance in explaining an example of a forming apparatus for forming the openings shown in FIG. 35.

The forming apparatus for the openings can be a machine tool used in manufacturing expanded metal having an upper blade 638 with a wavy edge and a lower blade 639 with a straight edge. The upper blade 638 is disposed above a plate-like material 637 that is to constitute the reinforcement members 630, 640 in such a way as to be able to move freely in a vertical direction and a horizontal direction. The wavy edge of the upper blade 638 corresponds to the lengthwise dimensions of the openings 635, 645. The lower blade 639 is fixedly disposed below the upper blade 638 and supports the bottom of the plate-like material 637.

In forming the openings, the plate-like material 637 is fed an increment of the strand width SW of the openings 635, 645 at a time, for example, by means of pinch rollers, the upper blade 638 is then lowered by a prescribed stroke to cut the plate-like material 637, pushing it out at the same time, in coordination with the bottom blade 639, and the upper blade is then raised. The upper blade 638 advances half a pitch of the waveform of the blade when it rises to its up position and then lowers to cut the plate-like material 637 and pushes it out.

The openings are formed by repeatedly providing an intermittent feed to the plate-like material 637 and vertical and longitudinal reciprocating movements to the upper blade 638. Since the openings 635, 645 have corrugated shapes, they require a relatively larger space for stacking and make the preform larger. Therefore, it is preferable to be flattened by, for example, rolling.

Figure 39:
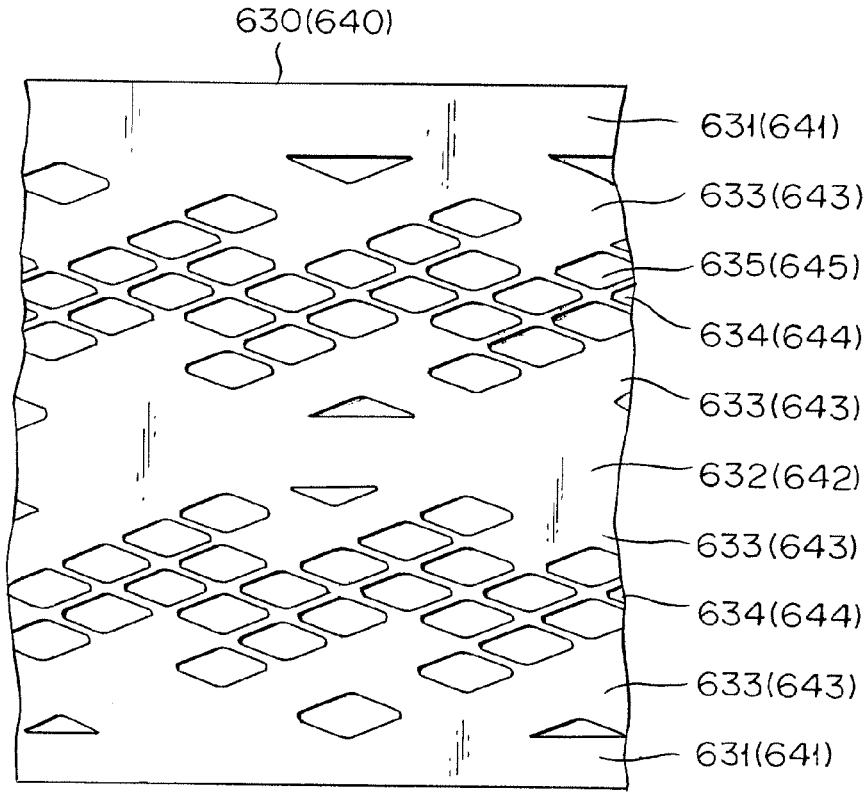
FIG. 39 is a plan view of assistance in explaining a modified example 1 according to the embodiment A7.
Figure 40:
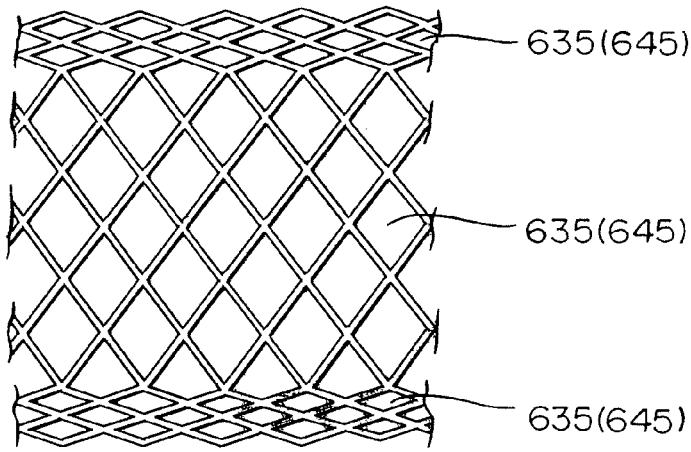
FIG. 40 is a plan view of assistance in explaining a modified example 2 according to the embodiment A7.
Figure 41:
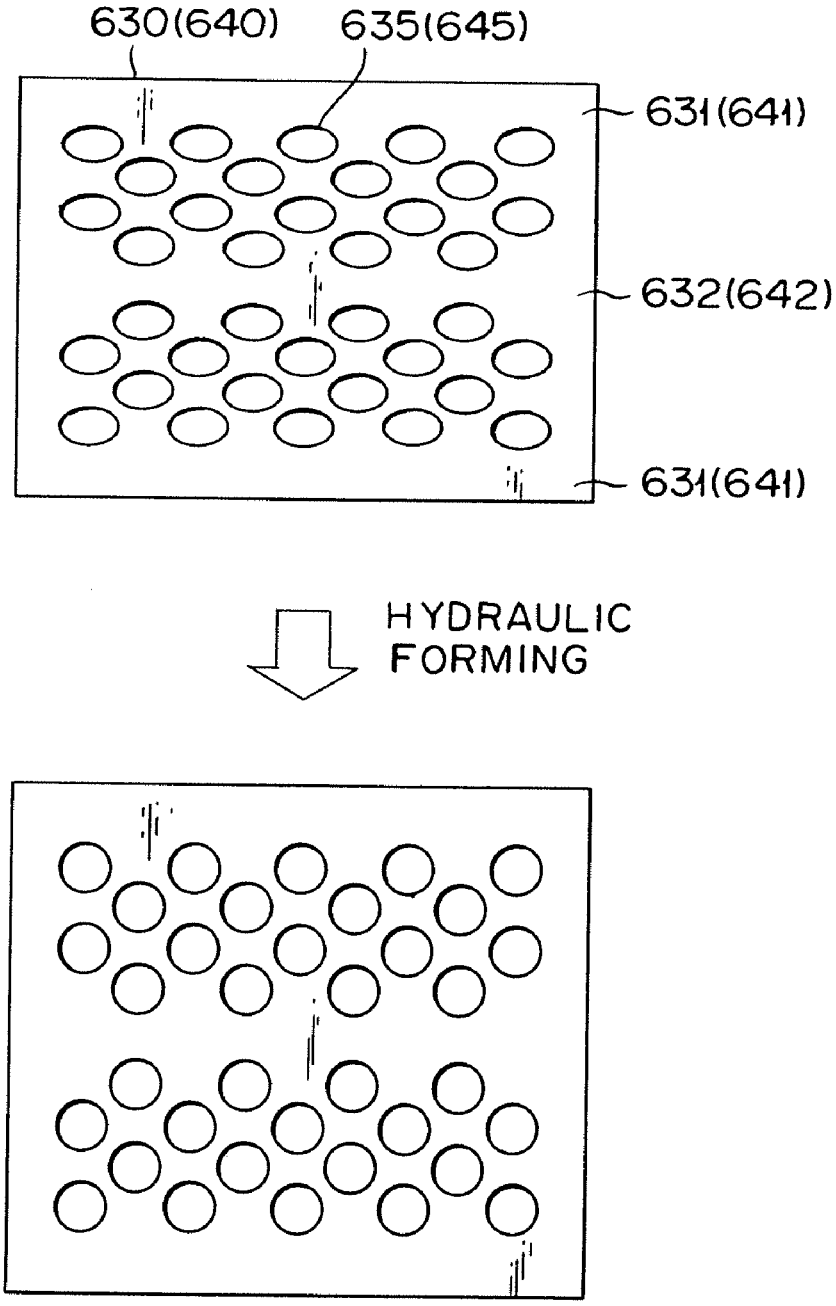
FIG. 41 is a schematic illustration of assistance in explaining a modified example 3 according to the embodiment A7.
Figure 42:
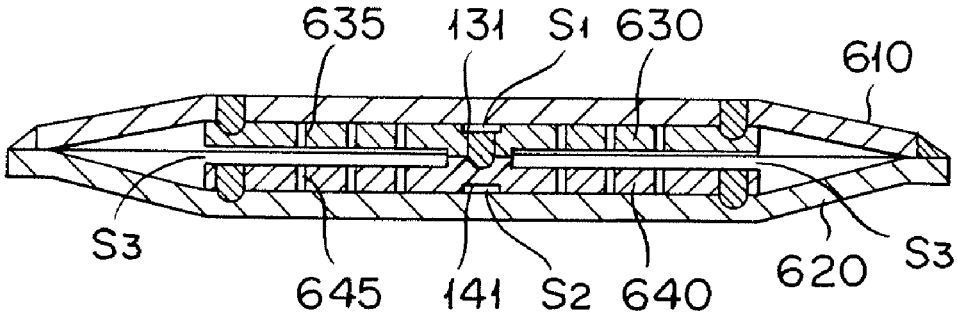
FIG. 42 is a cross-sectional view of assistance in explaining a modified example 4 according to the embodiment A7.

FIG. 39 and FIG. 40 are plan views of assistance in explaining modified examples 1 and 2 according to the embodiment A7, FIG. 41 is a schematic illustration of assistance in explaining a modified example 3 according to the embodiment A7, and FIG. 42 is a cross-sectional view of assistance in explaining a modified example 4 according to the embodiment A7.

It is preferable that the openings 635, 645 of the upper insertion plate 630 and the lower insertion plate 640 are constituted to expand evenly toward both ends 631, 641 and the central areas 632, 642. This can be achieved as shown in FIG. 39 by making the layout density of the openings 635, 645 in peripheral areas 633, 643 adjoining both ends 631, 641 and the central areas 632, 642 smaller than the layout density of the openings 635, 645 in middle areas 634, 644 located in between the peripheral areas 633, 643.

The shapes of the openings 635, 645 do not necessarily have to be equal but can be modified arbitrarily depending on the locations on the upper insertion plate 630 and the lower insertion plate 640 as shown in FIG. 40.

The openings 635, 645 do not have to be slits but rather punched out holes like those shown in FIG. 41 to reduce the unit's weight simultaneously. It is preferable in this case to adopt substantially an elliptical shape for the openings 635, 645 with its major axis aligned along the jointing direction of both ends 631, 641 and the central areas 632, 642 of the upper insertion plate 630 and the lower insertion plate 640 considering the direction of the tension that develops during hydroforming.

Moreover, the holes should preferably be produced by laser cutting or fine blanking in order to finish the hole's inner circumference smoother so that no crack can be started from those holes during hydroforming.

It is also possible to reduce welding failure by adopting recesses 131, 141 according to the embodiment A2 for the upper insertion plate 630 and the lower insertion plate 640 as shown in FIG. 42 to form spaces $S_1$-$S_3$. The embodiments A3 through A6 can be arbitrarily combined as well.

As stated above, it is possible to suppress the possibility of the enforcement materials' fractures more securely in the embodiment A7.

Figure 43:
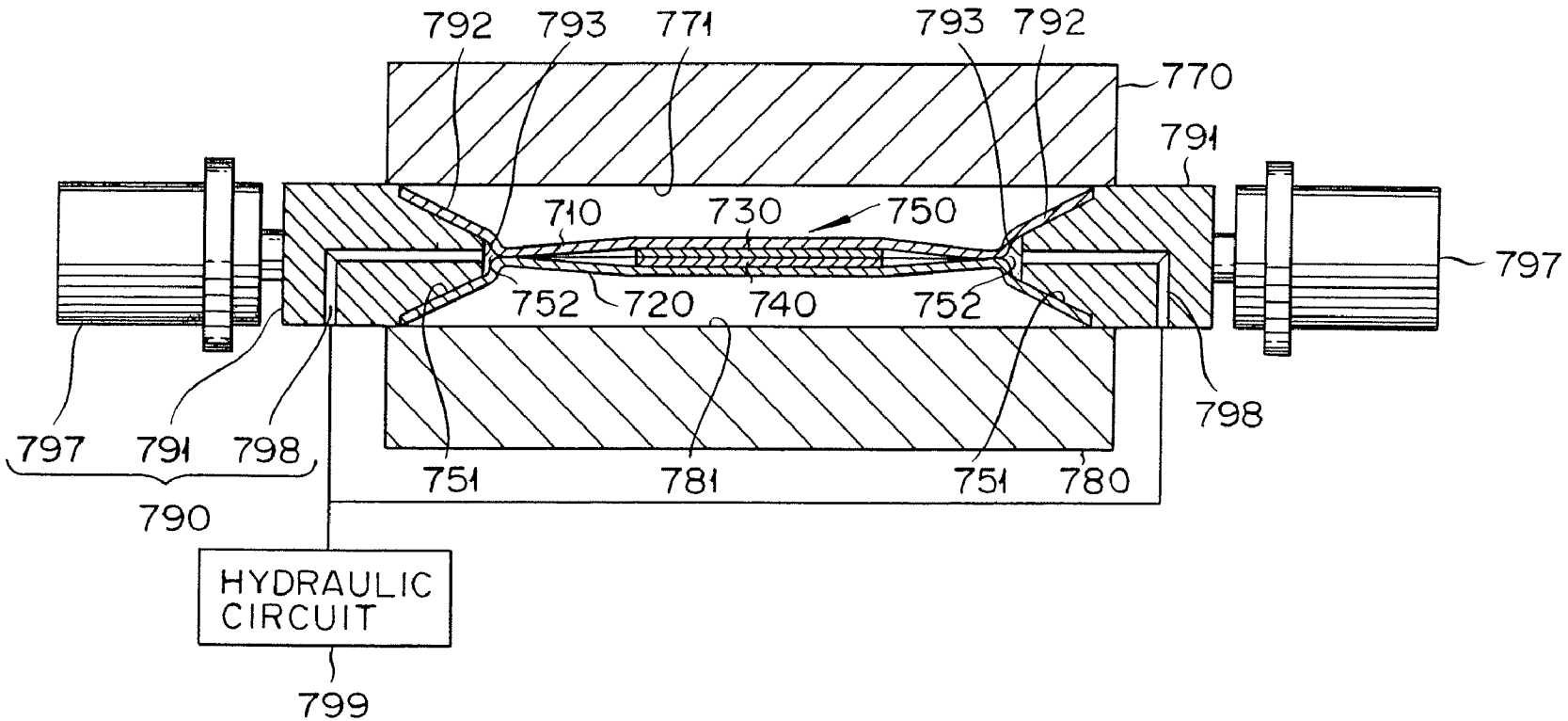
FIG. 43 is a cross-sectional view of assistance in explaining an embodiment A8.

FIG. 43 is a cross-sectional view of assistance in explaining an embodiment A8.

The embodiment A8 is substantially different from the embodiment A1 in the shape of the preform and the constitution of the hydroforming apparatus. A preform 750 concerning the embodiment A8 has a top plate 710 and a bottom plate 720 to form outer surfaces of the hydroformed product, an upper insertion plate 730 and a lower insertion plate 740 to form reinforcement ribs of the hydroformed product, and a non-jointing part 751 for providing hydraulic pressure by accepting a forming medium.

The upper insertion plate 730 and the lower insertion plate 740 are disposed inside of the top plate 710 and the bottom plate 720. The non-jointing part 751 is constituted of an abutment face between the end of the top plate 710 and the end of the bottom plate 720. The abutment face is preformed in substantially a conical shape. The non-jointing part 751 has an outer end on which a circular opening is provided and an inner end 752 communicating with the inside of the preform 750. In fact, the preform 750 has an opening formed by the abutment face between the end surface of one of the outer members 710 and the end surface of the other of the outer members 720. The non-jointing part 751 is not limited to a shape being disposed throughout the end surface but can be partially disposed.

The top plate 710 is disposed to face a cavity surface 771 of a top die 770. The bottom plate 720 is disposed to face a cavity surface 781 of a bottom die 780. The cavity surfaces 771, 781 correspond to the outer surfaces of the hydroformed product.

A hydraulic pressure supply mechanism 790 has a flow path 798 that communicates with a hydraulic circuit 799, an axial press punch 791, and an axial press cylinder 797. The axial press punch 791 is located on each side of the top die 770 and the bottom die 780 and is connected to the axial press cylinder 797. The axial press punch 791 has a nozzle unit 792.

The nozzle unit 792 has an injection port 793 that communicates with the flow path 798, and presents a substantially conical shape that corresponds with the shape of the non-jointing part 751. The axial press cylinder 797 supports the axial press punch 791 to move towards or away from the dies of the top die 770 and the bottom die 780. The power source of the axial press cylinder 797 is typically hydraulic or pneumatic.

The non-jointing part 751 of the preform 750 expands when the nozzle unit 792 is pushed into its opening, while its expanded diameter is restricted by the top die 770 and the bottom die 780. As a consequence, the non-jointing part 751 makes a close contact with the nozzle unit 792 providing a sealing effect.

The injection port 793 of the nozzle unit 792 is aligned with the inner end 752 that communicates with the inside of the preform 750. As a consequence, the forming medium supplied from the hydraulic circuit 799 is introduced to the flow path 798 and the injection port 793, the forming medium is injected into the inside of the preform 750 via the non-jointing part 751 and the inner end 752.

Therefore, the hydraulic pressure supply mechanism 790 applies a hydraulic pressure to the inside of the preform 750 to cause an inflating deformation.

As can be seen from the above, the embodiment A8 can form the outer surfaces of the hydroformed product and reinforcement ribs that divide the hollow cross section of the hydroformed product by causing an inflating deformation of the preform 750 by means of hydraulic pressure by introducing a forming medium into an opening created by an abutment face between the end surface of one of the outer members 710, 720 and the end surface of the other of the outer members 710, 720.

Figure 44:
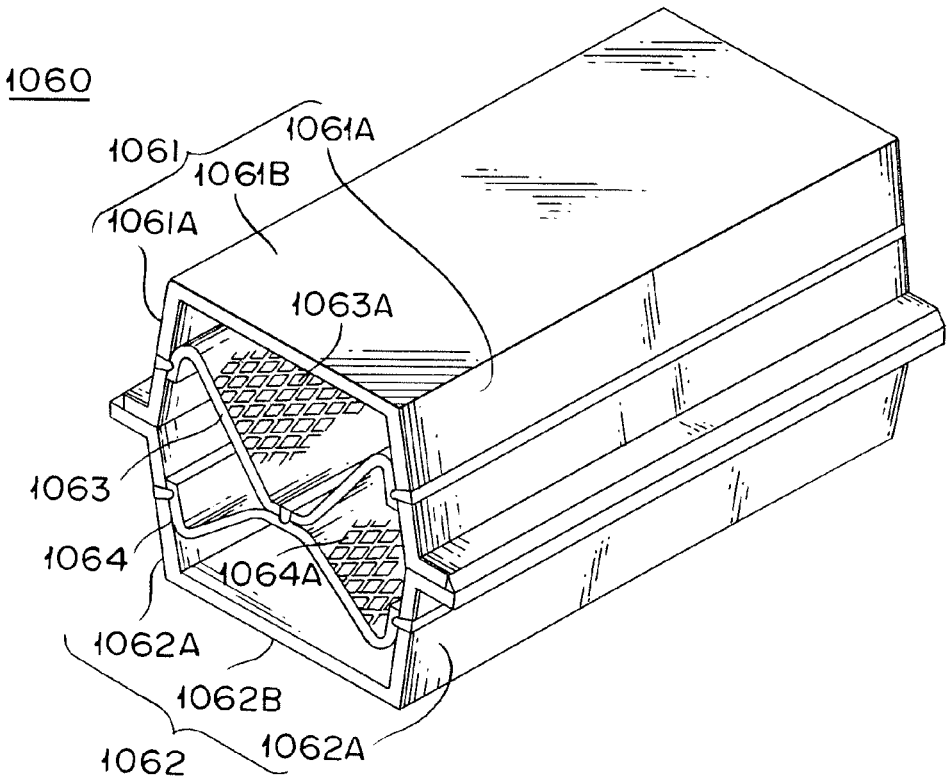
FIG. 44 is a perspective view of assistance in explaining a hydroformed product according to an embodiment B1.
Figure 45:
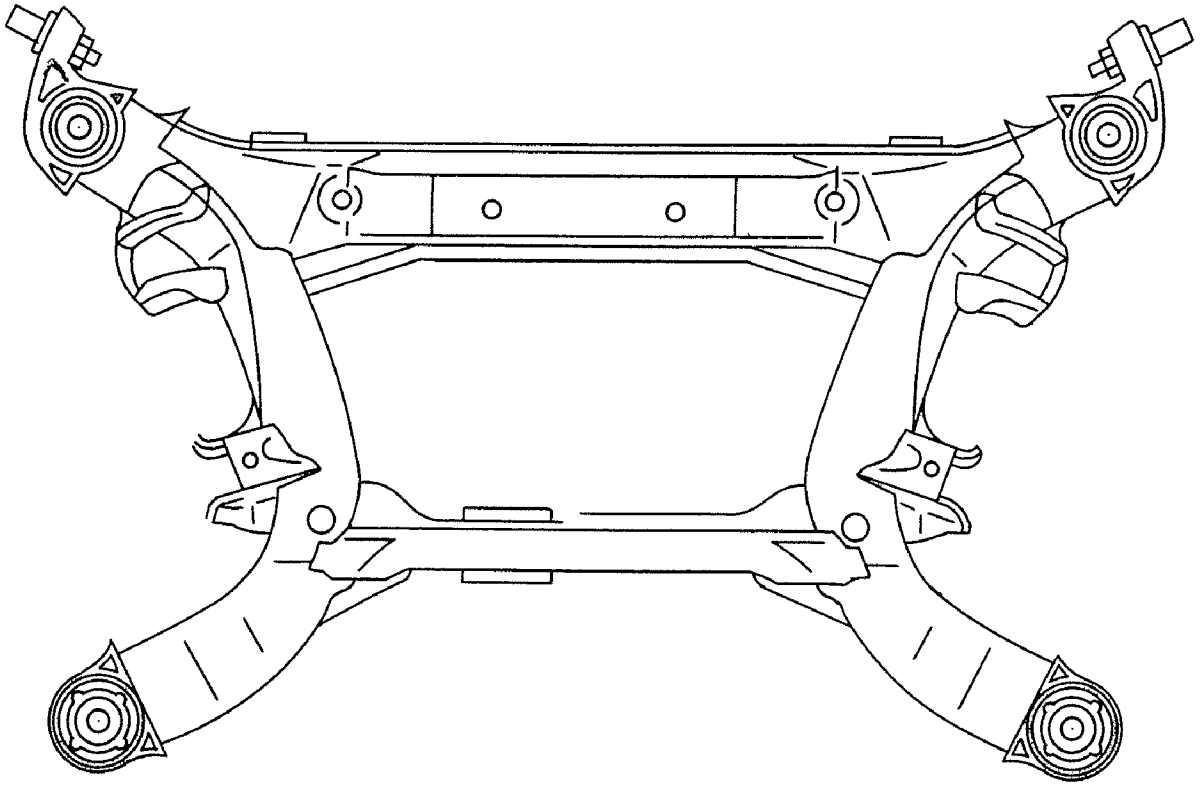
FIG. 45 is a plan view of assistance in explaining an automobile part to which the hydroformed product shown in FIG. 44 is applied.

FIG. 44 is a perspective view of assistance in explaining a hydroformed product according to an embodiment B1 and FIG. 45 is a plan view of assistance in explaining an automobile part to which the hydroformed product shown in FIG. 44 is applied.

A hydroformed product 1060 has outer surfaces 1061, 1062 forming a hollow structure and reinforcement members 1063, 1064 and is applied to automobile parts that require lighter weight and high rigidity, such as a side member and a cross member of a suspension part 1065. The hydroformed product 1060 can also be applied to pillar parts, axle parts, or body side parts.

Outer surfaces 1061, 1062 have sidewalls 1061A, 1062A that are inclined relative to an overlapping surface OS and summit parts 1061B, 1062B that are surrounded by the sidewalls 1061A, 1062A. The reinforcement ribs 1063, 1064 are dividing hollow cross sections of outer surfaces 1061, 1062 and supporting sidewalls 1061A, 1062A in order to improve the rigidity relative to the horizontal or lateral direction relative to the overlapping surface OS. The reinforcement ribs 1063, 1064 have net-shaped slits or expanded openings 1063A, 1064A.

Figure 46:
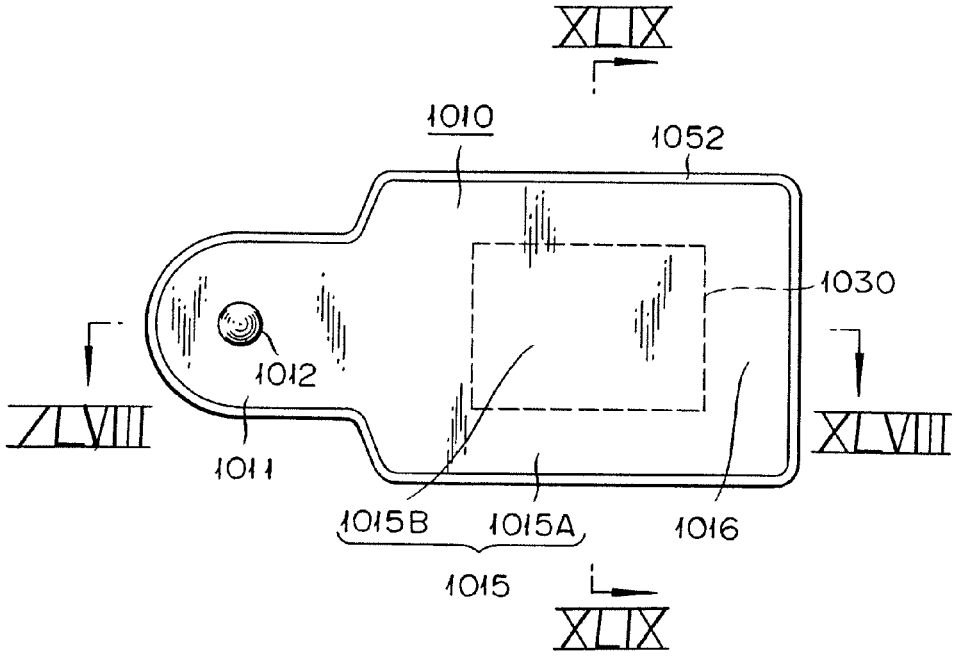
FIG. 46 is a plan view of assistance in explaining a preform according to the embodiment B1.
Figure 47:
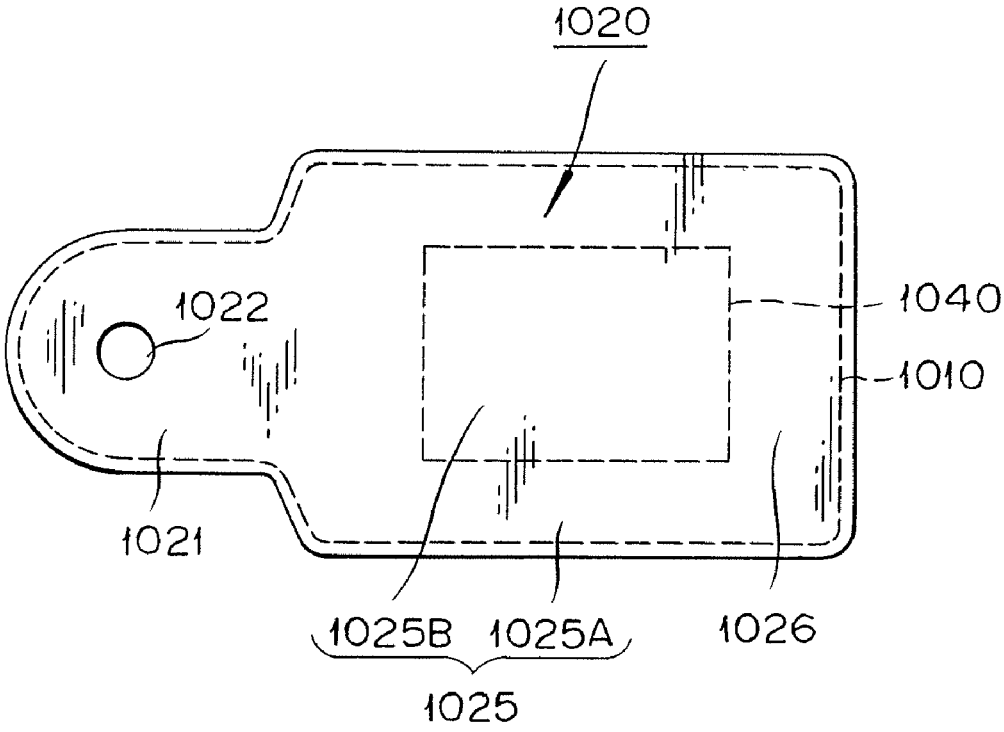
FIG. 47 is a rear elevation of the preform shown in FIG. 46.
Figure 48:
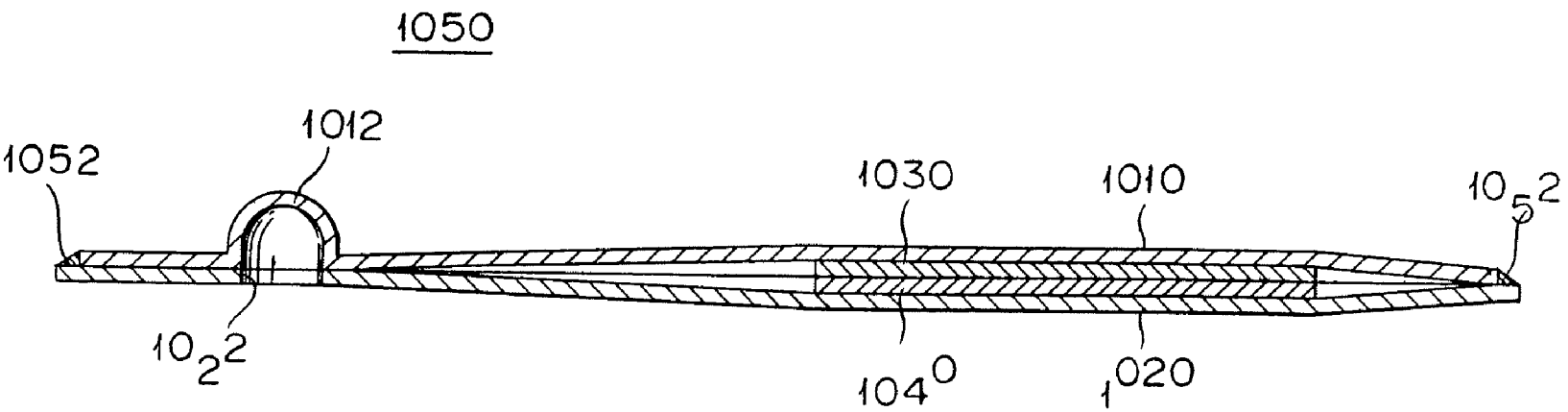
FIG. 48 is a cross-sectional view taken on line XLVIII-XLVIII of FIG. 46.
Figure 49:
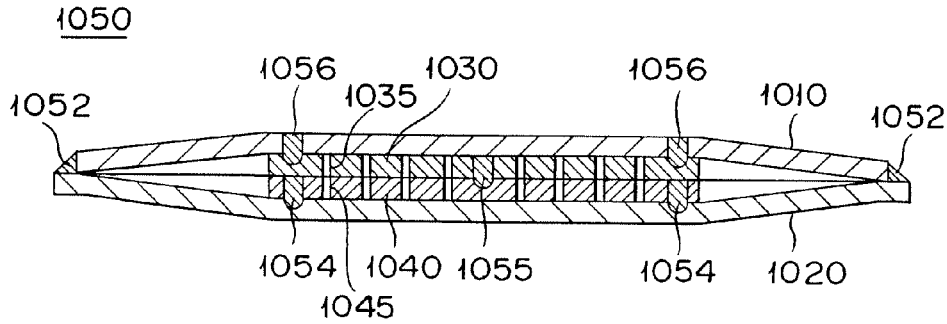
FIG. 49 is a cross-sectional view taken on line XLIX-XLIX of FIG. 46.

FIG. 46 is a plan view of assistance in explaining a preform according to the embodiment B1, FIG. 47 is a rear elevation of the preform shown in FIG. 46, FIG. 48 is a cross-sectional view taken on line XLVIII-XLVIII of FIG. 46, and FIG. 49 is a cross-sectional view taken on line XLIX-XLIX of FIG. 46.

The preform 1050 has outer members and reinforcement members. The outer members are parts to form the outer surfaces 1061, 1062 of the hydroformed product 1060. The reinforcement members are parts to form the reinforcement ribs 1063, 1064 of the hydroformed product 1060.

The sheet materials that constitute the outer members include the top plate 1010 as the first outer member and the bottom plate 1020 as the second outer member and their overlapping edge has a joint 1052 formed by fillet welding. The method of forming the joint 1052 can be anything that securely provides good sealing and does not affect hydraulic forming capability, for example, laser welding, arc welding, or gluing.

The sheet materials that constitute the reinforcement members include an upper insertion plate 1030 as the first reinforcement member and a lower insertion plate 1040 as the second reinforcement member of substantially same shapes and are disposed in the inside of the top plate 1010 and the bottom plate 1020 overlapping them respectively. The material of the sheet that constitute the outer members 1010, 1020 and the reinforcement members 1030, 1040 are not specified but can be cold rolled steel sheet or hot rolled mild steel sheet.

The top plate 1010 that forms the outer surface 1061 of the hydroformed product 1060 has a middle section 1015 and end sections 1011, 1016 located on both sides of the middle section 1015. A peripheral area 1015A and a central area 1015B of the middle section 1015 form the sidewall 1061A and the summit part 1061B of the outer surface 1061. A dome-shaped part 1012 is formed on the section 1011.

The bottom plate 1020 that is to form the outer surface 1062 of the hydroformed product 1060 is slightly larger than the top plate 1010 in size and is similar to the top plate 1010 in shape, and has a middle section 1025 that faces the middle section 1015 of the top plate 1010 and end sections 1021, 1026 that face the end sections 1011, 1016 of the top plate 1010. A peripheral area 1025A and a central area 1025B of the middle section 1025 form a sidewall 1062A and a summit part 1062B of the outer surface 1062. The end section 1021 has an opening 1022 that coincides with the position of the dome-shaped part 1012.

The upper insertion plate 1030 and the lower insertion plate 1040 have substantially same shapes. Both end sections 1041 of the lower insertion plate 1040 are jointed to the bottom plate 1020 via joints 1054. Both end sections 1031 of the upper insertion plate 1030 are jointed to the top plate 1010 via joints 1056. A central area 1042 of the lower insertion plate 1040 is jointed to a central area 1032 of the upper insertion plate 1030 via a joint 1055.

Both ends 1031, 1041 of the upper insertion plate 1030 and the lower insertion plate 1040 are jointed to peripheral areas 1015A, 1025A of the middle sections 1015, 1025 of the top plate 1010 and the bottom plate 1020 that form the sidewalls 1061A, 1062A of the outer surfaces 1061, 1062 of the hydroformed product 1060. As a result, the hydroformed product obtained from the preform 1050 will have the reinforcement ribs 1063, 1064 that support the sidewalls 1061A, 1062A, and thus improve the rigidity in the direction parallel or horizontal to the overlapping surface OS.

The joints 1054, 1055 and 1056 are formed by pierce welding. The pierce welding preferably welds together the first sheet material located on the surface and the second sheet material located below the first sheet material to provide a good joint strength. Laser welding or electronic beam welding can be applied as the pierce welding. Also, the method of forming the joints 1054, 1055 and 1056 can be anything that securely provides good jointing strength and does not affect hydroforming capability, for example, gluing.

Figure 50:
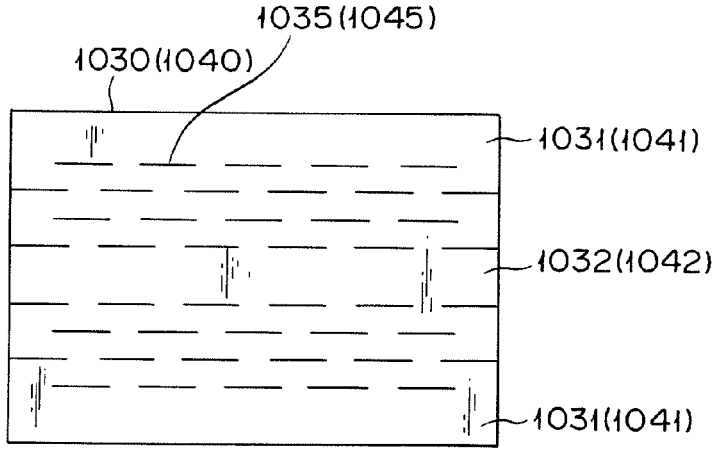
FIG. 50 is a plan view of assistance in explaining shapes of a lower insertion plate and an upper insertion plate that constitute reinforcement members of the preform shown in FIG. 48 and FIG. 49.
Figure 51:
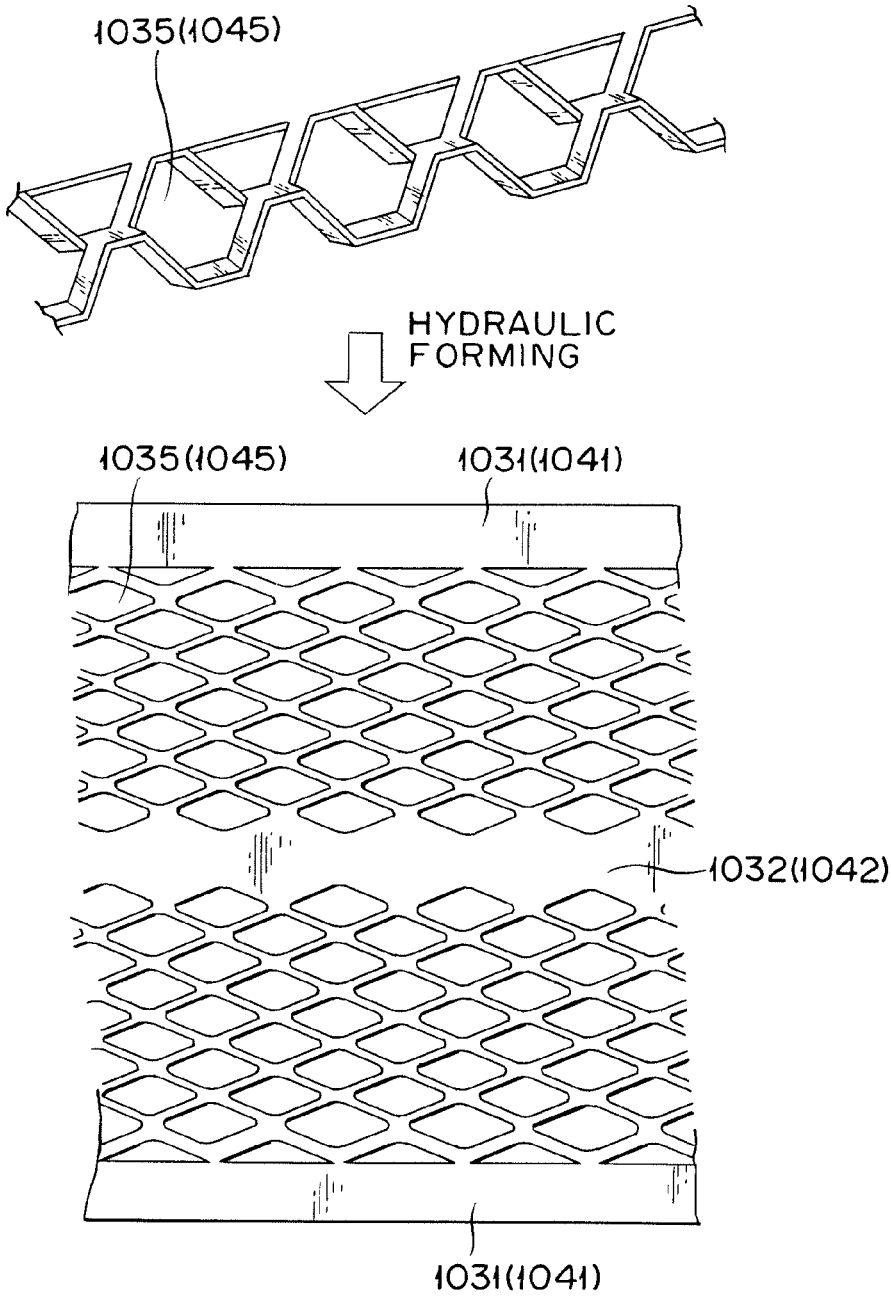
FIG. 51 is a plan view of assistance in explaining shape changes of openings shown in FIG. 50.

FIG. 50 is a plan view of assistance in explaining shapes of the lower insertion plate and the upper insertion plate that constitute reinforcement members of a preform shown in FIG. 48 and FIG. 49, and FIG. 51 is an enlarged view of assistance in explaining shape changes of the openings shown in FIG. 50.

The upper insertion plate 1030 and the lower insertion plate 1040 use, for example, expanded metal as defined by JIS G 3351 and have openings 1035, 1045. The openings 1035, 1045 are formed by generating slits in a staggered pattern by machining, and can be expanded by inflating deformation during hydroforming for minimizing the possibility of fractures of the upper insertion plate 1030 and the lower insertion plate 1040.

The openings 1035, 1045 are disposed in the non-jointing parts which are areas excluding both ends 1031, 1041 and central areas 1032, 1042 of the upper insertion plate 1030 and the lower insertion plate 1040 where joints 1054, 1055 and 1056 are disposed in order to minimize the effects on the joints. However, the openings 1035, 1045 can be formed over the entire surface if needed.

As can be seen from the above, the preform 1050 allows the openings 1035, 1045 built into the reinforcement members 1030, 1040 to expand by inflating deformation during hydroforming, the expansion of the openings 1035, 1045 minimizing the elongations of the reinforcement members 1030, 1040 that can result in fractures of the reinforcement members 1030, 1040. Therefore, it can suppress the possibilities of fractures of the reinforcement members 1030, 1040.

Since the practical elongation characteristics of the reinforcement members 1030, 1040 are improved because of the existence of the openings 1035, 1045, the degree of freedom of the ratio between the widths of the outer members 1010, 1020 vs. the widths of the reinforcement members 1030, 1040, or the ratios of the lengths of the outer surface's peripheries and the lengths of reinforcement ribs improves. Consequently, it provides an increased design freedom and an increased manufacturing capacity. Also, narrowing the widths of the reinforcement members 1030, 1040 can accomplish the object of suppressing the fractures of the reinforcement members 1030, 1040 while reducing the weight of the reinforcement members 1030, 1040.

Furthermore, the shapes of the openings 1035, 1045 are not particularly specified and can be anything such as diamond shapes or hexagonal shapes so long as they can expand by inflating deformation during hydroforming. The formation of the openings 1035, 1045 can be accomplished by punching out holes.

Figure 52:
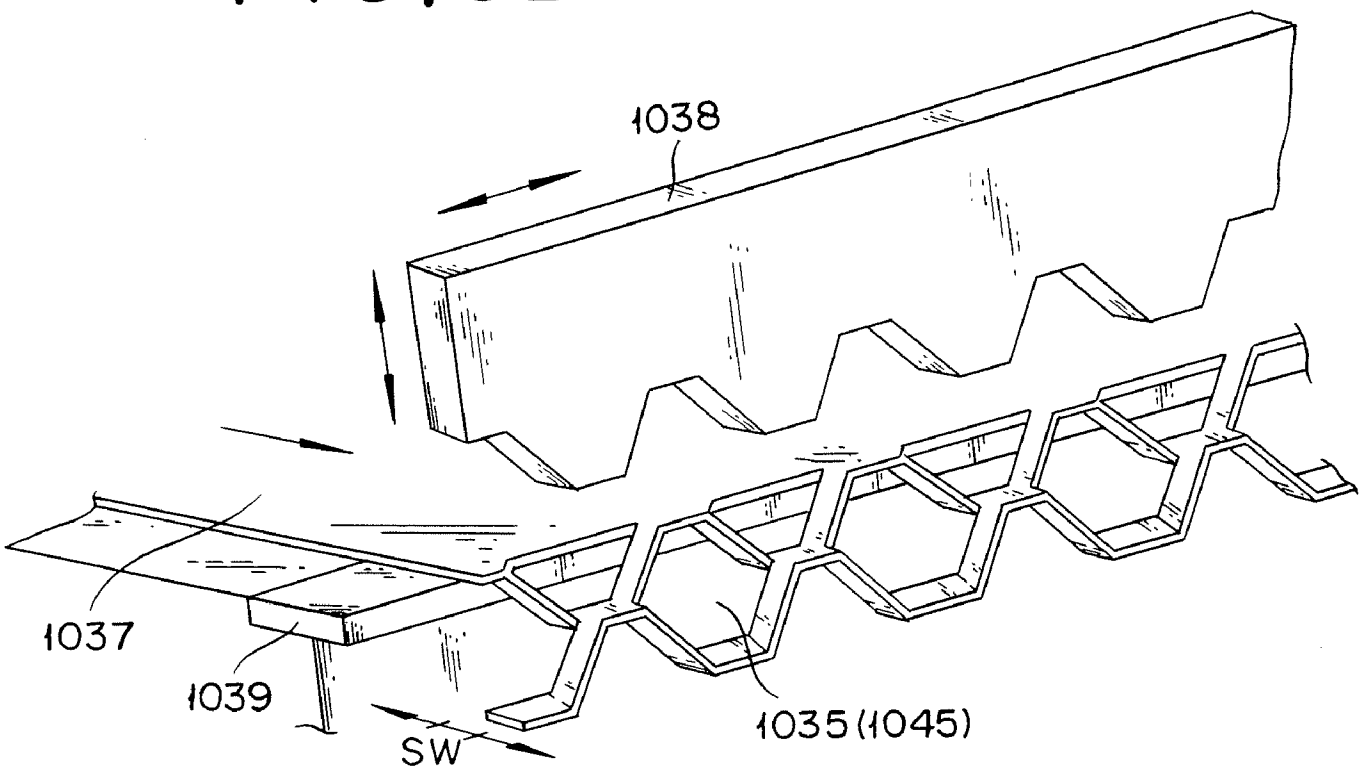
FIG. 52 is a perspective view of assistance in explaining an example of a forming apparatus for forming the openings shown in FIG. 50.

FIG. 52 is a perspective view of assistance in explaining an example of a forming apparatus for the openings shown in FIG. 50.

The forming apparatus for the openings can be a machine tool used in manufacturing expanded metal having an upper blade 1038 with a wavy edge and a lower blade 1039 with a straight edge. The upper edge 1038 is disposed above a plate-like material 1037 that is to constitute the reinforcement members 1030, 1040 in such a way as to be able to move freely in a vertical direction and a horizontal direction. The wavy edge of the upper blade 1038 corresponds to the lengthwise dimensions of the openings 1035, 1045. The lower blade 1039 is fixedly disposed below the plate-like material 1037 and supports the bottom of the plate-like material 1037.

In forming the openings, the plate-like material 1037 is fed an increment of the strand width SW of the openings 1035, 1045 at a time, for example, by means of pinch rollers, the upper blade 1038 is then lowered by a prescribed stroke to cut the plate-like material 1037, pushing it in at the same time, in coordination with the bottom blade 1039, and the upper blade 1038 is then raised. The upper blade 1038 advances half a pitch of the waveform of the blade when it rises to its up position then lowers to cut the plate-like material 1037 and pushes it out.

The openings are formed by repeatedly providing an intermittent feed to the plate-like material 1037 and vertical and longitudinal reciprocating movements to the upper blade 1038. Since the openings 1035, 1045 have corrugated shapes, they require a relatively larger space for stacking and make the preform larger. Therefore, it is preferable to be flattened by, for example, rolling.

Figure 53:
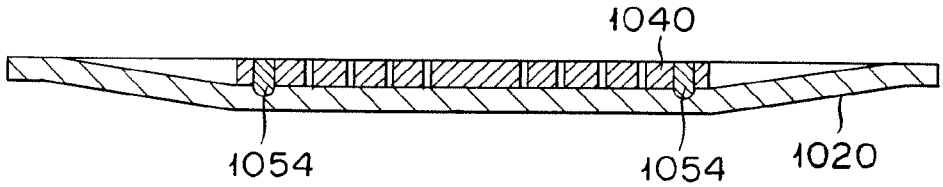
FIG. 53 is across-sectional view of assistance in explaining an example method of jointing the lower insertion plate and the upper insertion plate showing the jointing process of the lower insertion plate to a bottom plate.

Next, an example of the method for jointing the reinforcement members, or the lower insertion plate and the upper insertion plate of the preform will be described. FIG. 53 is a cross-sectional view of assistance in explaining the jointing process of the lower insertion plate to the bottom plate, FIG. 54 is a cross-sectional view of assistance in explaining the jointing process of the upper insertion plate to the lower insertion plate following FIG. 53, and FIG. 55 is across-sectional view of assistance in explaining the jointing process of the top plate to the upper insertion plate following FIG. 54.

First, the lower insertion plate 1040 is disposed on the bottom plate 1020 disposed in a specified location. Next, joint the end sections 1041 of the lower insertion plate 1040 to the peripheral areas 1025A of the middle section 1025 of the bottom plate 1020 by pierce welding to form the joint 1054 (see FIG. 53).

Figure 54:
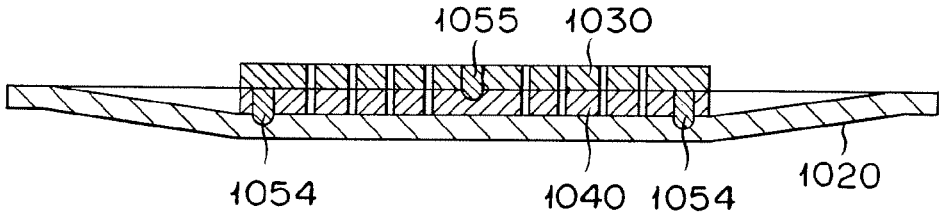
FIG. 54 is a cross-sectional view of assistance in explaining jointing process of the upper insertion plate to the lower insertion plate following FIG. 53.
Figure 55:
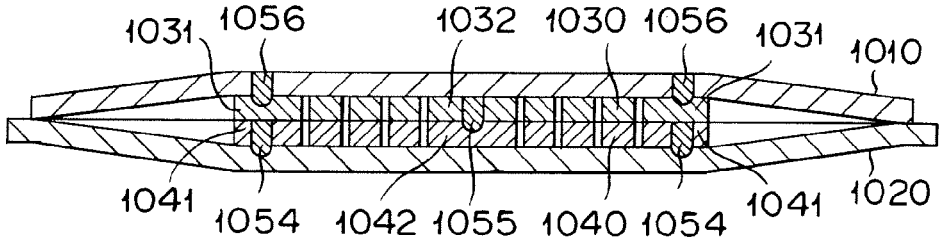
FIG. 55 is a cross-sectional view of assistance in explaining jointing process of a top plate to the upper insertion plate following FIG. 54.

After that, the upper insertion plate 1030 is laid on the lower insertion plate 1040 and the central area 1032 of the upper insertion plate 1030 is jointed to the central area 1042 of the lower insertion plate 1040 by pierce welding to form the joint 1055 (see FIG. 54).

The top plate 1010 is then laid on top of them to match the edges of the top plate 1010 with the edges of the bottom plate 1020. Next, joint the peripheral areas 1015A of the middle section 1015 of the top plate 1010 to both ends 1031 of the upper insertion plate 1030 by pierce welding to form the joint 1056 (see FIG. 55)

Finally, the overlapped edges of the top plate 1010 and the bottom plate 1020 are jointed to complete the preform 1050 (FIG. 49).

The openings 1035, 1045 are disposed in the areas excluding both ends 1031, 1041 and central areas 1032, 1042 of the upper insertion plate 1030 and the lower insertion plate 1040 where joints 1054, 1055 and 1056 are disposed, and thus have no effect on the joints.

Figure 56:
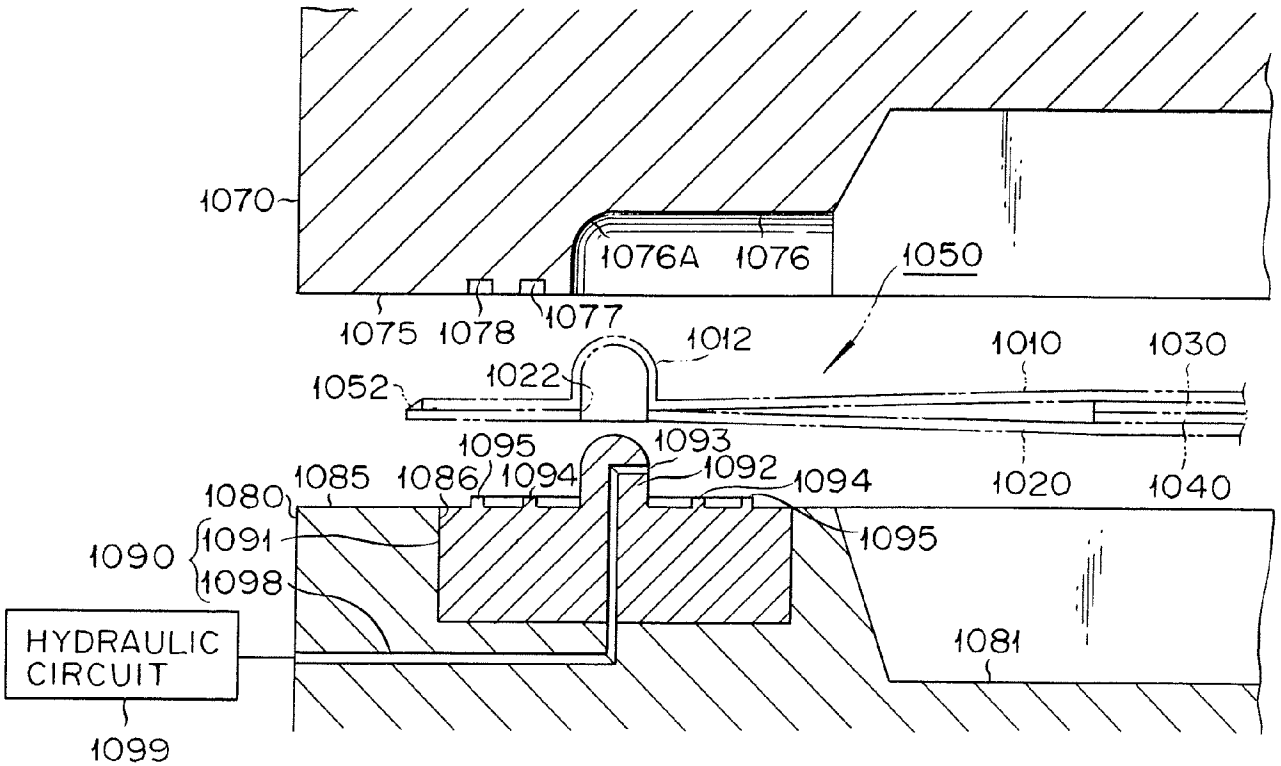
FIG. 56 is a cross-sectional view of assistance in explaining a hydroforming apparatus according to the embodiment B1.
Figure 57:
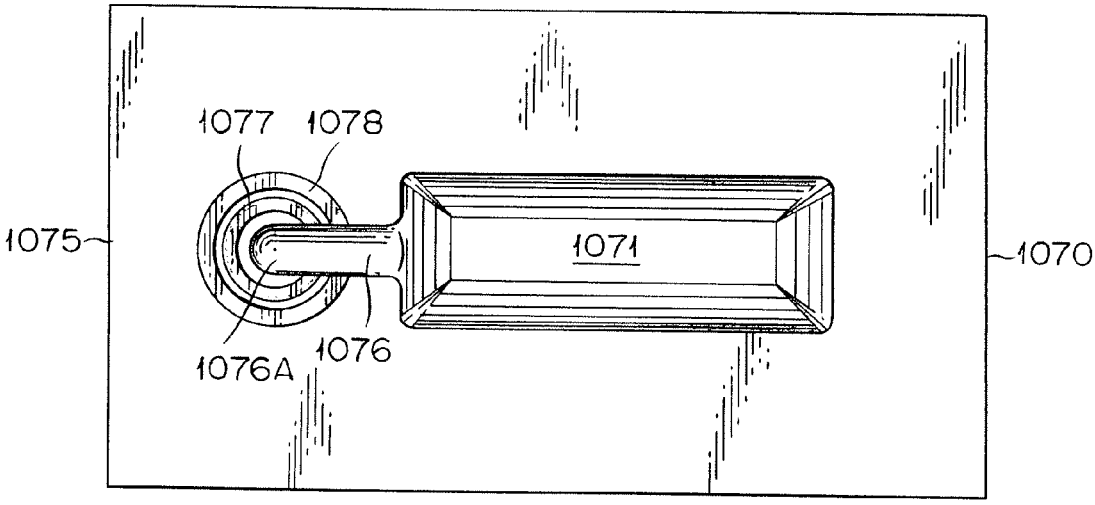
FIG. 57 is a plan view of assistance in explaining a top die for the hydroforming apparatus shown in FIG. 56.
Figure 58:
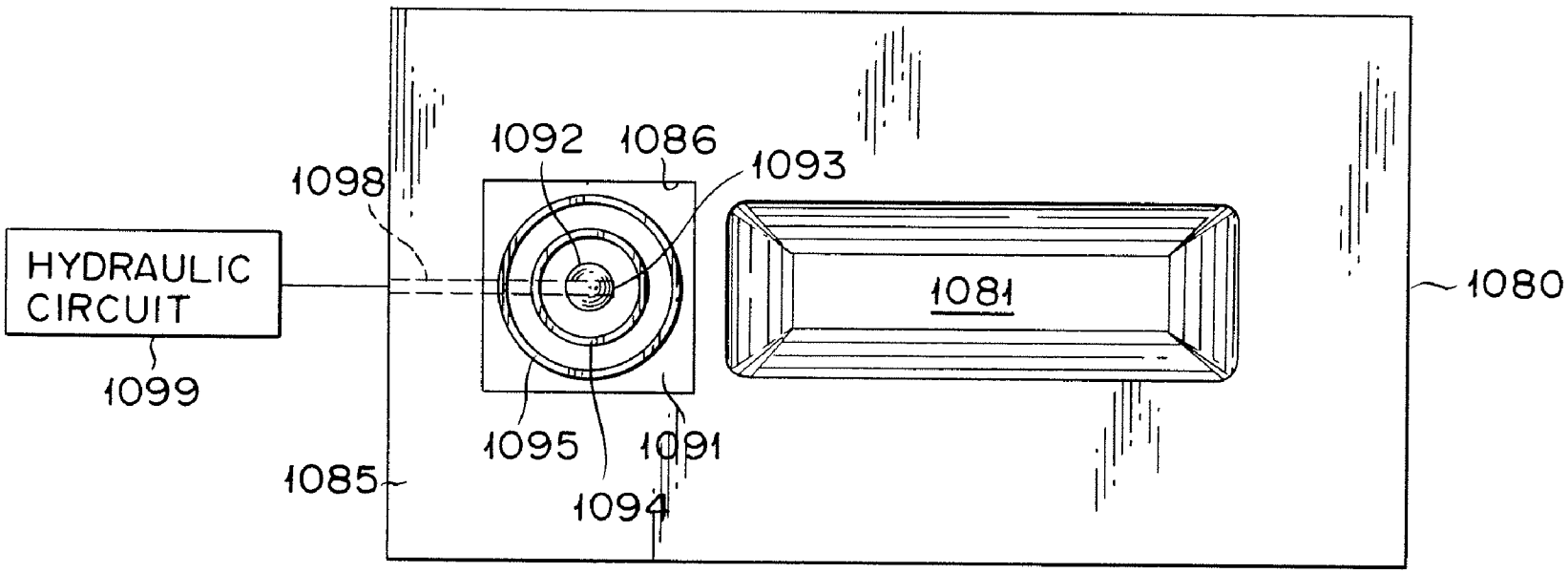
FIG. 58 is a plan view of assistance in explaining a bottom die for the hydroforming apparatus shown in FIG. 56.

FIG. 56 is a cross-sectional view of assistance in explaining a hydroforming apparatus according to the embodiment B1, FIG. 57 is a plan view of assistance in explaining a top die for the hydroforming apparatus shown in FIG. 56, and FIG. 58 is a plan view of assistance in explaining a bottom die for the hydroforming apparatus shown in FIG. 56.

The hydroforming apparatus has a top die 1070 and a bottom die 1080 as forming dies, and a hydraulic pressure supply mechanism 1090. The top die 1070 and the bottom die 1080 can be moved proximate to or apart from each other, and clamped with a preform 1050 being placed inside thereof.

The top die 1070 and the bottom die 1080 have cavity surfaces 1071, 1081 and pressing sections 1075, 1085. The cavity surfaces 1071, 1081 correspond to the outer surface shapes of the hydroformed product 1060, having sidewalls and summit parts, or top and bottom surfaces corresponding to the sidewalls 1061A, 1062A and summit parts 1061B, 1062B on the outer surfaces 1061, 1062 of the hydroformed product 1060. The pressing sections 1075, 1085 are parts to grip the outer periphery of the preform 1050 during the die clamping.

The pressing section 1075 of the top die 1070 includes a recess 1076 that extends from the cavity surface 1071, having arc-shaped grooves 1077, 1078 placed to surround an end section 1076A of the recess 1076. The end section 1076A has a cross-sectional shape that corresponds to the outer shape of the section obtained by vertically separating the dome-shaped part 1012 of the preform 1050 in two parts. The common center of the arc-shaped grooves 1077, 1078 coincides with the center of the end section 1076A. The pressing section 1085 of the bottom die 1080 has a substantially rectangular recess 1086 where a nozzle unit 1091 is to be placed.

The hydroforming apparatus further has a large spacer and a small spacer (not shown) placed between the pressing section 1075 of the top die 1070 and the pressing section 1085 of the bottom die 1080, so that the die clamping of the top die 1070 and the bottom die 1080 can be implemented in two stages.

The thickness of the large spacer is designed to correspond with the thickness of a part of the preform 1050 where the joints 1054, 1055 and 1056 are located, i.e., the total thickness of the top plate 1010, the bottom plate 1020, the upper insertion plate 1030 and the lower insertion plate 1040. The thickness of the smaller spacer is designed to correspond with the thickness of an edge of the preform 1050 where the joint 1052 is located, i.e., the total thickness of the top plate 1010 and the bottom plate 1020.

The hydraulic pressure supply mechanism 1090 is, for example, connected to a pressure generating device having a booster cylinder and a forming medium source, and has a flow path 1098 and a nozzle unit 1091 that are connected to a hydraulic circuit 1099. The flow path 1098 extends through the inside of the bottom die 1080 and reaches the nozzle unit 1091. The forming medium is typically water.

The nozzle unit 1091 has a dome-shaped section 1092 that corresponds to the inside of the dome-shaped section 1012 of the preform 1050, and annular protrusions 1094, 1095 disposed to surround the dome-shaped section 1092. The annular protrusions 1094, 1095 are matched in positions with the arc-shaped grooves 1077, 1078 of the pressing section 1075 of the top die 1070. The annular protrusions 1094, 1095 are smaller than the arc-shaped grooves 1077, 1078 in size and are selected in consideration of the thickness of the top plates 1010 and the bottom plate 1020. The arc-shaped grooves 1077, 1078 as well as annular protrusions 1094, 1095 can be omitted if necessary.

The dome-shaped part 1092 can pass freely through the opening 1022 of the bottom plate 1020 and has an injection port 1093 that communicates with the flow path 1098. When the nozzle unit 1091 is inserted into the opening 1022 and placed inside the dome-shaped part 1012 of the preform 1050, the forming medium supplied from the hydraulic circuit 1099 is introduced inside the preform 1050 via the nozzle part 1091 and the opening 1022. As a result, the forming medium applies a hydraulic pressure to the inside of the preform 1050 and causes an inflating deformation of the preform 1050.

Figure 59:
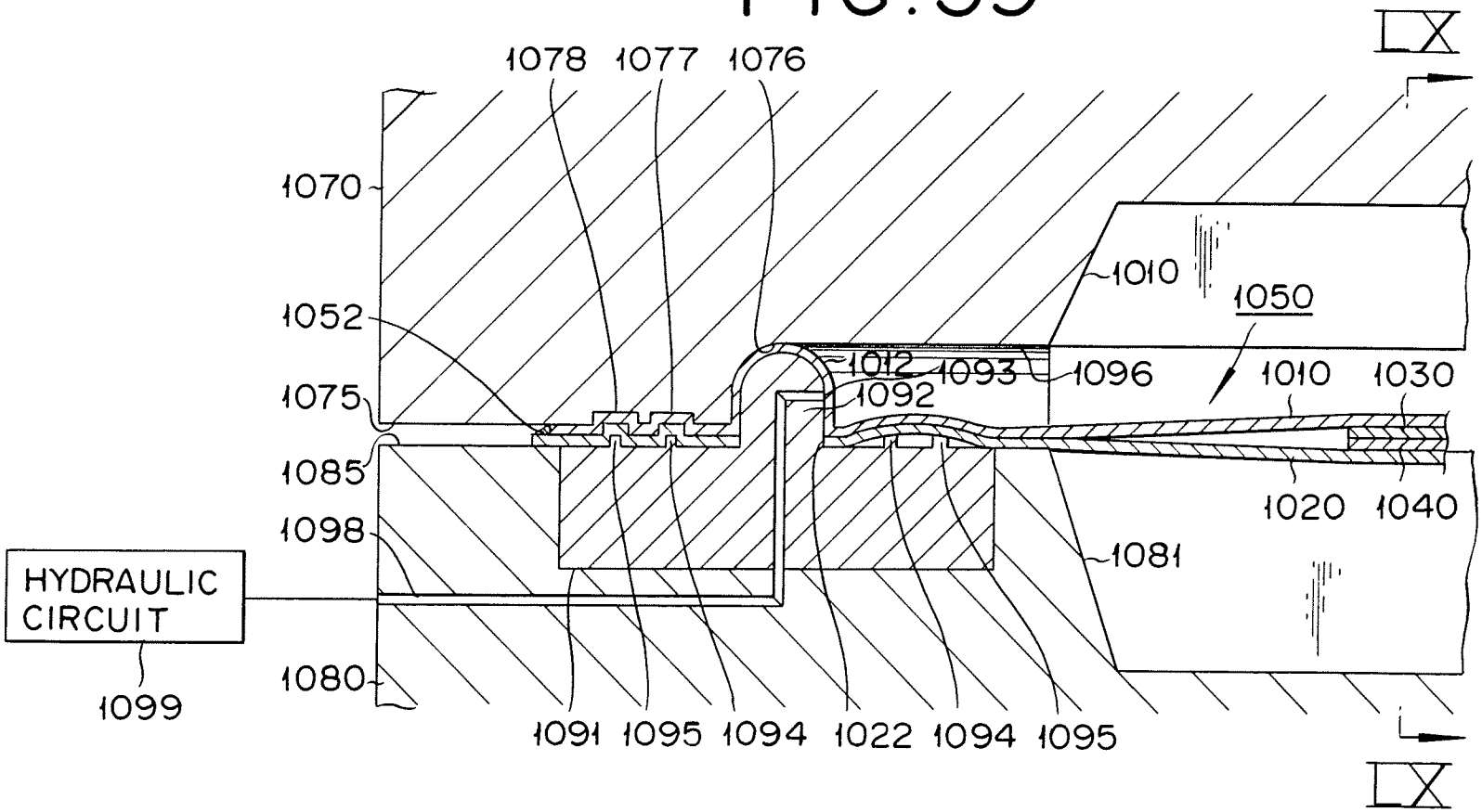
FIG. 59 is a cross-sectional view of assistance in explaining a hydroforming method according to the embodiment B1 showing a die clamping stage.
Figure 61:
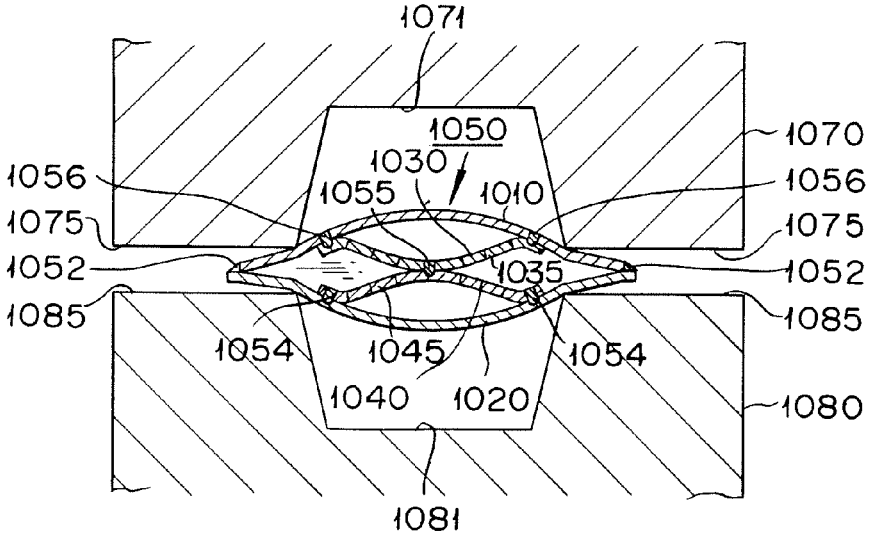
FIG. 61 is a cross-sectional view of assistance in explaining an initial stage of forming continued from FIG. 60.
Figure 62:
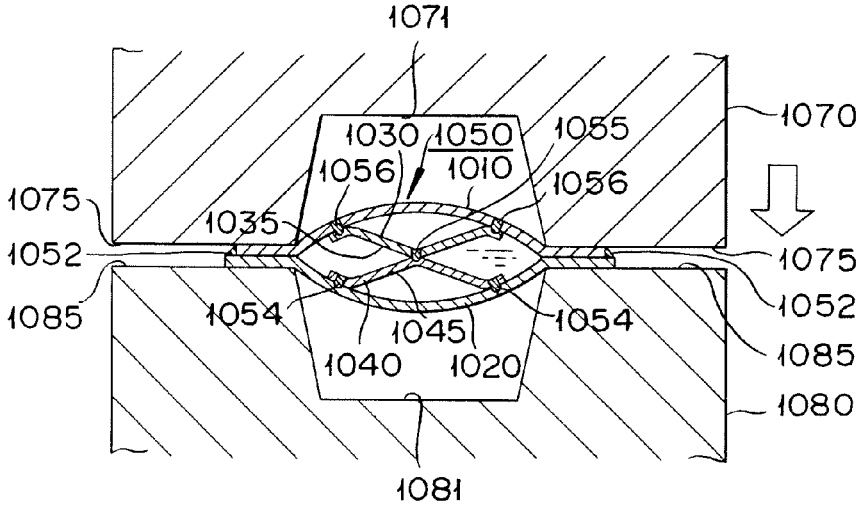
FIG. 62 is a cross-sectional view of assistance in explaining a die clamping stage continued from FIG. 61.
Figure 63:
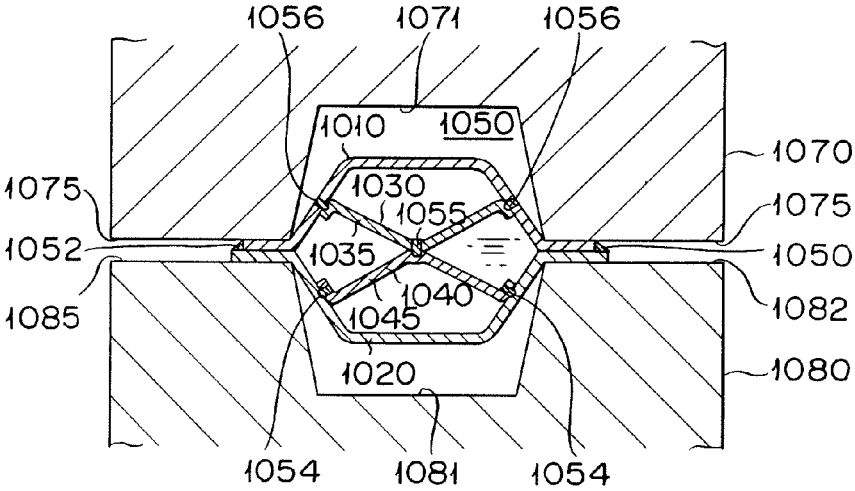
FIG. 63 is a cross-sectional view of assistance in explaining an intermediate stage of forming continued from FIG. 62.
Figure 64:
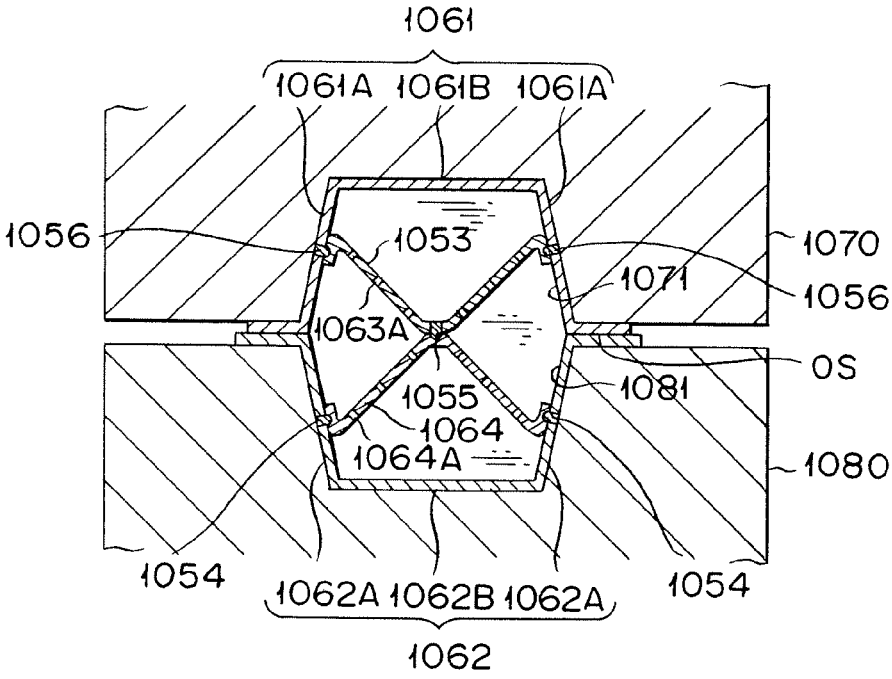
FIG. 64 is a cross-sectional view of assistance in explaining a latter stage of forming continued from FIG. 63.

Next, the hydroforming method according to the embodiment B1 will be described. FIG. 59 is a cross-sectional view of assistance in explaining a die clamping stage, FIG. 60 is a cross-sectional view taken on line LX-LX of FIG. 59, FIG. 61 is a cross-sectional view of assistance in explaining an initial stage of forming continued from FIG. 60, FIG. 62 is a cross-sectional view of assistance in explaining a die clamping stage continued from FIG. 61, FIG. 63 is a cross-sectional view of assistance in explaining an intermediate stage of forming continued from FIG. 62, and FIG. 64 is a cross-sectional view of assistance in explaining a latter stage of forming continued from FIG. 63.

First, the preform 1050 is placed on the bottom die 1080. At this time, the bottom plate 1020 that is to constitute the outer surface 1062 of the hydroformed product 1060 is disposed in such a way as to face the cavity surface 1081, and align the opening 1022 of the bottom plate 1020 with the dome-shaped part 1092 of the nozzle unit 1091 of the hydraulic pressure supply mechanism 1090.

Figure 60:
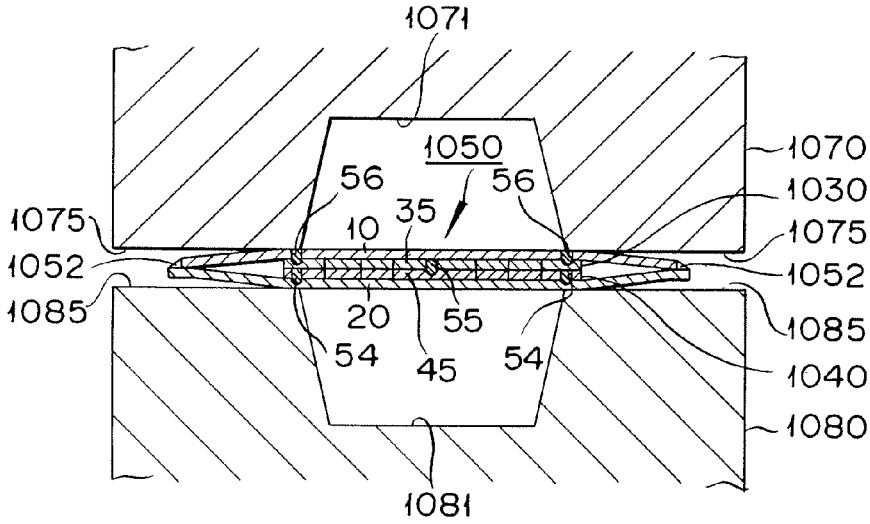
FIG. 60 is a cross-sectional view taken on line LX-LX of FIG. 59.

After that, the top die 1070, which has been in a standby position, comes down to approach the bottom die 1080 to complete the clamping of the top die 1070 and the bottom die 1080 (see FIG. 59 and FIG. 60). At this time, the top plate 1010, which is to constitute the outer surface 1061 of the hydroformed product 1060, is disposed in such a way as to face the cavity surface 1071, and the dome-shaped part 1012 of the top plate 1010 is fitted to the end section 1076A of the recess 1076 located in the pressing section 1075 of the top die 1070.

The vicinity of the dome-shaped part 1012 is gripped by the arc-shaped grooves 1077, 1078 in the pressing section 1075 of the top die 1070 and the annular protrusions 1094, 1095 in the nozzle unit 1091 placed in the recess 1086 of the bottom die 1080. This generates an annularly deformed area in the vicinity of the dome-shaped part 1012, which provides an improved sealability against the forming medium being introduced.

The joints 1052, 1054 and 1056 of the preform 1050 are disposed to the pressing sections 1075, 1085, which are positioned a prescribed clearance apart from each other by the large spacer (not shown).

The hydraulic pressure supply mechanism 1090 introduces a forming medium supplied from the hydraulic circuit 1099 into the inside of the preform 1050 via the nozzle unit 1091 and the opening 1022 to apply a hydraulic pressure. As a result, the preform 1050 causes its inflating deformation, bringing the edges of the preform 1050 closer toward the cavity surfaces 1071, 1081, and causing material flows.

As the joints 1054, 1056 of the preform 1050 move into the internal forming space surrounded by the cavity surfaces

1071, 1081 (see FIG. 61), the large spacer (not shown) placed between the pressing sections 1075, 1085 of the top die 1070 and the bottom die 1080 is replaced with smaller spacer. The top die 1070 comes down further in correspondence with the thickness of the smaller spacer to clamp the dies, securing a specified clearance corresponding to the thickness of the edges of the preform 1050 (see FIG. 62).

As the supply of the forming medium continues, the upper insertion plate 1030 and the lower insertion plate 1040 jointed to the top plate 1010 and the bottom plate 1020, which are causing inflating deformation, are stretched under a tension (see FIG. 63). At this time, the expansions of the openings 1035, 1045 of the upper insertion plate 1030 and the lower insertion plate 1040 suppress the elongations of the upper insertion plate 1030 and the lower insertion plate 1040 to minimize the possibilities of fractures of the upper insertion plate 1030 and the lower insertion plate 1040.

Moreover, the root sections of the upper insertion plate 1030 and the lower insertion plate 1040 bend in an L-shape because of the existence of the joints of 1054, 1056 limiting the radii of curvatures in the bends small. Furthermore, the upper insertion plate 1030 and the lower insertion plate 1040 pull each other via the joint 1055, the applied force remains balance so the shapes of the root sections of the upper insertion plate 1030 and the lower insertion plate 1040 become substantially similar.

When the inner pressure of the preform 1050 reaches its final pressure, the supply of the forming medium is stopped and held for a prescribed time to complete the inflation process of the preform 1050 (see FIG. 64). Consequently, the top plate 1010 and the bottom plate 1020 form the outer surfaces 1061, 1062 of the hydroformed product 1060 wherein the peripheral areas 1015A, 1025A and the central areas 1015B, 1025B of the middle sections 1015, 1025 of the top plate 1010 and the bottom plate 1020 form the sidewalls 1061A, 1062A that are inclined relative to the overlapping surface OS of the outer surface 1061, 1062 and the summit parts 1061B, 1062B surrounded by the sidewalls 1061A, 1062A, respectively.

On the other hand, since both ends 1031, 1041 of the upper insertion plate 1030 and the lower insertion plate 1040 are jointed to the sidewalls 1061A, 1062A and the central areas 1032, 1042 are jointed together, the upper insertion plate 1030 and the lower insertion plate 1040 divide the hollow cross section of the outer surfaces 1061, 1062 of the hydroformed product 1060 and form the reinforcement ribs 1063, 1064 that support the sidewalls 1061A, 1062A of the outer surfaces 1061, 1062.

Next, the top die 1070 is raised after removing the hydraulic pressure, the hydroformed product is taken out, and trimming including cutting is performed.

The reinforcement ribs 1063, 1064 of the hydroformed product 1060 are formed securely by suppressing the elongation that otherwise may cause fractures by allowing the openings 1035, 1045 of the upper insertion plate 1030 and the lower insertion plate 1040 to expand, so that they contribute in maintaining a stable and excellent strength quality of the hydroformed product 1060.

As can be seen from the above, the embodiment B1 of the present invention is capable of providing a preform that can restrain fractures of reinforcement members, a hydroforming method for obtaining a hydroformed product with stable and excellent strength quality, and a hydroformed product with stable and excellent strength quality.

Moreover, although it was shown to provide the hydraulic pressure by injecting the forming medium through the opening formed in one of the outer members, the embodiment B1 is capable of applying various other types of preforms and hydroforming apparatuses without being limited to the aforementioned particular style.

For example, the opening 1022 of the bottom plate 1020 and the nozzle unit 1091 of the hydraulic pressure supply mechanism 1090 can both be provided more than one. It is also possible to perform the die clamping only once by disposing the joints 1054, 1056 of the preform 1050 in the internal forming space surrounded by the cavity surfaces 1071, 1081 from the start, and thus eliminate the spacer replacement process.

Figure 65:
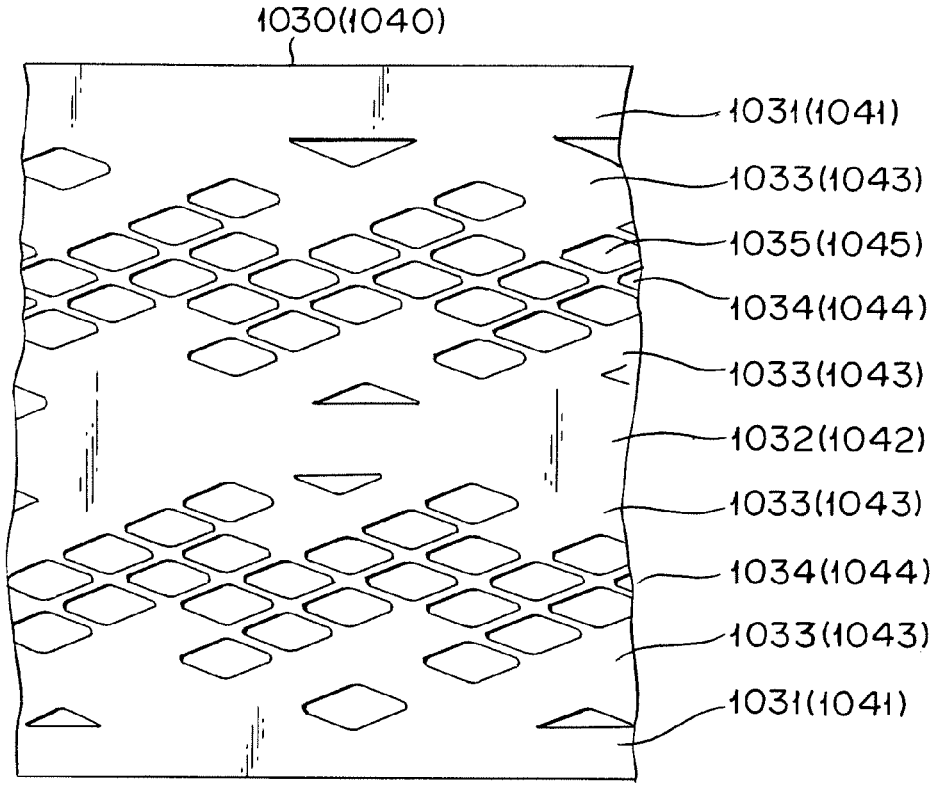
FIG. 65 is a plan view of assistance in explaining a modified example 1 of the openings according to the embodiment B1.
Figure 66:
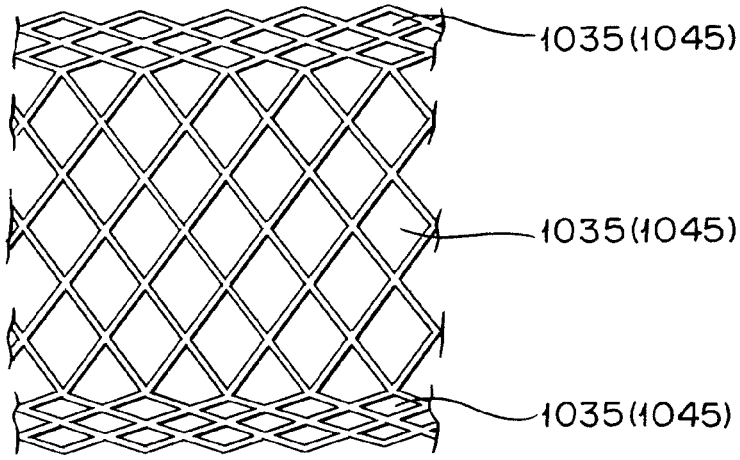
FIG. 66 is a plan view of assistance in explaining a modified example 2 of the openings according to the embodiment B1.
Figure 67:
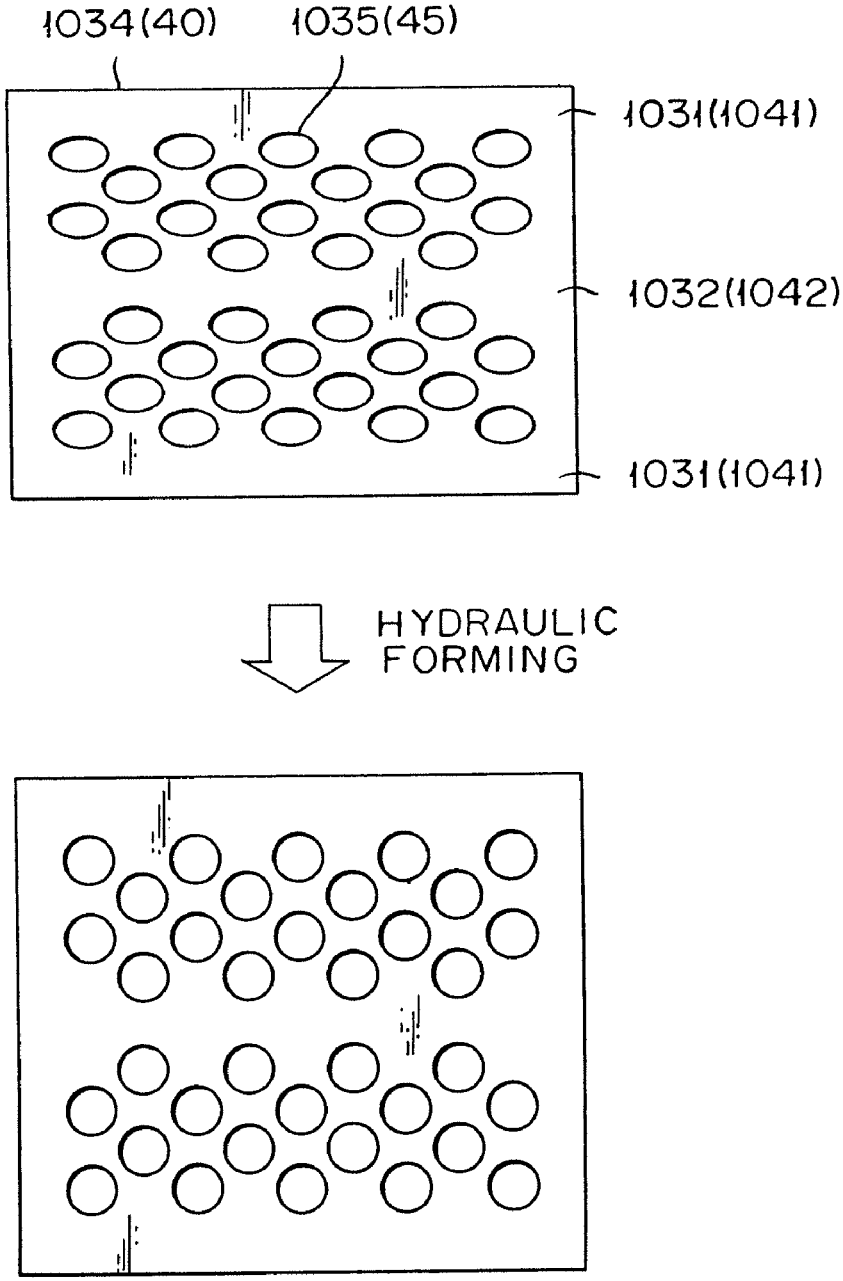
FIG. 67 is a schematic illustration of assistance in explaining a modified example 3 of openings according to the embodiment B1.

FIG. 65 and FIG. 66 are plan views of assistance in explaining a modified example 1, 2 of openings according to the embodiment B1, and FIG. 67 is a schematic illustration of assistance in explaining a modified example 3 of openings according to the embodiment B1.

It is preferable that the openings 1035, 1045 of the upper insertion plate 1030 and the lower insertion plate 1040 are constituted to expand evenly toward both ends 1031, 1041 and the central areas 1032, 1042. This can be achieved, as shown in FIG. 65, by making the layout density of the openings 1035, 1045 in peripheral areas 1033 and 1043 adjoining both ends 1031 1041 and the central areas 1032, 1042 smaller than the layout density of the openings 1035, 1045 in middle areas 1034, 1044 located in between the peripheral areas 1033 and 1043.

The shapes of the openings 1035, 1045 do not necessarily have to be equal but can be modified arbitrarily depending on the locations on the upper insertion plate 1030 and the lower insertion plate 1040 as shown in FIG. 66.

The openings 1035, 1045 do not have to be slits but rather punched out holes like those shown in FIG. 67 to reduce the unit's weight simultaneously. It is preferable in this case to adopt substantially an elliptical shape for the openings 1035, 1045 with its major axis aligned in the jointing direction related to both ends 1031, 1041 and the central areas 1032, 1042 of the upper insertion plate 1030 and the lower insertion plate 1040 considering the direction of the tension that develops during hydroforming.

Moreover, the holes should preferably be produced by laser cutting or fine blanking to make the hole's inner circumference smoother in order to prevent the holes from becoming starting points of cracks during hydroforming.

FIG. 68 is a cross-sectional view of a preform according to the embodiment B2 and FIG. 69 is a cross-sectional view of assistance in explaining shapes of a lower insertion plate and an upper insertion plate that constitute reinforcement members of the preform shown in FIG. 68. Those members that have the similar functions as those in the embodiment B1 will be denoted with the similar reference numerals hereinafter in order to avoid duplicating their descriptions.

The embodiment B2 is generally different from the embodiment B1 in that the welding yield is improved by modifying the shapes of the upper insertion plate and the lower insertion plate.

The upper insertion plate 1130 and the lower insertion plate 1140 in accordance with the embodiment B2 have recesses 1131, 1141 located substantially in the middle between the edges. The recesses 1131, 1141 have, for example, bending shapes which can be formed by presses.

The recesses 1131, 1141 are aligned with joint 1155 to be pierce welded. The welding heat generated by pierce welding moves primarily through an area with reduced thickness and the welding preferably requires a penetration of about two to three times of the material thickness. Therefore, it is so designed that the sheet thickness $D_2$ of the bottoms of the recesses 1131, 1141 is smaller than the sheet thickness $D_1$ of the vicinities of the recesses 1131, 1141, or areas where the recesses 1131, 1141 are not formed, and the width W of the recesses 1131, 1141 is two to three times of the sheet thickness $D_1$.

The lower insertion plate 1140 is disposed in such a way that the recess 1141 faces the bottom plate 1120, and its both ends are connected to the middle area of the bottom plate 1120 via the joint 1154. The recess 1141 forms a space $S_2$ between the lower insertion plate 1140 and the bottom plate 1120.

The upper insertion plate 1130 is disposed in such a way that a back area 1132 of the recess 1131 faces a back area 1142 of the recess 1141 of the lower insertion plate 1140, and the back areas 1132, 1142 are connected via the joint 1155. Since the back areas 1132, 1142 constitute protrusions or are protrusively shaped, they form a thin flat space $S_3$ between the upper insertion plate 1130 and the lower insertion plate 1140.

The top plate 1110 is disposed to face the recess 1131 of the upper insertion plate 1130, and the middle area of the top plate 1110 is connected to both ends of the upper insertion plate 1130 via the joint 1156. The recess 1131 forms a space $S_1$ between the upper insertion plate 1130 and the top plate 1110. The edges of the top plate 1110 are connected to the edges of the bottom plate 1120 via joints 1152.

Figure 72:
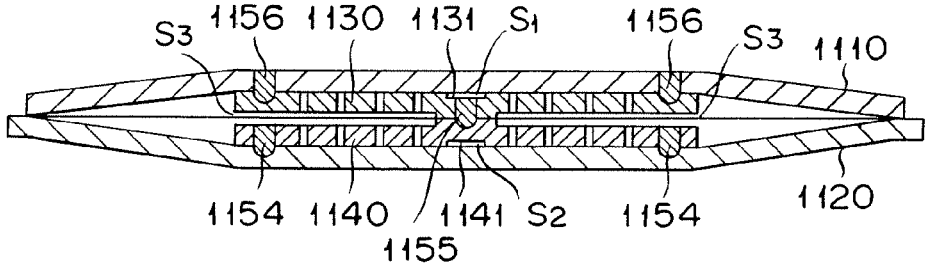
FIG. 72 is a cross-sectional view of assistance in explaining jointing process of a top plate to the upper insertion plate following FIG. 71.

Next, an example of the method for jointing the reinforcement members 1130, 1140 of the preform 1150 will be described. FIG. 70 is a cross-sectional view of assistance in explaining the jointing process of the lower insertion plate to the bottom plate, FIG. 71 is a cross-sectional view of assistance in explaining the jointing process of the upper insertion plate to the lower insertion plate following FIG. 70, and FIG. 72 is across-sectional view of assistance in explaining the jointing process of the top plate to the upper insertion plate following FIG. 71.

First, place the bottom plate 1120 at a specified position, and then place the lower insertion plate 1140 so as to cause the recess 1141 to face the bottom plate 1120. Next, join the end sections of the lower insertion plate 1140 to the bottom plate 1120 by pierce welding to form the joint 1154 (see FIG. 70).

Place the upper insertion plate 1130 on the lower insertion plate 1140 in such a way that the back area 1132 of the recess 1131 of the upper insertion plate 1130 abuts against the back area 1142 of the recess 1141 of the lower insertion plate 1140. Then joint the recess 1131 of the upper insertion plate 1130 to the back area 1142 of the recess 1141 of the lower insertion plate 1140 by pierce welding to form the joint 1155 (see FIG. 71).

In fact, the joint 1155 is formed by welding the first sheet material or the upper insertion plate 1130 located on the surface to the second sheet material or the lower insertion plate 1140 located below the first sheet material while stacking more than three pieces of sheet materials that constitute the outer member and the reinforcement members, i.e., the bottom plate 1120, the upper insertion plate 1130 and lower insertion plate 1140.

The recess 1141 of the lower insertion plate 1140 forms the space $S_2$. Specifically, the space $S_2$, which is aligned with the joint area, is located between the lower insertion plate 1140 as the second sheet material and the bottom plate 1120 as the third sheet material located below the second sheet material. The space $S_2$ therefore prevents the transmission of welding heat and inadvertent welding failure of the lower insertion plate 1140 as the second sheet material to the bottom plate 1120 as the third sheet material, and thus improves the welding yield.

The upper insertion plate 1130 is relatively unstable as it is supported only by the back area 1142 of the recess 1141 of the lower insertion plate 1140 via the back area 1132 of the recess 1131. Such an unstable condition can be averted by placing wedging plates 1158, 1159 in the space $S_3$ formed between the upper insertion plate 1130 and the lower insertion plate 1140. The space $S_3$ has a function of absorbing any warping that may have developed due to jointing of the lower insertion plate 1140 and the bottom plate 1120, and thus reduces poor welding to improve the welding yield.

The wedging plates 1158, 1159 are removed when the forming of the joint 1155 is completed, allowing the edges of the top plate 1110 to meet with the edges of the bottom plate 1120. Next, joint the top plate 1110 to both ends of the upper insertion plate 1130 by pierce welding to form the joint 1156 (see FIG. 72)

At this time, the space $S_3$ remains between the upper insertion plate 1130 and the lower insertion plate 1140. In fact, the joint 1156 is formed by welding the first sheet material or the top plate 1110 located on the surface to the second sheet material or the upper insertion plate 1130 located below the first sheet material while stacking more than three pieces of sheet materials that constitute the outer members and the reinforcement members, i.e., the topplate 1110, the bottom plate 1120, the upper insertion plate 1130 and lower insertion plate 1140. In addition, the space $S_3$, which is aligned with the joint area, is located between the upper insertion plate 1130 as the second sheet material and the lower insertion plate 1140 as the third sheet material located below the second sheet material.

Accordingly, the space $S_3$ prevents the transmission of welding heat and inadvertent welding failure of the second sheet material or the upper insertion plate 1130 to the third sheet material or the lower insertion plate 1140, and thus improves the welding yield.

When the joint 1156 is completed, the overlapping edges of the top plate 1110 and the bottom plate 1120 are jointed to complete the preform 1150 (see FIG. 68).

As can be seen from the above, the embodiment B2 makes it possible to reduce the manufacturing cost of the preform 1150 by preventing welding failures to improve the welding yield, and provides a preform with a good manufacturing cost. The use of the wedging plates 1158, 1159 placed in the space $S_3$ can be omitted depending on the situation.

Figure 73:
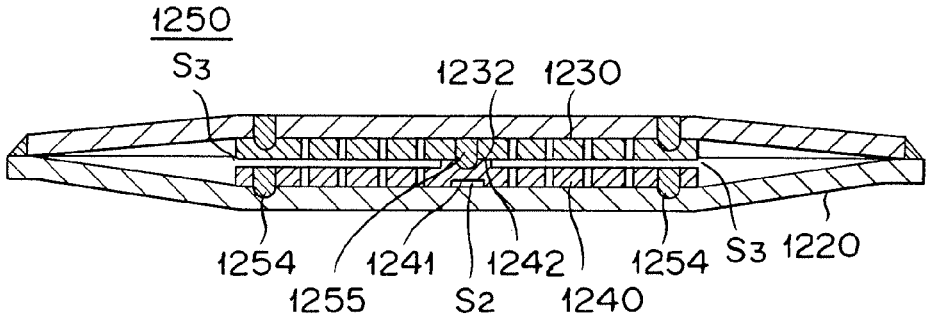
FIG. 73 is across-sectional view of assistance in explaining a preform according to an embodiment B3.

FIG. 73 is a cross-sectional view of assistance in explaining a preform according to the embodiment B3.

A preform 1250 according to the embodiment B3 is substantially different from the preform 1150 according to the embodiment B2 in that the upper insertion plate and the lower insertion plate are different in shape wherein an upper insertion plate 1230 is substantially flat, and a lower insertion plate 1240 has a recess 1241 located substantially in the middle of both ends.

The lower insertion plate 1240 is so disposed as to make the recess 1241 to face against the bottom plate 1220, both ends of the lower insertion plate 1240 are connected to the bottom plate 1220 via a joint 1254, and the recess 1241 forms a space $S_2$ between it and the bottom plate 1220.

A back area 1242 of the recess 1241 of the lower insertion plate 1240 is connected to the upper insertion plate 1030 via a joint 1255. The reference numeral 1232 denotes the back area of the upper insertion plate 1230 that abuts against the back area 1242 of the recess 1241 of the lower insertion plate 1240, the abutment face of the back areas 1232, 1242 define the joint area. The back area 1242 has a protruded shape so that a space $S_3$ is formed between the upper insertion plate 1230 and the lower insertion plate 1240.

As described above, the recess 1241 is formed only on the lower insertion plate 1240, so that the shape of the vicinity of the joint 1255 is not vertically symmetric. On the other hand, the upper insertion plate 1230 and the lower insertion plate 1240 experience a bending condition due to a compression load in the initial stage of hydraulic forming (see FIG. 61).

At this time, the side of the joint 1255 where the recess 1241 is located is more easily bent, so that it is possible to maintain the direction of the initial bending always the same and the location of the joint 1255 always substantially in the middle, different from the case of the preform 1250 according to the embodiment B2. Namely, it is possible to avoid the reinforcement rib from resulting in a distorted shape in the hydroforming due to the difference in the inflation amount.

As can be seen from the above, it is possible to improve the shape quality or accuracy of the reinforcement ribs that divide the hollow cross section of the hydroformed product in the embodiment B3 further than in the embodiment B2.

Figure 74:
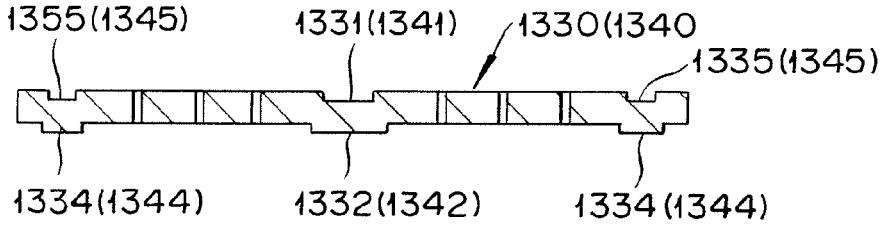
FIG. 74 is a cross-sectional view of assistance in explaining a lower insertion plate and an upper insertion plate that constitute reinforcement members according to an embodiment B4.

FIG. 74 is a cross-sectional view of assistance in explaining a lower insertion plate and an upper insertion plate that constitute reinforcement members according to the embodiment B4. The preform according to the embodiment B4 is generally different from the preform 1150 according to the embodiment B2 in that protrusions are formed on both the upper insertion plate and the lower insertion plate.

Protrusions 1334, 1344 in the embodiment B4 are disposed in the vicinities of the end sections across back areas 1332, 1342 of recesses 1331, 1341. Each of the protrusions 1334, 1344 is formed in a bent shape having a substantially flat summit part and can be formed by a press forming process. Reference numerals 1335, 1345 denote the depressed back areas of the protrusions 1334, 1344.

The protrusions 1334, 1344 are located to abut against each other and the height of the protrusions 1334, 1344 is chosen to match the height of the back areas 1332, 1342 of the recesses 1331, 1341.

As a result, when the upper insertion plate 1330 is laid on the lower insertion plate 1340 aligning the back area 1332 of the upper insertion plate 1330 with the back area 1342 of the lower insertion plate 1340, the protrusion 1334 and the back areas 1332 of the recesses 1331 of the upper insertion plate 1330 abut against the protrusion 1344 and the back area 1342 of the recess 1341 of the lower insertion plate 1340, respectively. In addition, the space $S_3$ formed between the upper insertion plate 1330 and the lower insertion plate 1340 matches the total height of the back areas 1332, 1342.

Figure 75:
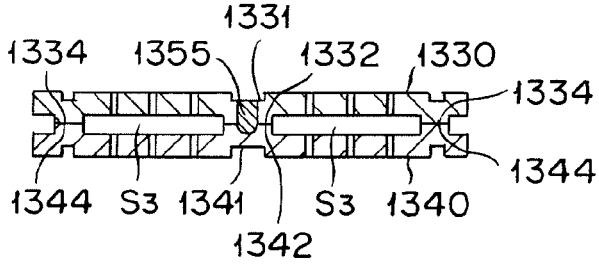
FIG. 75 is a cross-sectional view of assistance in explaining an example method of jointing reinforcement members shown in FIG. 74 showing the jointing process of the upper insertion plate to the lower insertion plate.
Figure 76:
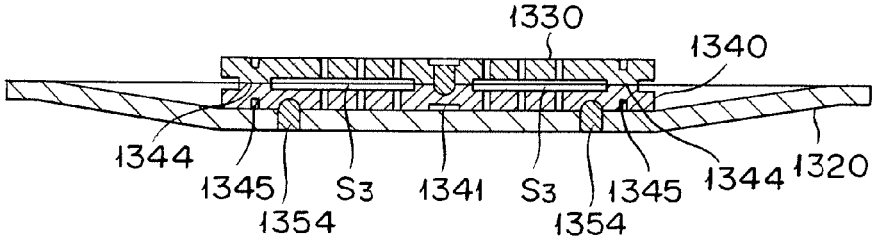
FIG. 76 is across-sectional view of assistance in explaining jointing process of a lower insertion plate to a bottom plate following FIG. 75.
Figure 77:
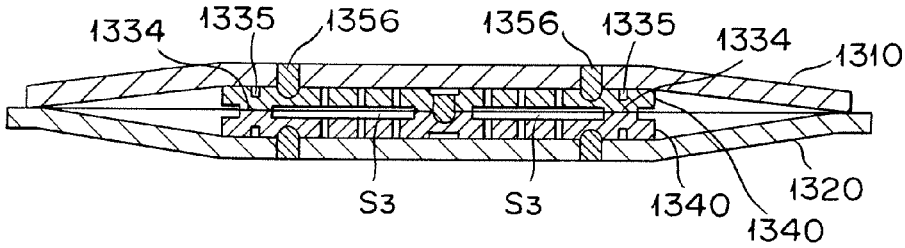
FIG. 77 is across-sectional view of assistance in explaining jointing process of a top plate to the upper insertion plate following FIG. 76.
Figure 78:
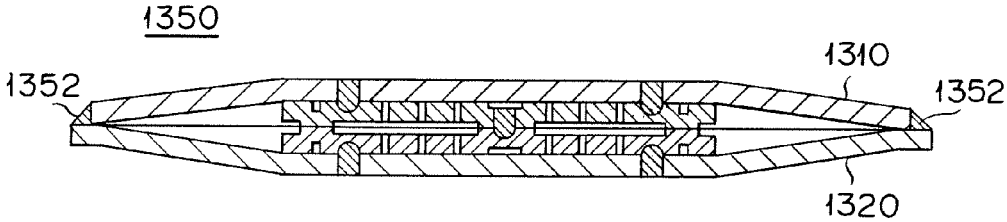
FIG. 78 is across-sectional view of assistance in explaining jointing process of the top plate to the bottom plate following FIG. 77.

Next, an example of the method for jointing the reinforcement members shown in FIG. 74 will be described. FIG. 75 is a cross-sectional view of assistance in explaining the jointing process of the upper insertion plate to the lower insertion plate, FIG. 76 is a cross-sectional view of assistance in explaining the jointing process of the lower insertion plate to a bottom plate following FIG. 75, FIG. 77 is a cross-sectional view of assistance in explaining the jointing process of a top plate to the upper insertion plate following FIG. 76, and FIG. 78 is a cross-sectional view of assistance in explaining the jointing process of the top plate to the bottom plate following FIG. 77.

First, overlap the upper insertion plate 1330 on the lower insertion plate 1340 disposed at a specified position in such a way as to cause the protrusion 1334 and the back areas 1332 of the recesses 1331 of the upper insertion plate 1330 to abut against the protrusion 1344 and the back area 1342 of the recess 1341 of the lower insertion plate 1340. Then joint the recess 1331 of the upper insertion plate 1330 to the back area 1342 of the recess 1341 of the lower insertion plate 1340 by pierce welding to form the joint 1355 (see FIG. 75).

Different from the case of the embodiment B2 wherein it is supported in one place, the upper insertion plate 1330 is stable as it is supported by three locations in total, i.e., the protrusions 1344 and the back part 1342 of the recess 1341 of the lower insertion plate 1340 in cooperation with the protrusions 1334 and the back part 1332 of the recess 1331. Therefore, it is not necessary to use the wedging plates 1158, 1159 which are otherwise required to cancel the instability, so that it can reduce the production man-hour related to the wedging plates 1158, 1159 and provide a better productivity.

After that, the jointed member consisting of the upper insertion plate 1330 and the lower insertion plate 1340 is disposed in such a way that the recess 1341 of the lower insertion plate 1340 faces the bottom plate 1320. Next, joint the bottom plate 1320 to both ends of the lower insertion plate 1340 by pierce welding to form the joint 1354 (see FIG. 76). The welding locations are in the vicinities of the protrusions 1344 and the back areas 1345.

In fact, the joint 1354 is formed by welding the first sheet material or the bottom plate 1320 located on the surface to the second sheet material or the lower insertion plate 1340 located below the first sheet material while stacking more than three pieces of sheet materials that constitute the reinforcement member and the reinforcement members, i.e., the bottom plate 1320, the upper insertion plate 1330 and lower insertion plate 1340.

On the other hand, the space $S_3$ is formed between the upper insertion plate 1330 and the lower insertion plate 1340 by abutting the protrusions 1334, 1344 as well as the back areas 1332, 1342 of the recesses 1331, 1341. Thus, the space $S_3$ prevents the transmission of welding heat and inadvertent welding failure of the second sheet material or the lower insertion plate 1340 to the third sheet material or the upper insertion plate 1330, and improves the welding yield.

When the formation of the joint 1354 is completed, the top plate 1310 is laid matching the edges of the top plate 1310 with the edges of the bottom plate 1320. Next, joint the top plate 1310 to both ends of the upper insertion plate 1330 by pierce welding to form the joint 1356 (see FIG. 77). The welding locations are in the vicinities of the protrusions 1334 and the back areas 1335, and the space $S_3$ exists between the upper insertion plate 1330 and the lower insertion plate 1340.

Accordingly, the joint 1356 is formed by welding the first sheet material or the top plate 1310 located on the surface to the second sheet material or the upper insertion plate 1330 located below the first sheet material while stacking more than three pieces of sheet materials that constitute the outer members and the reinforcement member, i.e., the top plate 1310 and bottom plate 1320, and the upper insertion plate 1330 and lower insertion plate 1340. In addition, the space $S_3$, which is aligned with the joint area, is located between the upper insertion plate 1330 as the second sheet material and the lower insertion plate 1340 as the third sheet material located below the second sheet material.

The space $S_3$ therefore prevents the transmission of welding heat and inadvertent welding failure of the second sheet material or the upper insertion plate 1330 to the third sheet material or the lower insertion plate 1340, and thus improves the welding yield.

When the joint 1356 is completed, the overlapping edges of the top plate 1310 and the bottom plate 1320 are jointed to complete the preform 1350 (see FIG. 78). The reference numeral 1352 denotes the joint formed on the edges.

As can be seen from the above, the embodiment B4 makes it possible to improve the productivity in comparison with the embodiment B2 and the embodiment B3.

The heights of the protrusions 1334, 1344 do not have to be identical. For example, the heights of the protrusions 1334, 1344 can be arbitrarily chosen so long as the total height of the protrusions 1334, 1344 matches with the total height of the back areas 1332, 1342 of the recesses 1331, 1341. It is also possible to form protrusions only on the upper insertion plate 1330 or the lower insertion plate 1340. In this case, the height of the protrusion should coincide with the total height of the back areas 1332, 1342 of the recesses 1331, 1341.

Figure 79:
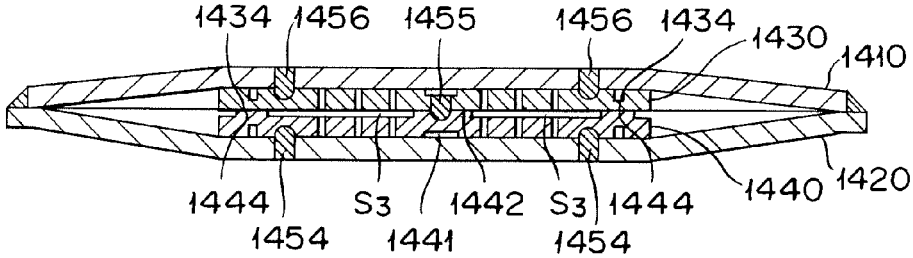
FIG. 79 is across-sectional view of assistance in explaining reinforcement members according to an embodiment B5.

FIG. 79 is across-sectional view of assistance in explaining reinforcement members according to the embodiment B5.

A preform 1450 concerning the embodiment B5 is substantially different from the preform 1350 concerning the embodiment B4 in regard to the shape of the upper insertion plate in that an upper insertion plate 1430 is substantially flat having neither a recess nor a protrusion, and a lower insertion plate 1440 has a recess 1441 and protrusions 1444.

The upper insertion plate 1430 is stable as it is supported by total of three locations, the back area 1442 of the recess 1441 and the protrusions 1444 of the lower insertion plate 1440. As a consequence, this embodiment is capable of reducing the production man-hour and providing a better productivity as in the embodiment B4.

Moreover, the space $S_3$ is formed between the upper insertion plate 1430 and the lower insertion plate 1440 by abutting of the upper insertion plate 1430 against the back areas 1442 of the recesses 1441 and the protrusions 1444. Therefore, if the jointed assembly of the upper insertion plate 1430 and the lower insertion plate 1440 with the joint 1455 is disposed on the bottom plate 1420 for forming the joints 1454 in the vicinities of the protrusions 1444 and the back areas of the protrusions 1444, the space $S_3$ prevents the transmission of welding heat as in the case of the embodiment B4, and thus prevents inadvertent welding failure between the lower insertion plate 1440 and the upper insertion plate 1430, and improves the welding yield.

Furthermore, if the top plate 1410 is disposed on the upper insertion plate 1430 for forming the joints 1456 in the vicinities of the protrusions 1434 that abuts against the protrudes sections 1444 after the joint 1454 is formed, the space $S_3$ prevents the transmission of welding heat as in the case of the embodiment B4, and thus prevents inadvertent welding failure between the upper insertion plate 1430 and the lower insertion plate 1440, and improves the welding yield.

On the other hand, the recess 1441 is formed only on the lower insertion plate 1440 in the preform 1450, so that the shape of the vicinity of the joint 1455 is not vertically symmetric as in the case of the embodiment B3. Therefore, the side of the joint 1455 on which the recess 1441 is located is more likely to bend when hydroforming is applied, so that the initial bending direction becomes always the same and so it becomes possible to keep the location of the joint 1455 substantially in the middle more securely. Namely, it is possible to avoid the reinforcement rib from resulting in a distorted shape in the hydroforming due to the difference in the inflation amount.

As can be seen from the above, it is possible to improve the shape quality or accuracy of the reinforcement ribs that divide the hollow cross section of the hydroformed product in the embodiment B5 further than in the embodiment B4.

The protrusions do not have to be formed on the lower insertion plate 1440, but also can be provided on the upper insertion plate 1430. It is also possible to form protrusions on both the upper insertion plate 1430 and the lower insertion plate 1440. In this case, it is necessary to make the total height of the protrusions substantially equal to the height of the back area 1442 of the recess 1441 of the lower insertion plate 1440.

Figure 80:
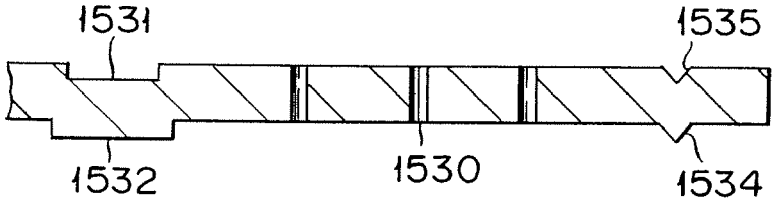
FIG. 80 is a cross-sectional view of assistance in explaining an upper insertion plate that constitutes one of reinforcement members according to an embodiment B6.
Figure 81:
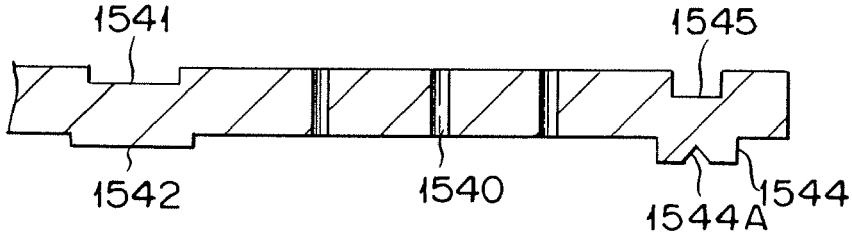
FIG. 81 is across-sectional view of assistance in explaining a lower insertion plate that constitutes the other of the reinforcement members according to the embodiment B6.
Figure 82:
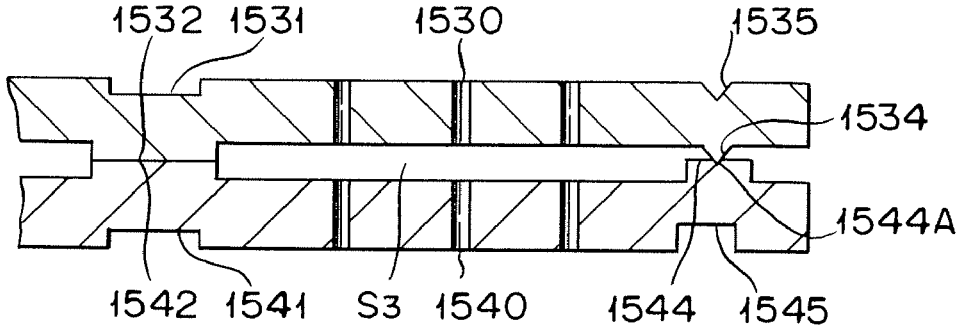
FIG. 82 is a cross-sectional view of assistance in explaining a fitting structure between the upper insertion plate of FIG. 80 and the lower insertion plate of FIG. 81.

FIG. 80 is across-sectional view of assistance in explaining an upper insertion plate that constitutes one of the reinforcement members according to the embodiment B6, FIG. 81 is a cross-sectional view of assistance in explaining a lower insertion plate that constitutes the other of the reinforcement members according to the embodiment B6, and FIG. 82 is a cross-sectional view of assistance in explaining a fitting structure between the upper insertion plate of FIG. 80 and the lower insertion plate of FIG. 81.

A preform concerning the embodiment B6 is substantially different from the preform 1350 (see FIG. 68) concerning the embodiment B4 in regard to the shape of the upper insertion plate and the lower insertion plate in that an upper insertion plate 1530 concerning the embodiment B6 has protrusions 1534 disposed across a back area 1532 of a recess 1531. The protrusion 1534 is formed substantially in a v-shape and is located in the vicinity of the end of the upper insertion plate 1530.

On the other hand, a lower insertion plate 1540 has receiving parts 1544 disposed across a back area 1542 of a recess 1541. The receiving part 1544 includes a protrusion formed by a press forming process, and is positioned to fit properly with the protrusion 1534 of the upper insertion plate 1530. The receiving part 1544 has a summit part on which a concave 1544A is provided to fit properly with the protrusion 1534 of the upper insertion plate 1530. A reference numeral 1545 denotes the depressed back area of the receiving part 1544.

A space $S_3$ formed between the lower insertion plate 1540 and the upper insertion plate 1530 when the receiving part 1544 of the lower insertion plate 1540 fits with the protrusion 1534 of the upper insertion plate 1530 matches with the sum of the height of the back area 1532 of the recess 1531 of the upper insertion plate 1530 and the height of the back area 1542 of the recess 1541 of the lower insertion plate 1540.

When the upper insertion plate 1530 is laid over the lower insertion plate 1540, the protrusion 1534 of the upper insertion plate 1530 fits with the receiving part 1544 of the lower insertion plate 1540 in a specified position. Specifically, the protrusion 1534 and the receiving part 1544 can function as the positioning mechanism of the upper insertion plate 1530 for the lower insertion plate 1540.

Therefore, when jointing the recess 1531 of the upper insertion plate 1530 to the back area 1542 of the recess 1541 of the lower insertion plate 1540 by pierce welding to form joints (FIG. 75), the overlapping of the upper insertion plate 1530 to the lower insertion plate 1540 can be easily and quickly done.

As can be seen from the above, the embodiment B6 makes it possible to improve the productivity in comparison with the embodiment B4.

It is also possible to dispose the receiving part 1544 on the upper insertion plate 1530 and dispose the protrusion 1534 to the lower insertion plate 1540.

The positioning mechanism by means of the protrusion 1534 and the receiving part 1544 can be applied to the embodiment B3 as well. For example, the overlapping of the upper insertion plate 1230 on the lower insertion plate 1240 can be easily and speedily done by disposing the protrusion 1534 on the upper insertion plate 1230 and disposing the receiving part 1544 on the lower insertion plate 1240.

In this case, the space $S_3$ formed between the lower insertion plate 1240 and the upper insertion plate 1230 by fitting the receiving part 1544 of the lower insertion plate 1240 to the protrusion 1534 of the upper insertion plate 1230 should match with the height of the back area 1242 of the recess 1241 of the lower insertion plate 1240. It is also possible to dispose the receiving part 1544 on the upper insertion plate 1230 and dispose the protrusion 1534 to the lower insertion plate 1240.

Figure 83:
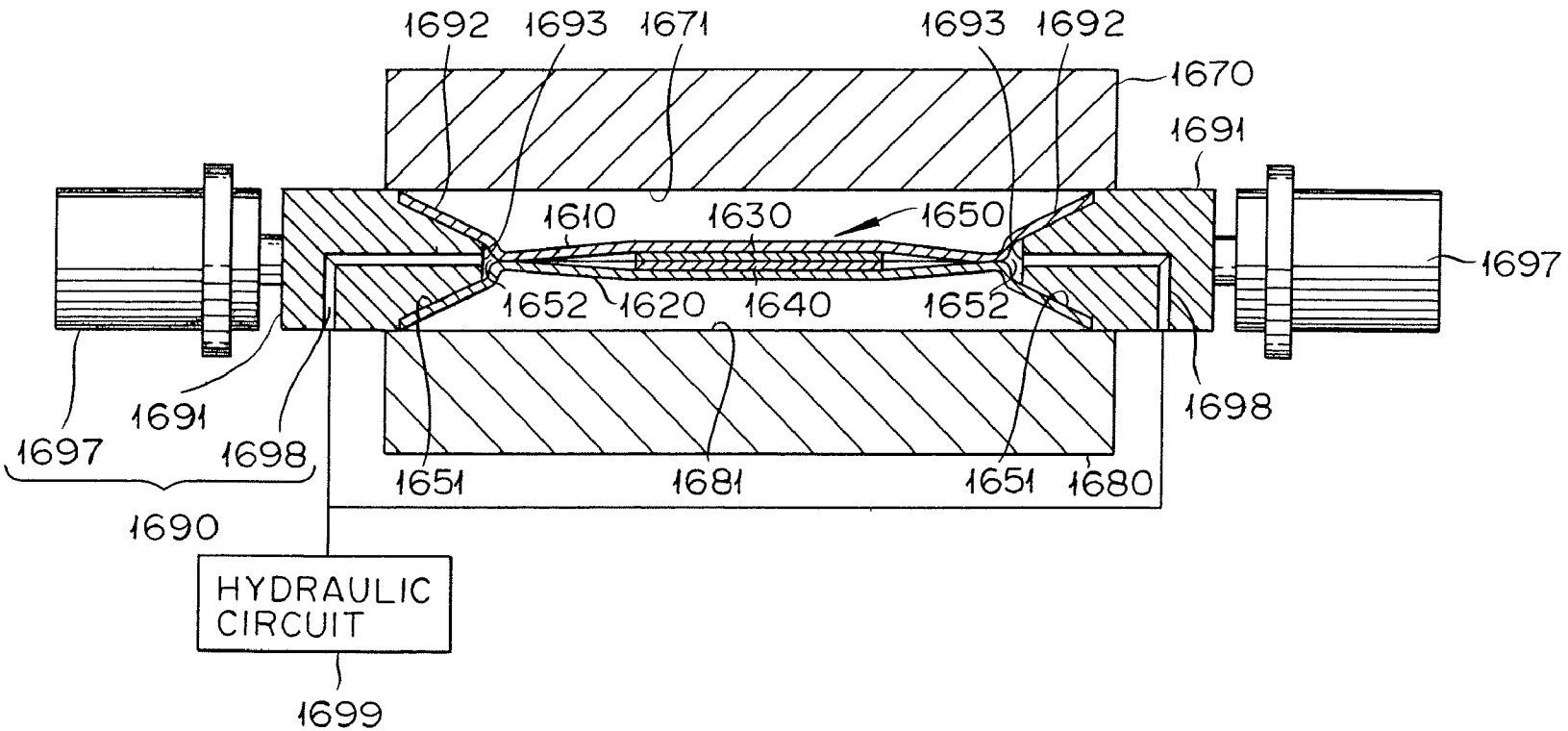
FIG. 83 is a cross-sectional view of assistance in explaining an embodiment B7.

FIG. 83 is across-sectional view of assistance in explaining an embodiment B7.

The embodiment B7 is substantially different from the embodiment B1 in the shape of the preform and the constitution of the hydroforming apparatus, and a preform 1650 concerning the embodiment B7 has a top plate 1610 and a bottom plate 1620 to form outer surfaces of a hydroformed product, an upper insertion plate 1630 and a lower insertion plate 1640 to form reinforcement ribs of the hydroformed product, and a non-jointing part 1651 for providing hydraulic pressure by accepting a forming medium.

The upper insertion plate 1630 and the lower insertion plate 1640 are disposed inside of the top plate 1610 and the bottom plate 1620. The non-jointing part 1651 is constituted of the abutment face between the end of the top plate 1610 and the end of the bottom plate 1620. The abutment face is preformed in substantially a conical shape. The non-jointing part 1651 has an outer end on which a circular opening is provided and an inner end 1652 communicating with the inside of the preform 1650. Namely, the preform 1650 has an opening formed by the abutment face between end of one of the outer members 1610, 1620 and the end of the other of the outer members 1610, 1620. The non-jointing part 1651 is not limited to a shape being disposed throughout the end surface but can be partially disposed.

The top plate 1610 is disposed to face a cavity surface 1671 of a top die 1670. The bottom plate 1620 is disposed to face a cavity surface 1681 of a bottom die 1680. The cavity surfaces 1671, 1681 correspond to the outer surfaces of the hydroformed product.

A hydraulic pressure supply mechanism 1690 has a flow path 1698 that communicates with a hydraulic circuit 1699, an axial press punch 1691, and an axial press cylinder 1697. The axial press punch 1691 is located on each side of the top die 1670 and the bottom die 1680 and is connected to the axial press cylinder 1697. The axial press punch 1691 has a nozzle unit 1692.

The nozzle unit 1692 has an injection port 1693 that communicates with the flow path 1698, and presents a substantially conical shape that corresponds with the shape of the non-jointing part 1651. The axial press cylinder 1697 supports the axial press punch 1691 to move towards or away from the dies, or the top die 1670 and the bottom die 1680. The power source of the axial press cylinder 1697 is typically hydraulic or pneumatic.

The non-jointing part 1651 of the preform 1650 expands when the nozzle unit 1692 is pushed into its opening, while its expanded diameter is restricted by the top die 1670 and the bottom die 1680. As a consequence, the non-jointing part 1651 makes a close contact with the nozzle unit 1692 providing a sealing effect.

The injection port 1693 of the nozzle unit 1692 is aligned with the inner end 1652 that communicates with the inside of the preform 1650. As a consequence, the forming medium supplied from the hydraulic circuit 1699 is introduced to the flow path 1698 and the injection port 1693, the forming medium is injected into the inside of the preform 1650 via the non-jointing part 1651 and the inner end 1652.

Therefore, the hydraulic pressure supply mechanism 1690 applies a hydraulic pressure to the inside of the preform 1650 to cause an inflating deformation.

As can be seen from the above, the embodiment B7 can form the outer surfaces of a hydroformed product and reinforcement ribs that divide the hollow cross section of the preform 1650 by causing an inflating deformation by means of hydraulic pressure by introducing a forming medium into an opening created by an abutment face between the end surface of one of the outer members 1610, 1620 and the end surface of the other of the outer members 1610, 1620.

It is obvious that this invention is not limited to the particular embodiments shown and described above but may be variously changed and modified without departing from the technical concept of this invention.

For example, depending on the intended hydroformed product, it is possible to modify as needed the shapes of the sheet materials that constitute the first and second outer members, the sheet materials that constitute the reinforcement members, locations of the recesses, the locations of the sheet materials that constitute the reinforcement members of the preform, etc.

It is also possible to form reinforcement ribs that evenly divide the hollow cross section of the hydroformed product in substantially vertical direction as well as in substantially horizontal direction by disposing and jointing the first and second reinforcement members in an offset manner. Moreover, it is possible to have reinforcement ribs that unevenly divide the hollow cross section of the hydroformed product by using the first and second reinforcement members with different shapes.

This application is based on Japanese Patent Application Nos. 2004-285233 and 2004-285240 filed on Sep. 29, 2004, the contents of which are hereby incorporated by reference.

What is claimed is:

1. A hydroforming method comprising the steps of:

disposing a preform inside forming dies having cavity surfaces that correspond to an outer shape of a hydroformed product; and applying a hydraulic pressure in an inside of said preform to form reinforcement ribs that divide a hollow cross section of said hydro formed product, in which said preform comprises first and second outer members composed of sheet materials having edges overlapped and jointed to each other for forming outer surfaces of the hydroformed product, and reinforcement members composed of a sheet material jointed to said first and second outer members to form said reinforcement ribs, said reinforcement members having a plurality of openings that are disposed in a staggered pattern and can be expanded by inflating deformation during hydroforming, in which said reinforcement ribs are formed by suppressing a fracture of said reinforcement members caused by elongations of said reinforcement members in a tensile direction due to a tensile force developed during inflating deformation of said preform as a result of expansions of said openings.

2. A hydroforming method as claimed in claim 1, wherein said hydraulic pressure is applied by means of injecting a forming medium into an opening formed in either said first or second outer member.

3. A hydroforming method as claimed in claim 2, wherein said hydraulic pressure is applied by means of injecting a forming medium into an opening formed by an abutment face between an end of said first outer member and an end of said second outer member.

4. A hydroforming method as claimed in claim 1, wherein said reinforcement members have dimensions capable of suppressing said elongation, wherein said sheet material of said reinforcement members maintains slackness to bend due to said dimensions during inflating deformation of said preform to form reinforcement ribs in bending shapes with slackness.

* * * * *